US006126384A

United States Patent [19]

Darcy et al.

[11] Patent Number: 6,126,384

[45] Date of Patent: Oct. 3, 2000

[54] PAPER SET FEEDING

[75] Inventors: James A. Darcy, Windham; Thomas E. Weeks, Manchester, both of N.H.; Gilbert G. Fryklund, Winchester, Mass.

[73] Assignee: Standard Duplicating Machines Corporation, Andover, Mass.

[21] Appl. No.: 08/966,462

[22] Filed: Nov. 7, 1997

Related U.S. Application Data

[63] Continuation-in-part of application No. 08/635,647, Apr. 22, 1996, abandoned, which is a continuation-in-part of application No. 08/587,636, Jan. 17, 1996, Pat. No. 5,820,334, which is a division of application No. 08/486,931, Jun. 7, 1995, Pat. No. 5,556,254.

[51] Int. Cl.[7] ..... B65G 59/06

[52] U.S. Cl. ..... 414/800; 414/801

[58] Field of Search ..... 414/796.6, 796.7, 414/796.8, 796.9, 795.5, 800, 801

[56] References Cited

U.S. PATENT DOCUMENTS

| | | | |
|---|---|---|---|
| 820,804 | 5/1906 | Lucy . | |
| 1,158,045 | 10/1915 | Graham . | |
| 2,936,909 | 5/1960 | Gard . | |
| 3,095,193 | 6/1963 | Sorenson . | |
| 3,190,642 | 6/1965 | Smith . | |
| 3,206,042 | 9/1965 | Peterson . | |
| 3,640,426 | 2/1972 | Hammer . | |
| 3,661,278 | 5/1972 | Hammerle . | |
| 3,690,476 | 9/1972 | Stacy . | |
| 3,726,168 | 4/1973 | Glanz et al. . | |
| 3,815,762 | 6/1974 | Hoke et al. . | |
| 3,960,291 | 6/1976 | Navi . | |
| 3,995,092 | 11/1976 | Hubert . | |
| 3,997,067 | 12/1976 | Murata . | |
| 4,046,370 | 9/1977 | Navi . | |
| 4,079,846 | 3/1978 | Tsuruta . | |
| 4,119,219 | 10/1978 | Marschke . | |
| 4,247,093 | 1/1981 | Kistner et al. . | |
| 4,396,336 | 8/1983 | Malamood . | |
| 4,405,276 | 9/1983 | Wiegand . | |
| 4,547,115 | 10/1985 | Charbonnet . | |
| 4,667,948 | 5/1987 | Angelbeck et al. . | |
| 4,696,615 | 9/1987 | Ettischer et al. . | |
| 4,699,371 | 10/1987 | Ettischer et al. . | |
| 4,701,094 | 10/1987 | Courjaret et al. . | |
| 4,718,808 | 1/1988 | Hoshino et al. . | |
| 4,718,809 | 1/1988 | Krasuski et al. . | |
| 4,783,064 | 11/1988 | Hayashi . | |
| 4,907,942 | 3/1990 | Pfeil . | |
| 4,955,784 | 9/1990 | Staszenski et al. . | |
| 4,966,521 | 10/1990 | Frye et al. . | |
| 4,988,263 | 1/1991 | Odenthal . | |
| 5,011,126 | 4/1991 | Suzuki et al. . | |
| 5,017,085 | 5/1991 | Ishikawa | 414/796.8 |
| 5,018,940 | 5/1991 | Hognestad et al. . | |
| 5,026,250 | 6/1991 | Hofer . | |
| 5,044,874 | 9/1991 | Shill | 414/796.8 |
| 5,062,764 | 11/1991 | Welsch | 414/796.8 |
| 5,067,702 | 11/1991 | Muraishi et al. . | |
| 5,096,367 | 3/1992 | Winski . | |
| 5,096,370 | 3/1992 | Mohr . | |
| 5,096,372 | 3/1992 | Maejima . | |

(List continued on next page.)

FOREIGN PATENT DOCUMENTS

| | | | |
|---|---|---|---|
| 3443735 | 6/1986 | Germany . | |
| 3641434 | 6/1988 | Germany | 414/796.8 |
| 81832 | 3/1990 | Japan . | |
| 749777 | 7/1980 | U.S.S.R. . | |
| 1039435 | 8/1966 | United Kingdom . | |

OTHER PUBLICATIONS

PCT Search Report, Apr. 2, 1999.

*Primary Examiner*—Douglas Hess
*Attorney, Agent, or Firm*—Fish & Richardson P.C.

[57] ABSTRACT

A sheet set feeder receives a stack of offset-jogged sheet sets, including a topmost sheet set and a next-to-topmost sheet set. The feeder separates the topmost sheet set from the remainder of the stack.

10 Claims, 52 Drawing Sheets

U.S. PATENT DOCUMENTS 5,102,293 4/1992 Schneider .
5,205,705 4/1993 Jenker ..... 414/796.8
5,207,416 5/1993 Soler .
5,244,340 9/1993 Pizzi et al. .
5,261,667 11/1993 Breeding .
5,380,147 1/1995 Hess et al. .
5,417,543 5/1995 Focke et al. .
5,556,254 9/1996 Darcy et al. ..... 414/798.1
5,641,266 6/1997 Lehtimaki ..... 414/796.8
5,692,878 12/1997 Freund ..... 414/796.8
5,820,334 10/1998 Darcy et al. ..... 414/798.1

PAPER SET FEEDING

This is a continuation-in-part of application Ser. No. 08/635,647, filed Apr. 22, 1996, now abandoned which is a continuation-in-part of application Ser. No. 08/587,636, filed Jan. 17, 1996, now U.S. Pat. No. 5,820,334, which is a divisional of 08/486,931, filed Jun. 7, 1995, now U.S. Pat. No. 5,556,254.

BACKGROUND OF THE INVENTION

The invention relates to feeding offset-jogged sets of sheets.

Many devices for printing and/or processing sheets of paper, such as laser or other electronic printers, offset printers, photocopiers, and collating equipment, can be operated to produce plural "sheet sets," e.g., where each set of sheets is one copy of a multiple-page document. Successive sheet sets in the "stack" of sets are typically "offset-jogged" or "offset-stacked" with respect to one another. That is, each individual set is shifted or offset—either laterally, longitudinally, or radially—with respect to the immediately adjacent set or sets.

After being printed and/or collated, individual sheet sets are often processed, such as by covering, trimming, folding, stitching, or otherwise binding them. Such processing can occur either "on-line" or "off-line." In on-line processing, individual sheet sets are removed and transported to the processor as they are outputted from the printer or collator.

In off-line processing, the entire stack of sheet sets is transferred to the processor or processors after printing or collating is complete. The processor then identifies and processes individual sheet sets. Because processing equipment typically has a higher "throughput rate" (i.e., sheets per unit time) than printers or collators, the outputs of several printers and/or collators may be fed to a single processing unit.

SUMMARY OF THE INVENTION

In one aspect of the invention, a shutter mechanism disposed beneath a hopper for a stack of offset-jogged sheet sets defines an aperture sized to admit individual sets from the stack. The shutter mechanism is driven so that the aperture moves from beneath one end of the bottommost sheet set—where a retainer supports the next-to-bottommost sheet set—to beneath the other end of the bottommost set.

Another aspect of the invention is a method for feeding individual sets from a stack of offset-jogged sheet sets in a hopper. A shutter beneath the hopper is moved so that an aperture defined by the shutter moves from beneath one end of the bottommost sheet set to beneath the other end of the set.

Among other advantages, the invention—which can be linked to the outputs of existing printing, copying, and/or collating equipment that produces offset-jogged sets—can be used to separate an individual sheet set as a whole from a stack of such sets for further processing, such as covering, trimming, or binding. Because it manipulates entire sheet sets, the invention can process a greater number of sheets per unit time than a device cycling at the same speed that manipulates every sheet within each set. Conversely, the invention can achieve the same overall sheet throughput rate as such a single-sheet manipulator while operating at lower cyclical speeds, thus reducing the likelihood of jamming and both the magnitude and rate of wear.

The invention achieves these advantages by capitalizing on the offset-jogged nature of the stack of sheet sets. It is thus not necessary to, e.g., mark individual sheet sets, such as with bar codes or other optically readable markings that might remain on the final document and detract from its overall appearance. Nor is it necessary to, e.g., reformat or modify in any way the output from the printer or collator, such as by segregating individual sheet sets with physical markers, such as slip sheets or chip boards interleaved between adjacent sets. Because such markers need not be added to the stack as the sets are generated or separated out from the individual, separated sheet sets prior to processing, the overall complexity of the set-separating operation is reduced.

Moreover, the invention can be used to separate sheet sets automatically, reducing or eliminating entirely the amount of human operator involvement necessary to process stacks of sets.

Preferred embodiments of the invention include the following features.

In a particularly useful embodiment, a sheet set conveyor (e.g., a rotator or a conveyor belt) is disposed beneath the aperture, and a door is disposed between the conveyor and the aperture. The door serves as a buffer to hold an individual sheet set after it passes through the aperture, and opens quickly to drop the set onto the conveyor below. The shutter defining the aperture includes a series of rollers extending, e.g., between flexible drive members such as link chains or the sides of a rigid planar frame. A sheet of urethane on a tensioning bar biased towards the rollers contacts at least some of the rollers, causing the rollers to spin as the aperture is moved with respect to the hopper by, e.g., a reversible motor or a linear actuator.

Like the retainer supporting the next-to-bottommost sheet set, another retainer supports the bottommost sheet set. The retainers comprise shelves that extend from opposed sides of the hopper a distance approximately equal to the distance between the offset-jogged ends of the bottommost and next-to-bottommost sheet sets. The shelves are pivotally (or alternatively, slidably) mounted to the feeder housing, and include sheets of urethane located to contact the next-to-bottommost and bottommost sheet sets. The separation of adjacent sheet sets in the hopper is facilitated by wedges at the edges of the aperture, as well as by air jet passages in either the shelves or the wedges that provide timed air jet blasts.

In another useful embodiment, the retainer for supporting the next-to-bottommost set comprises a portion of the shutter disposed adjacent the aperture. The aperture is defined by opposed edges of two shutter portions that can be moved with respect to one another.

In another aspect of the invention, a sheet set processing system includes an offset-jogged sheet set feeder, a sheet set processor, and a mechanical conveyor that conveys sets from the feeder to the processor.

Among other advantages in addition to those identified above, the processing system can be used to automatically separate and process individual sheet sets from a stack of such sets loaded into the feeder.

In a particularly useful embodiment, the system includes a cover feeder, and the sheet set processor comprises one or more of the following: a stitcher, a folder, a face trimmer, a perfect binder, a mailing/inserting system, a shrink wrapper, or a collator.

In another aspect of the invention, a sheet set feeder includes a gripper configured to receive a topmost sheet set while the set is disposed above a next-to-topmost sheet set in a stack of sheet sets. A member engages the next-to-topmost set while the topmost set is being received into the gripper.

In embodiments of this aspect of the invention, the gripper (e.g., including a pair of opposed jaws controlled to move towards one another by an actuator) is configured to move towards the stack, and the topmost sheet set is received into the gripper as it moves towards the stack. Alternatively, the feeder can include a mover (e.g., a pusher including a plow carried at the end of an actuator) for moving the topmost sheet set into the gripper. In either event, the gripper can movable with respect to the housing, e.g., a sufficient distance to move the topmost set completely off the stack.

Embodiments of this aspect of the invention can also include an actuator that pivots the member with respect to the stack. The member can be disposed on the opposite side of the stack from the gripper, and a sensor can sense the position of the member with respect to the stack.

Embodiments of this aspect of the invention can also include an air jet carried on the member and oriented to direct a stream of air between the topmost sheet set and the next-to-topmost sheet set, e.g., while the member engages the next-to-topmost sheet set.

Embodiments of this aspect of the invention can also include a conveyor configured to receive the topmost sheet set from the gripper, and/or an elevator at the bottom of the hopper.

In another aspect of the invention, a sheet set feeder includes two members. The first member (e.g., a gripper) slides the topmost sheet set completely off a stack of sheet sets while the second member engages the next-to-topmost sheet set in the stack.

In addition to the features discussed above, embodiments of this aspect of the invention can include a sensor to detect the level of the stack, and an elevator at the bottom of the hopper that receives the set. The gripper slides the topmost sheet set completely off the stack at a predetermined level with respect to the hopper.

In another aspect of the invention, a sheet set feeder includes a gripper with jaws configured to receive the topmost sheet set in a stack, a pusher configured to push the topmost sheet set into the jaws of the gripper, and a member that engages the next-to-topmost sheet set while the pusher pushes the topmost sheet set.

Embodiments of this aspect of the invention can include the features discussed above.

Another aspect of the invention is a method for feeding sheet sets in which a hopper is loaded with an offset-jogged stack of sheet sets. The topmost sheet set is removed from the stack while the next-to-topmost sheet set remains in the stack.

In addition to the features discussed above, in embodiments of this aspect of the invention the step of removing the topmost sheet set from the stack can involve gripping an end of the topmost sheet set and sliding it completely off the stack. The next-to-topmost sheet set can be engaged (e.g., held down) while the topmost sheet set is being gripped.

Another aspect of the invention is a method for feeding sheet sets in which a hopper is loaded with an offset-jogged stack of sheet sets. While the next-to-topmost sheet set is being held, an end of the topmost sheet set is engaged and mechanically grasped, and then removed from the stack.

Embodiments of this aspect of the invention can include the features discussed above.

Among other advantages in addition to those identified above, these top-feeding sheet set feeders and methods can be used to separate the topmost sheet set from the remainder of the stack.

Other advantages and features will become apparent from the following description of the preferred embodiments and from the claims.

DESCRIPTION OF PREFERRED EMBODIMENTS

Figure 1:
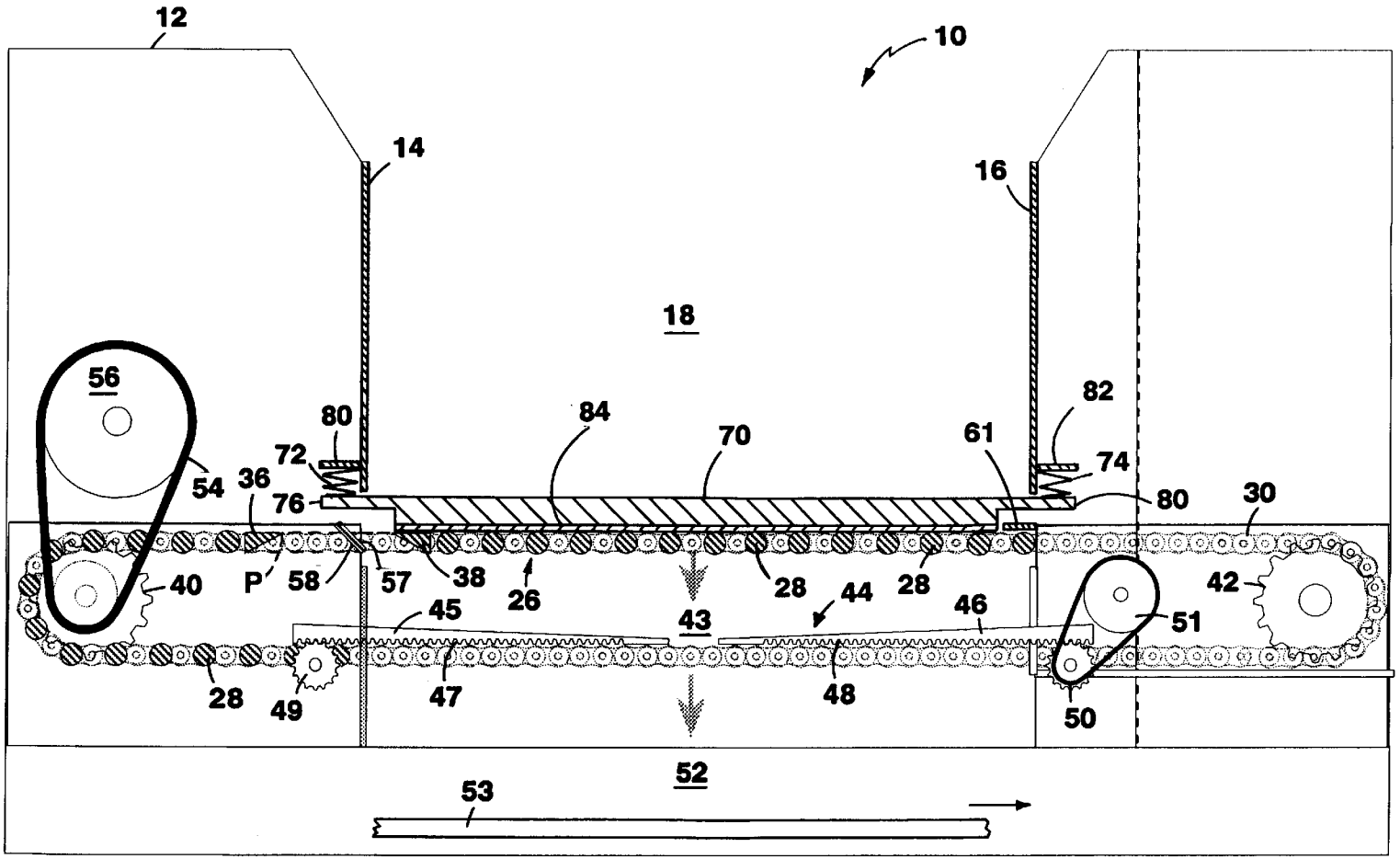
FIG. 1 is a cross-sectional side view of a sheet set feeder.
Figure 2:
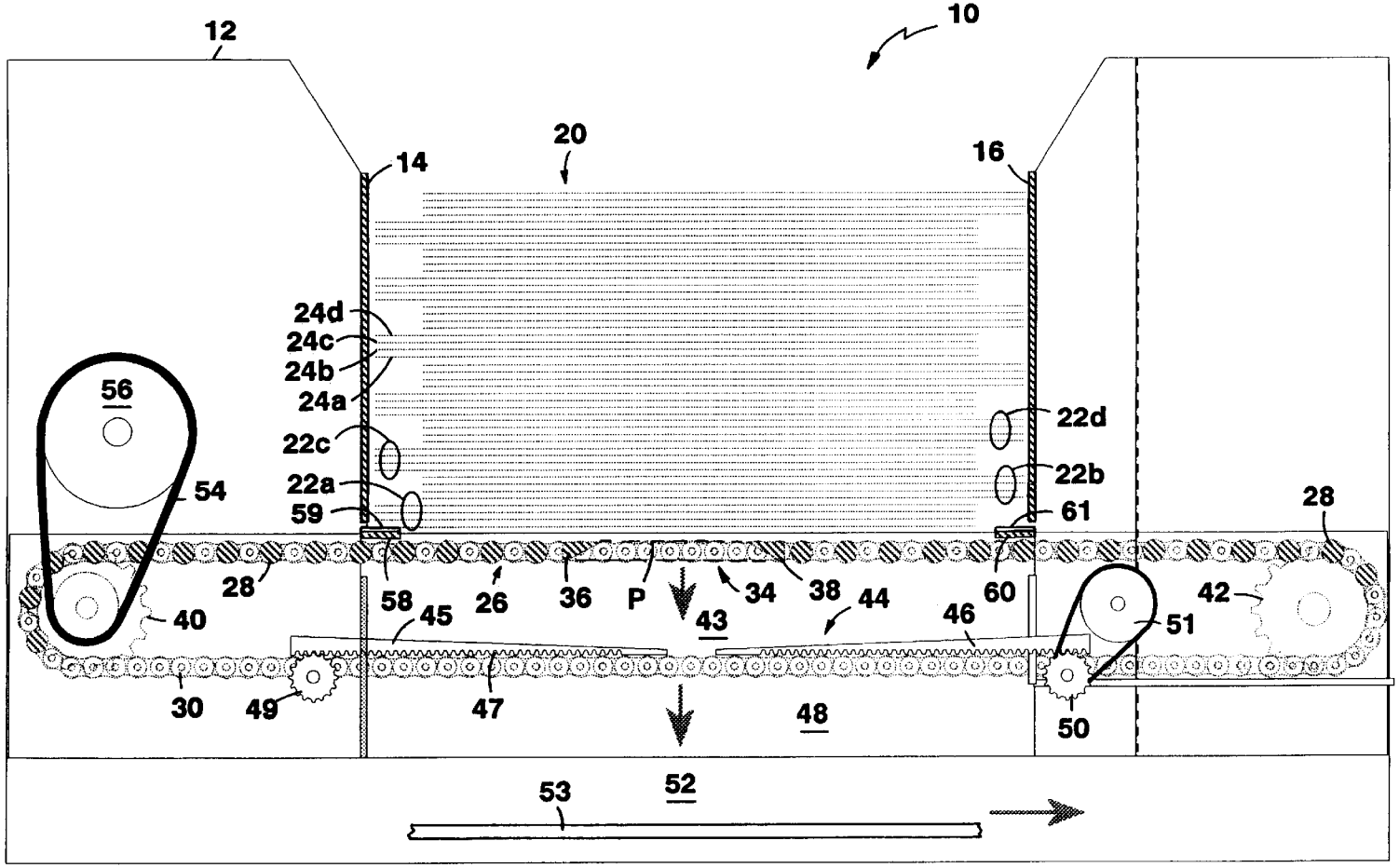
FIG. 2 is a cross-sectional side view of the sheet set feeder shown in FIG. 1, with a stack of sheet sets placed into the feeder.
Figure 3:
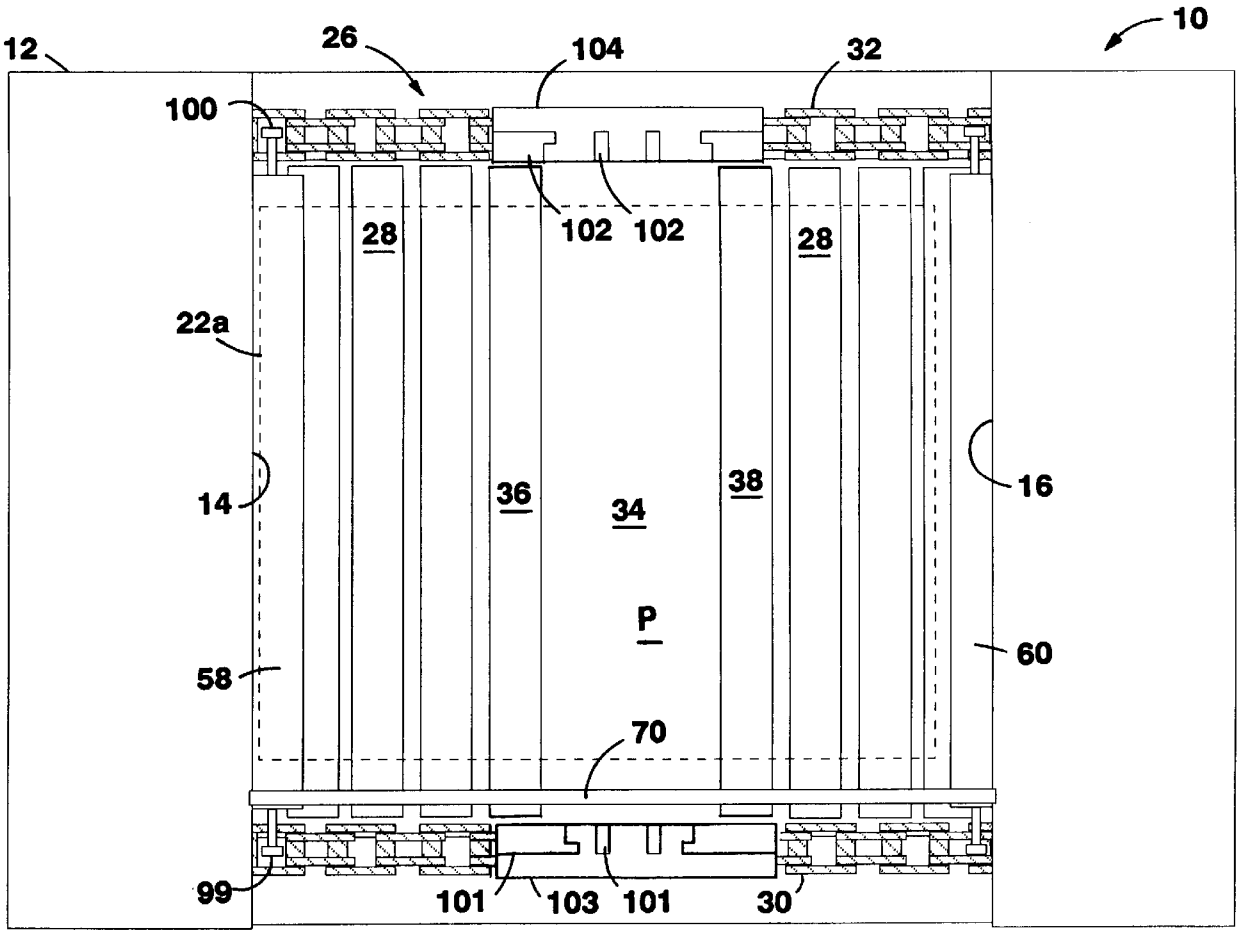
FIG. 3 is a top view of the sheet set feeder shown in FIG. 1.

As shown in FIGS. 1, 2, and 3, a sheet set feeder 10 includes a housing 12. Two facing vertical walls of housing 12, left wall 14 and right wall 16, define a hopper 18 for receiving a stack 20 comprised of offset-jogged sheet sets 22*a*, 22*b*, 22*c*, 22*d*, each of which in turn comprises two or more sheets 24*a*, 24*b*, 24*c*, 24*d* of, e.g., paper. (Sheet set feeder 10 can also be used to feed offset-jogged sets of other types of substantially planar sheets, such as of film or fabric.) The distance between left wall 14 and right wall 16 of hopper 18 is approximately equal to the length of a single sheet set, plus the distance by which each set is offset-jogged with respect to adjacent sets. Right wall 16 can be moved toward and away from left wall 14 to adjust the dimensions of hopper 18 to accommodate sets of different lengths.

A shutter 26 disposed beneath hopper 18 supports stack 20. Shutter 26 comprises a series of support rollers 28 disposed between a pair of link chains 30, 32. Rollers 28 are spaced at regular intervals along chains 30, 32, except for one region intermediate the ends of shutter 26 in which the rollers are separated to define an aperture 34. The top surface of shutter 26 defines a plane P as the top surface of aperture 34. A pair of wedges, left wedge 36 and right wedge 38, are attached, with their pointed ends directed toward one another, to opposite edges of aperture 34. Both the portion of shutter 26 that lies to the left of left wedge 36 and the portion of shutter 26 that lies to the right of right wedge 38 are approximately equal to the distance between left wall 14 and right wall 16 of hopper 18.

The width of aperture 34 (i.e., the distance between chains 30, 32) is selected based on the width of sets 22*a*, 22*b*, 22*c*, 22*d*. The length of aperture 34 (i.e., the distance between the opposed edges of wedges 36, 38) is selected based on, among other things, the thickness of sets 22*a*, 22*b*, 22*c*, 22*d*, the thickness of the individual sheets of paper 24*a*, 24*b*, 24*c*, 24*d* in each set, and the width and length dimensions of the sheets. In general, as the thicknesses of the sets and sheets increase, so also should the length of aperture 34. The length of aperture 34 can be adjusted by, e.g., replacing wedges 36, 38 with wedges of different lengths. Alternatively, the length of aperture 34 could be adjusted automatically based on the dimensions of the sets and sheets placed into hopper 18. It has been found that an aperture length of about 4 in. (10.16 cm.) yields acceptable performance when feeding sets of standard 20 pound, 8½11 in. (21.6×27.9 cm.) sheets of paper, where the sets are between 2 sheets and 1 in. (2.54 cm., about 250 sheets) thick.

Shutter 26, and thus also aperture 34, are reciprocatingly shuttled back and forth with respect to hopper 18 by the action of chains 30, 32. Other flexible drive members, such as belts, bands, or cables, could be used instead of chains 30, 32. Chains 30, 32 are continuous-loop chains that mesh with a pair of sprockets 40, 42 rotatably attached to housing 12. (Only those sprockets that mesh with chain 30 are shown. The sprockets that mesh with chain 32 are arranged in an identical fashion.) One of these sprockets, sprocket 40, is driven through a continuous-loop belt 54 by a reversible electric motor 56. Reversing the direction of rotation of motor 56 reverses also the direction of motion of aperture 34 with respect to hopper 18. In addition, the rotational speed of motor 56 may be controlled to vary the linear speed of chains 30, 32 and aperture 34.

A door 44 is disposed directly beneath shutter 26, such that the space between door 44 and shutter 26 defines a primary set accumulator 43. Door 44 is comprised of left and right door halves 45, 46. A rack 47, 48 attached beneath each door half 45, 46 mates with a pinion gear 49, 50 driven by a respective motor 51 (only the motor 51 that drives right pinion gear 50 is shown). Alternatively, a single motor can be used to drive both pinion gears. Motor 51 is a high-speed reversible electric motor, and the gear train is selected so that door halves 45, 46 open quickly when motor 51 is energized.

A secondary set accumulator 52 is disposed beneath door 44. Secondary set accumulator 52 can include a conveyor belt 53 for carrying away individual sets 22*a*, 22*b*, 22*c*, 22*d* as they drop down from primary accumulator 43, and/or a rotator 540 (FIGS. 17, 18, 19) for rotating the individual sets, e.g., by 90°.

Sheet set feeder 10 further includes a pair of shelves, left shelf 58 and right shelf 60, pivotally attached to housing 12. When they are horizontal, shelves 58, 60 extend away from walls 14, 16 a distance approximately equal to the distance between the ends of adjacent offset-jogged sheet sets 22*a*, 22*b*, 22*c*, 22*d*. Thus, left shelf 58 extends far enough into hopper 18 to support the left edge of sheet set 22*a*, but not far enough to support the left edge of sheet set 22*b*. Similarly, right shelf 60 extends far enough into hopper 18 to support the right edge of sheet set 22*b*, but not far enough to support the right edge of sheet set 22*a*. Sheets of urethane 57, 61 on the top surfaces of left and right shelves 58, 60 prevent the sets 22*a*, 22*b*, 22*c*, 22*d* from slipping off the shelves as shutter 26 moves back and forth.

When aperture 34 shuttles toward and past left wall 14 of hopper 18, left shelf 58 rotates clockwise to the near-vertical orientation shown in FIG. 1. When aperture 34 shuttles back toward right wall 16, left shelf 58 rotates counter-clockwise to its original, horizontal orientation, as shown in FIG. 2. Similarly, when aperture 34 shuttles past right wall 16 of hopper 18, right shelf 58 rotates counter-clockwise to a near-vertical orientation, and rotates clockwise back to its horizontal orientation when aperture 34 shuttles back toward left wall 14.

Figure 4A:
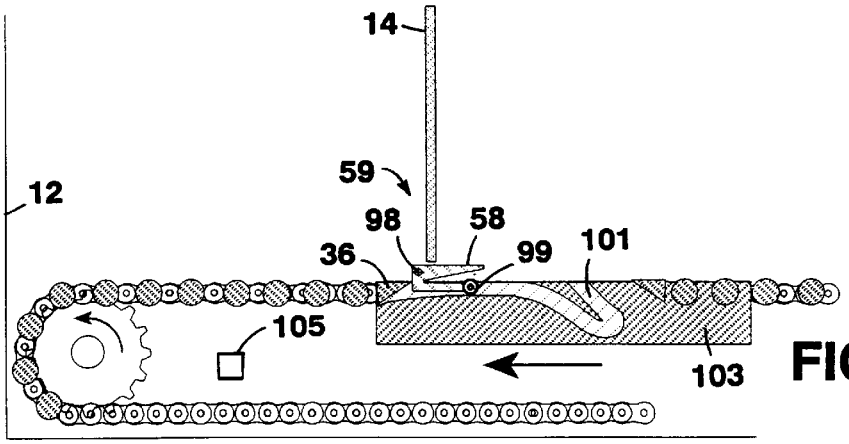
FIGS. 4A, 4B, and 4C are cross-sectional side views of a mechanism for actuating a shelf of the sheet set feeder shown in FIG. 1.
Figure 4B:
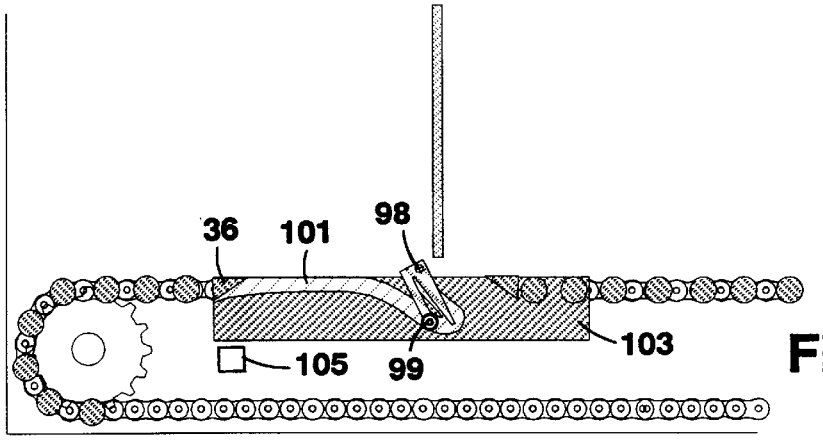
Figure 4C:
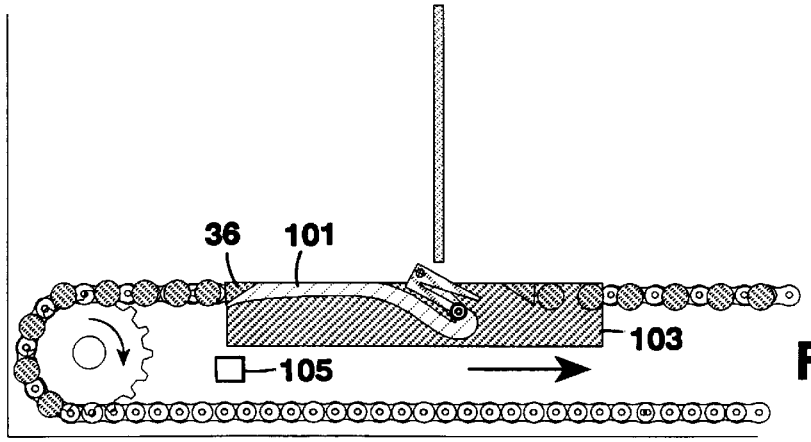

The mechanism 59 for actuating left shelf 58 is shown in detail in FIGS. 4A, 4B, and 4C. The mechanism for actuating right shelf 60 is identical in all material respects to mechanism 59. Left shelf 58 is attached to housing 12 by a pin hinge/torsion spring 98, which allows shelf 58 to rotate, and also biases it in a counterclockwise direction against left wall 14. Cam followers 99, 100 are rotatably attached to either end of left shelf 58 (see also FIG. 3). When left wedge 36 of aperture 34 moves to the left past left wall 14, cam followers 99, 100 engage channels 101, 102 in respective channel box cams 103, 104 located at the sides of aperture 34. Channels 101, 102 are shaped so that, as left wedge 36 continues to move to the left, left shelf 58 rotates clockwise to a near-vertical orientation, as shown in FIG. 4B. At this point, the left edge of channel box cam 103 passes a proximity switch 105, which reverses the direction of rotation of motor 56, and thus also the direction of movement of aperture 34.

Channels 101, 102 are shaped so that, as channel box cams 103, 104 move to the right, left shelf 58 rotates counterclockwise back up to its original, horizontal, orientation. The path defined by this portion of channel 101 can be steeper than the portion of channel 101 that causes cam follower 99 to rotate shelf 58 clockwise to the vertical orientation. By making the path steeper in this manner, shelf 58 rotates back up to its horizontal orientation more rapidly than it rotated down to its vertical orientation. In short, because of the path of channel 101, shelf 58 drops relatively slowly as box cam 103 moves to the left (FIG. 4A), and comes back up relatively rapidly as box cam 103 moves to the right (FIG. 4C). By "snapping up" in this manner, shelf 58 is more rapidly positioned to support the left end of the next-to-bottommost sheet set, reducing the likelihood that the left end will "droop" down into aperture 34 (i.e., that the left end will cross the plane P of aperture 34, as defined by shutter 26).

As shown in FIGS. 1 and 3, sheet set feeder 10 further includes a tensioning bar 70 that extends across hopper 18 between left wall 14 and right wall 16. (For clarity, tensioning bar 70 is not shown in FIG. 2.) Tensioning bar 70 is located between the edge of shutter 26 and the edge of stack 20 (set 22*a* is shown in phantom in FIG. 3), so as not to interfere with the motion of sets 22*a*, 22*b*, 22*c*, 22*d* as they pass through aperture 34. Springs 72, 74 are disposed between the ends 76, 78 of tensioning bar 70 and fingers 80, 82 projecting horizontally from the inside surfaces of walls 14, 16, biasing bar 70 downward toward shutter 26. A sheet of urethane 84 on the bottom surface of tensioning bar 70 contacts rollers 28 of shutter 26.

Figure 5:
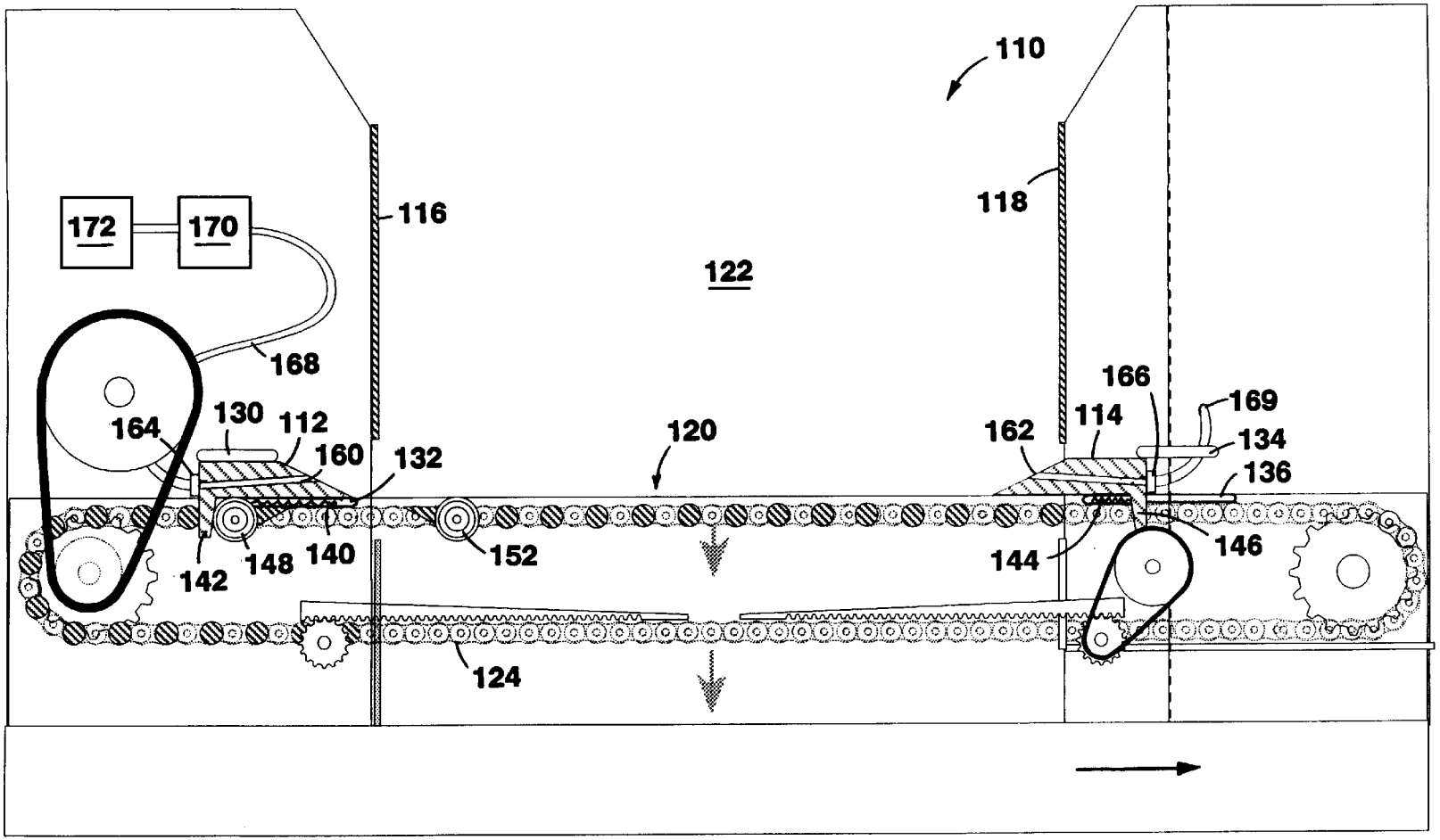
FIG. 5 is a cross-sectional side view of another sheet set feeder.
Figure 6:
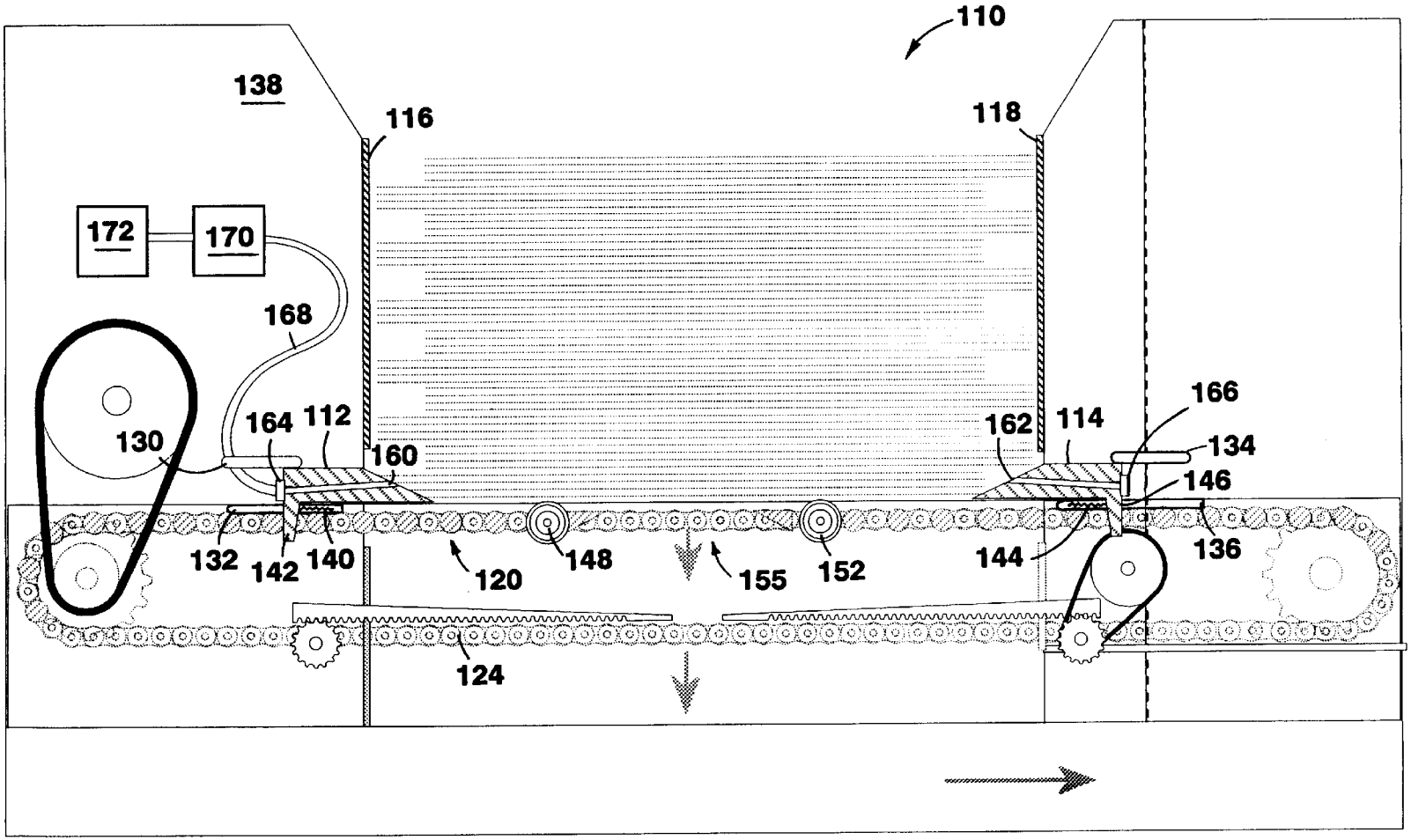
FIG. 6 is a cross-sectional side view of the sheet set feeder shown in FIG. 5, with a stack of sheet sets placed into the feeder.
Figure 7:
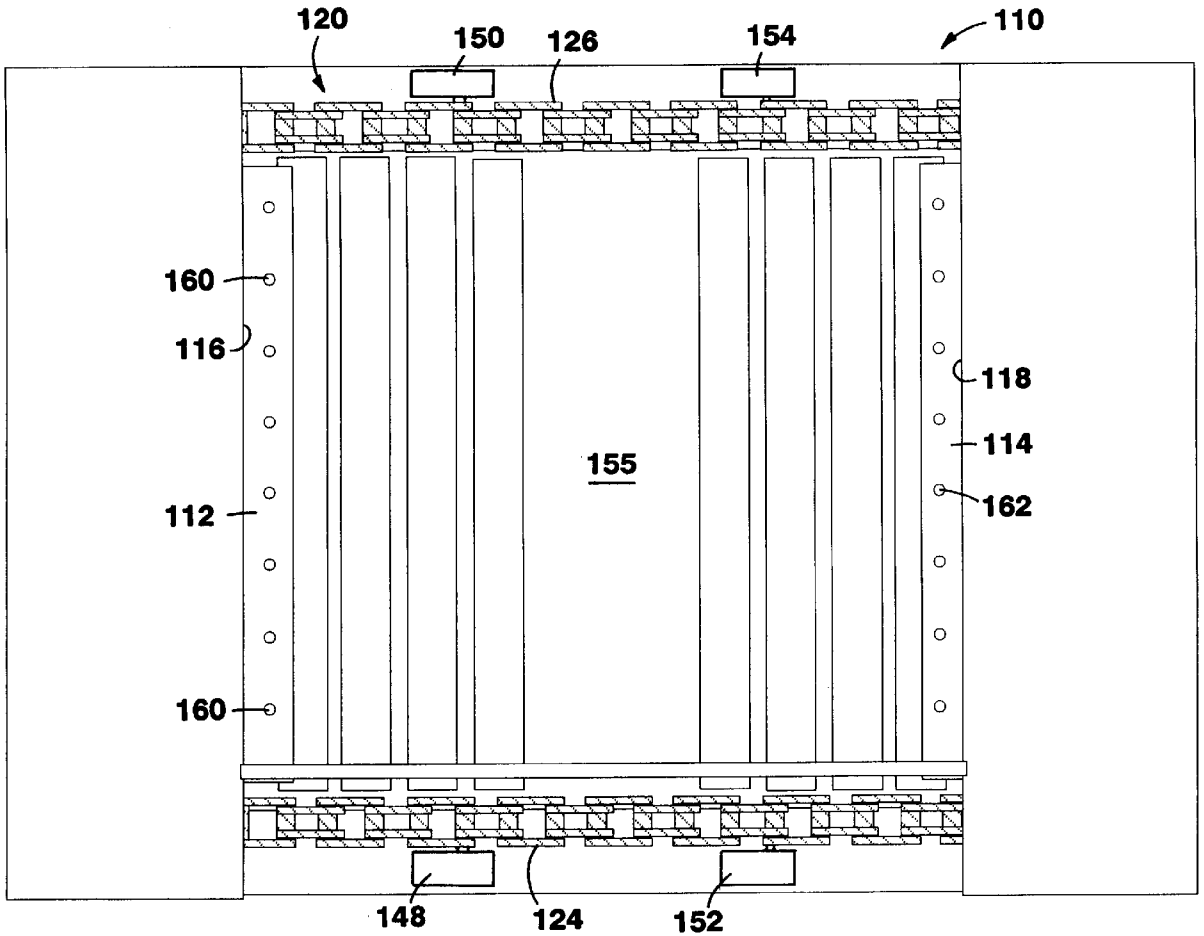
FIG. 7 is a top view of the sheet set feeder shown in FIG. 5.

Another sheet set feeder 110 is shown in FIGS. 5, 6, and 7. Sheet set feeder 110 is identical in many respects to sheet set feeder 10, except, whereas shelves 58, 60 in feeder 10 pivot, the shelves 112, 114 in feeder 110 retract into the left and right walls 116, 118 of the feeder. As in feeder 10, walls 116, 118, together with a shutter 120, define the hopper 122 of feeder 110, and drive chains 124, 126 move shutter 120 with respect to hopper 122.

Shelves 112, 114 are slidably disposed between spaced-apart brackets 130, 132, 134, 136 attached to the housing 138 of feeder 110. A spring 140 attached between bracket 122 and a finger 142 projecting down from shelf 112 biases shelf 112 toward shelf 114, and a spring 144 attached between bracket 136 and a finger 146 projecting down from shelf 114 likewise biases shelf 114 toward shelf 116. Bearings 148, 150, 152, 154 are attached to drive chains 124, 126 near the corners of the aperture 155 in shutter 120. Thus, as shown in FIG. 5, when the left edge of aperture 155 moves past left wall 116, bearings 148, 150 engage the fingers 132 (only one finger 132 shown) projecting down from shelf 112, causing it to slide into left wall 116. Right shelf 114 behaves similarly when the right edge of aperture 155 moves past right wall 116.

Shelves 112, 114 are also provided with a number of air passages 160, 162 spaced at regular intervals along the lengths of the shelves. Air passages 160, 162 are angled slightly upwardly, and facilitate sheet separation during operation, as described in detail below. A manifold 164, 166 at the back of each shelf 112, 114 is in communication with all of the air passages in each shelf. A tube 168, 169 connects each manifold 164, 166 to a solenoid valve 170 (only tube 168 is shown connected to valve 170), which is in turn connected to a source of pressurized gas 172. When solenoid valve 170 is energized, high pressure air is supplied to manifolds 164, 166, causing high-velocity air jets to issue from air passages 160, 162.

Figure 8A:
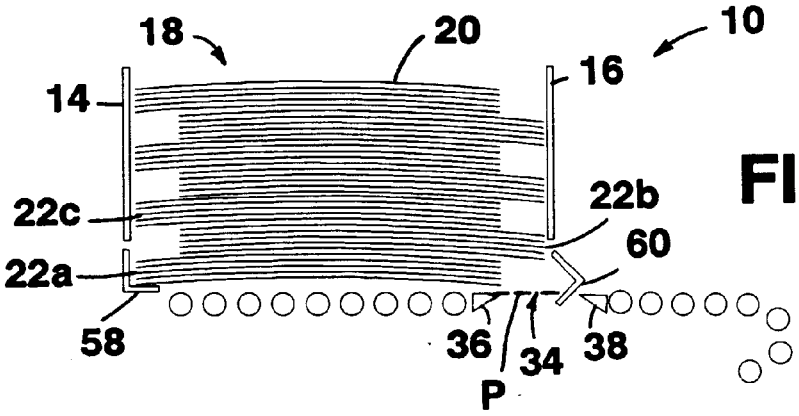
FIGS. 8A, 8B, 8C, and 8D are schematic side views showing the sheet set feeder shown in FIG. 1 in operation.
Figure 8B:
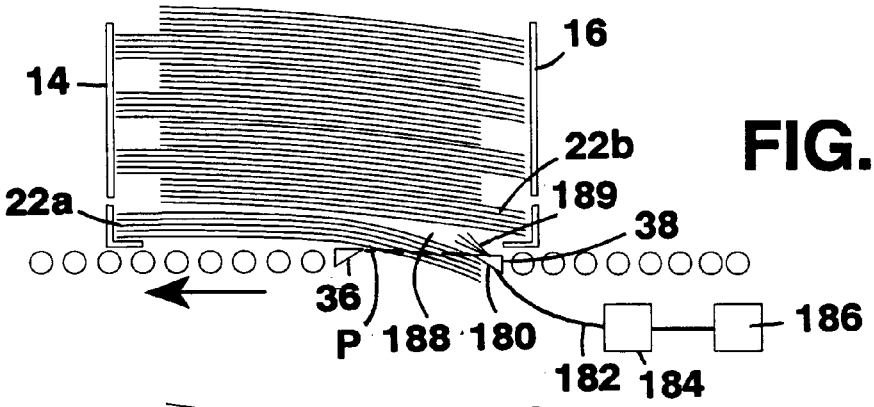

In operation, stack 20 is placed into hopper 18 of sheet set feeder 10 so that bottommost set 22*a* rests on rollers 28, as shown in FIG. 8A. (The operation of feeder 110 is similar to that of feeder 10.) The right edge of aperture 34 is initially past right wall 16 of hopper 18, and so left and right shelves 58, 60 are oriented horizontally and vertically, respectively. Motor 56 is then energized to cause aperture 34 to move to the left. When the left wedge 36 of aperture 34 moves past the right edge of bottommost set 22*a*, gravity causes the end of set 22*a* to droop through the aperture (i.e., the end crosses plane P), as shown in FIG. 8B. And when right wedge 38 moves past right wall 16, right shelf 60 rotates clockwise back to its horizontal orientation, thereby preventing the right edge of next-to-bottommost set 22*b* from drooping through aperture 34 (i.e., from crossing plane P).

Optionally, left and right wedges 36, 38 may each be provided with a manifold and a series of upwardly angled air passages, as in shelves 112, 114 of feeder 110. As shown in FIG. 8B, the passages 180 in right wedge 38 are supplied with air by a line 182 connected to a solenoid valve 184 and a source of pressurized air 186. When right wedge 38 moves to the left past right wall 16, solenoid 184 is activated and jets of air 189 issue from passages 180, further preventing next-to-bottommost set 22*b* from drooping through aperture 34 and facilitating the separation of set 22*a* from the bottom of stack 20.

Figure 8C:
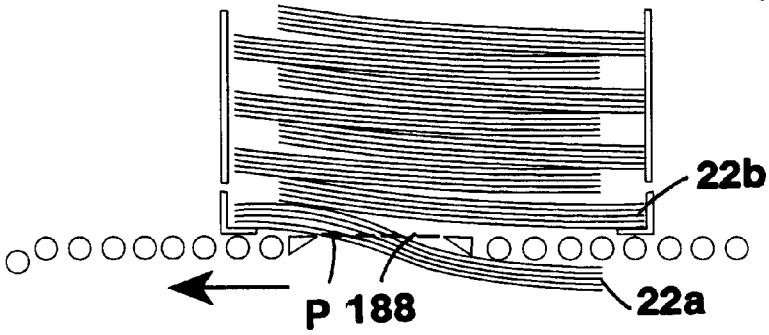
Figure 8D:
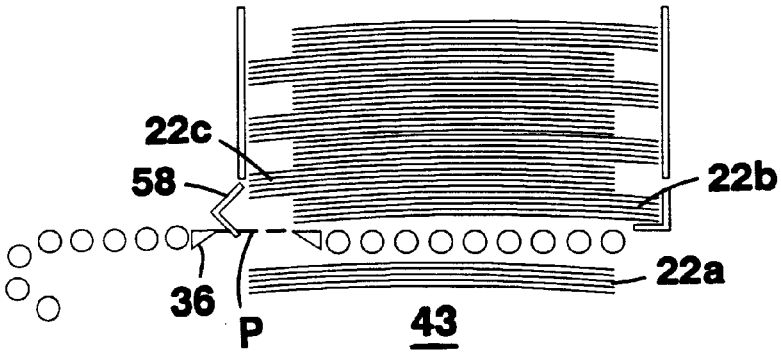

As aperture 34 continues to move to the left, left wedge 36 moves into the gap 188 between bottommost set 22*a* and next-to-bottommost set 22*b*, peeling off bottommost set 22*a* as shown in FIG. 8C. Urethane sheet 61 (FIGS. 1 and 2) on the top surface of right shelf 60 prevents set 22*b* from slipping to the left off shelf 60 as shutter 26 moves to the left. As shown in FIG. 8D, when left wedge 36 of aperture 34 moves past left wall 14 of hopper 18, left shelf 58 rotates clockwise to its vertical orientation, allowing set 22*a* to fall into primary set accumulator 43.

When aperture 34 reaches its leftmost extent of travel, motor 56 reverses direction, causing the aperture to shuttle back towards right wall 16 of hopper 18. Left shelf 58 rotates counterclockwise back to its original, horizontal orientation to support set 22*c* (which is now the next-to-bottommost set), and left wedge 36 peels set 22*b* (which is now the bottommost set) from the bottom of stack 20. While set 22*b* is being peeled off the bottom of stack 20, door 44 at the bottom of primary set accumulator 43 (FIG. 1) is quickly opened to allow set 22*a* to fall onto conveyor belt 53. Door 44 and primary accumulator 43 thus act as a buffer between set feeder 10 and conveyor belt 53, serving to synchronize the relatively slow rate at which individual sets are peeled off with the relatively high speed of conveyor belt 53. If primary accumulator 43 is not used, the drooping end of bottommost set 22*a* might come into contact with moving conveyor belt 53 before the set is completely stripped off stack 20. Should this occur, the relatively quickly moving belt 53 might, e.g., pull individual sheets 24*a*, 24*b*, 24*c*, 24*d* entirely or partially out of set 22*a*. If conveyor belt operates relatively slowly, primary accumulator 43 and door 44 may not be needed.

When right wedge 38 of aperture 34 moves past right wall 16 of hopper 18, right shelf 60 again rotates to the vertical orientation shown in FIG. 8A, allowing set 22*b* to fall into primary set accumulator 43. The cycle repeats until all remaining sets 22*c*, 22*d* are fed into primary set accumulator 43, and from there onto conveyor belt 53.

To provide for smooth motion of reciprocating shutter 26 throughout each cycle, motor 56 is initially controlled so that it ramps up from zero velocity to a constant speed. This speed is maintained until shutter 26 nears its leftmost or rightmost point of travel, at which point the motor speed is ramped back down to zero. The direction of rotation of motor 56 is then reversed, and the velocity profile repeated for the next cycle.

When stack 20 consists of a number of sets, the weight of the sets is generally sufficient to cause rollers 28 to roll freely as shutter 26 shuttles back and forth. However, when stack 20 consists of only a few sets, the weight of the sets alone may in some circumstances be insufficient to cause rollers 28 to roll. If so, as it shuttles back and forth shutter 26 may move the entire stack laterally against left and right walls 14, 16, which can "de-jog" the sets (i.e., reduce or eliminate the offset between the ends of adjacent sets). By pressing against rollers 28 with a constant force (as determined by springs 72, 74), tensioning bar 70 causes the rollers to roll irrespective of the weight of stack 20, preventing or reducing this de-jogging effect.

Figure 9:
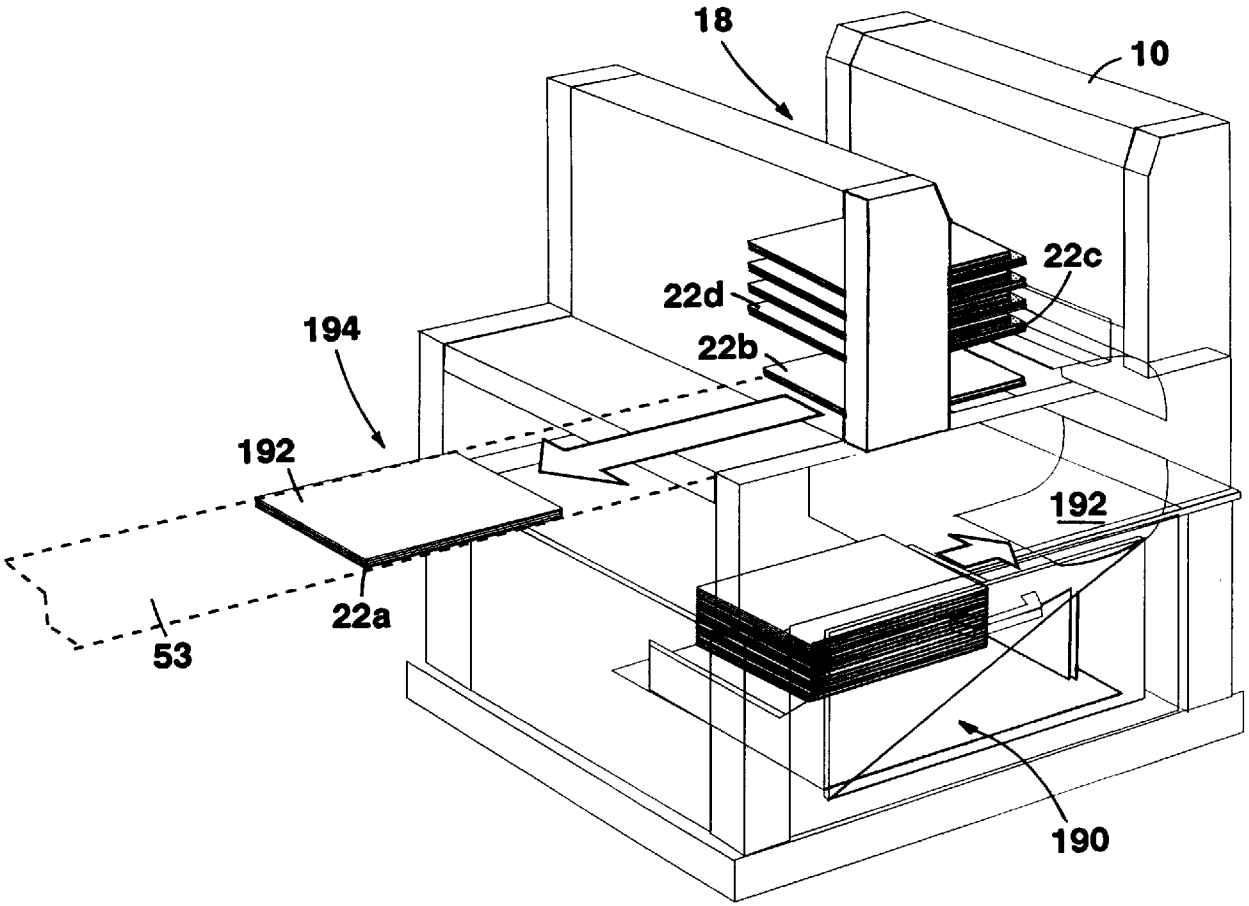
FIG. 9 is a perspective view of the sheet set feeder shown in FIG. 1 mated to a cover feeder.
Figure 10:
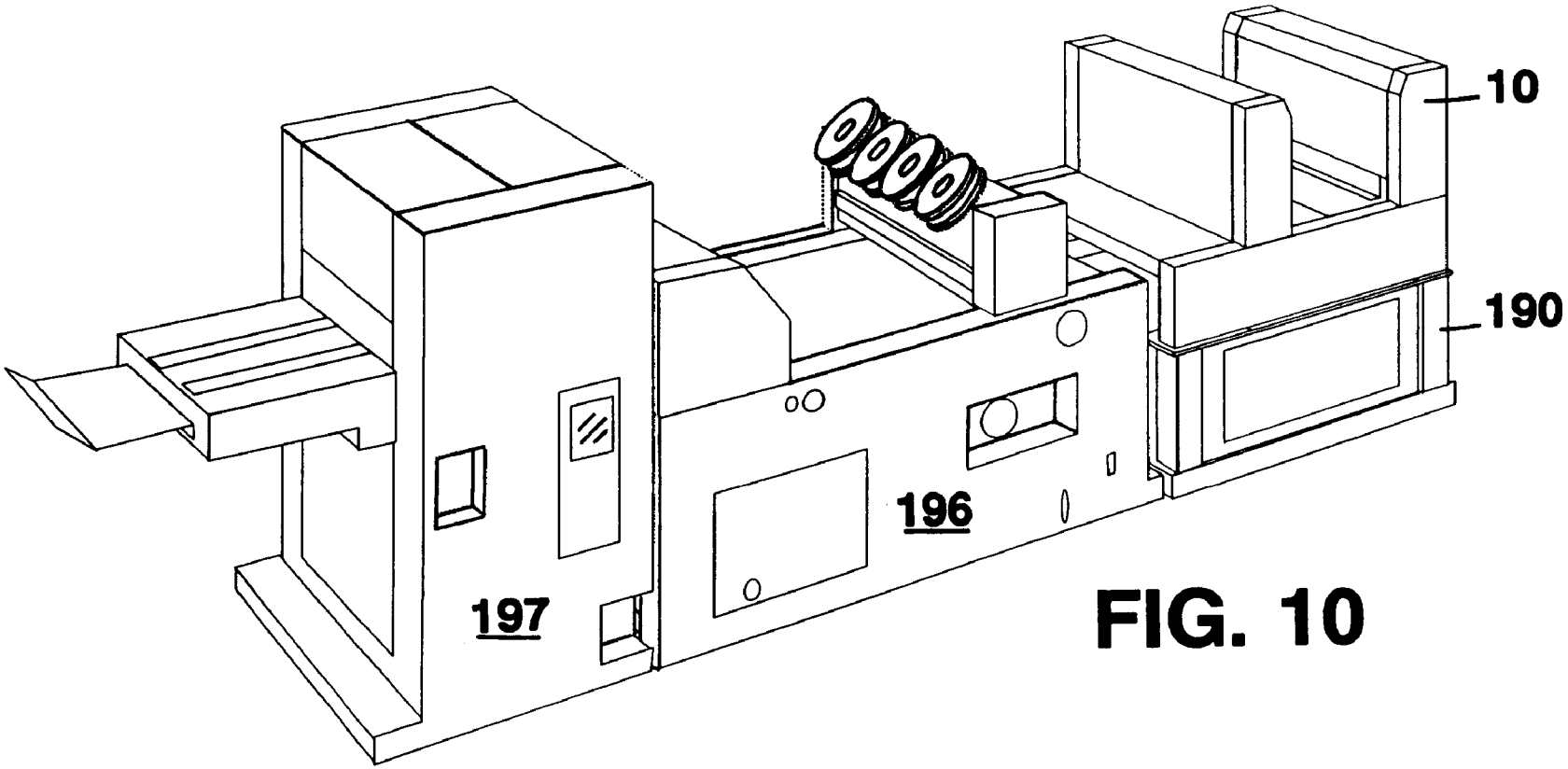
FIG. 10 is a perspective view of the sheet set feeder/cover feeder assembly shown in FIG. 9 mated to a stitcher/folder and a face trimmer.
Figure 11:
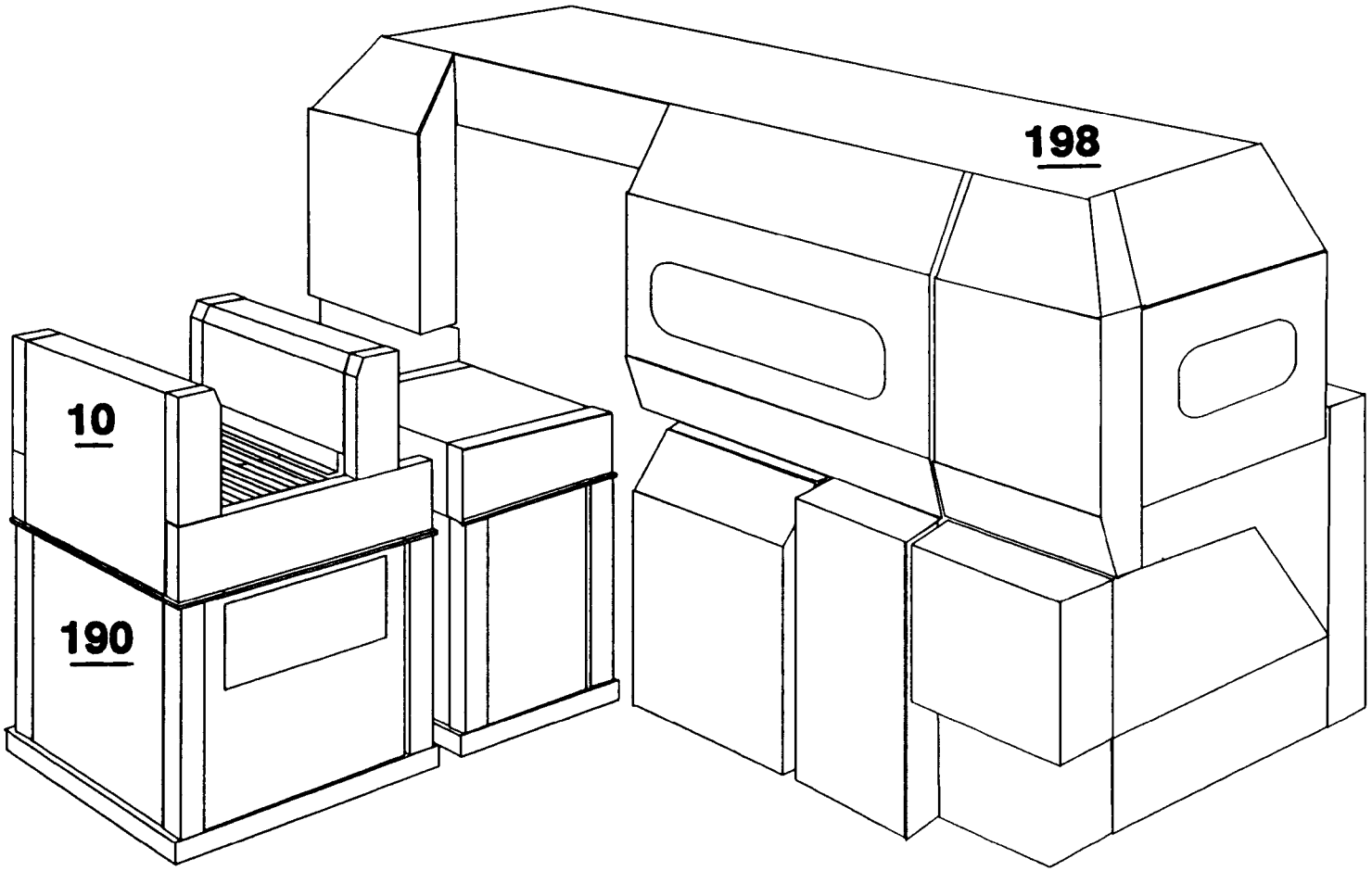
FIG. 11 is a perspective view of the sheet set feeder/cover feeder assembly shown in FIG. 9 mated to a perfect binder.
Figure 12:
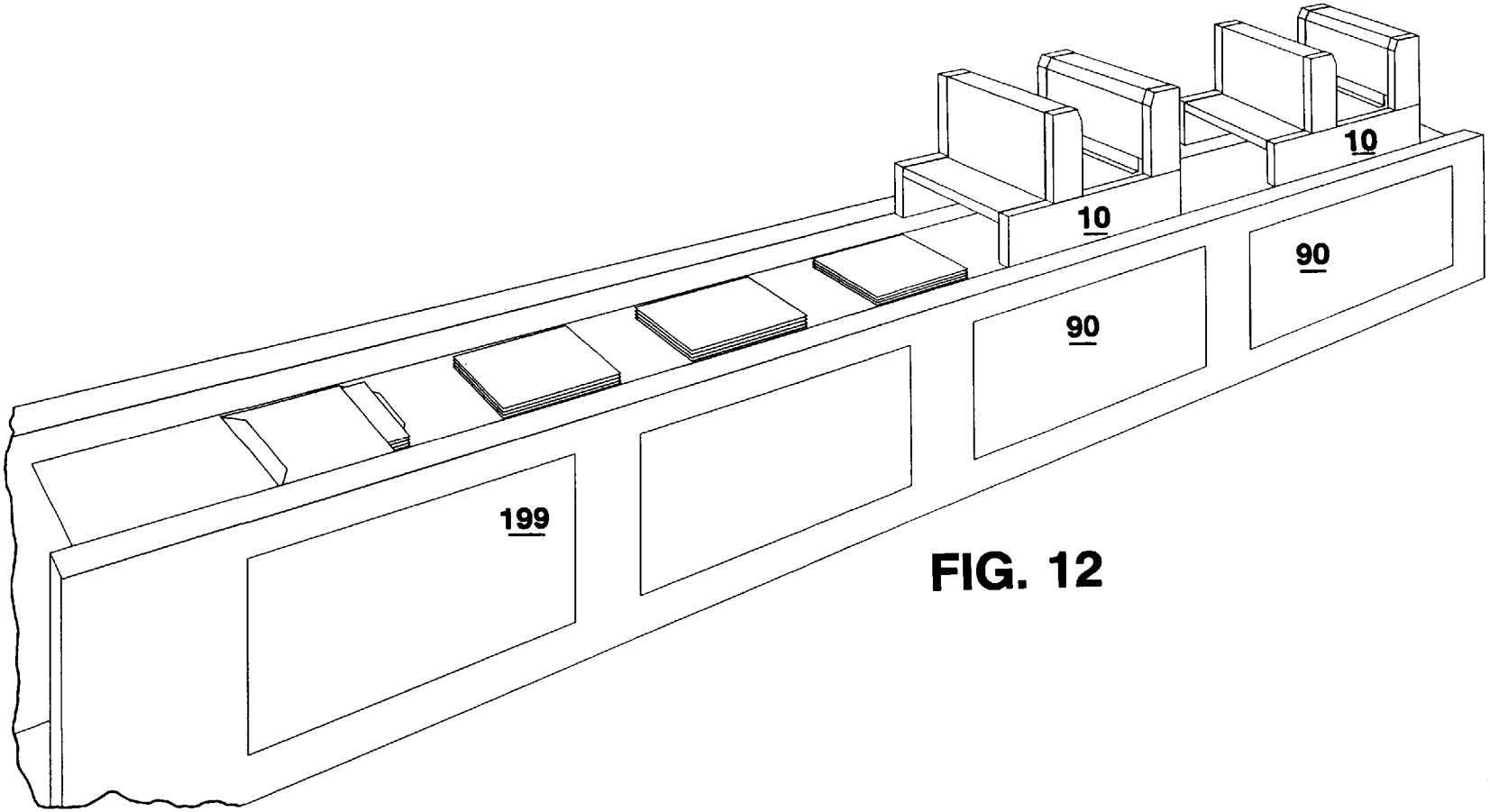
FIG. 12 is a perspective view of two of the sheet set feeder/cover feeder assemblies shown in FIG. 9 mated in tandem to a mailing/inserting system.
Figure 13:
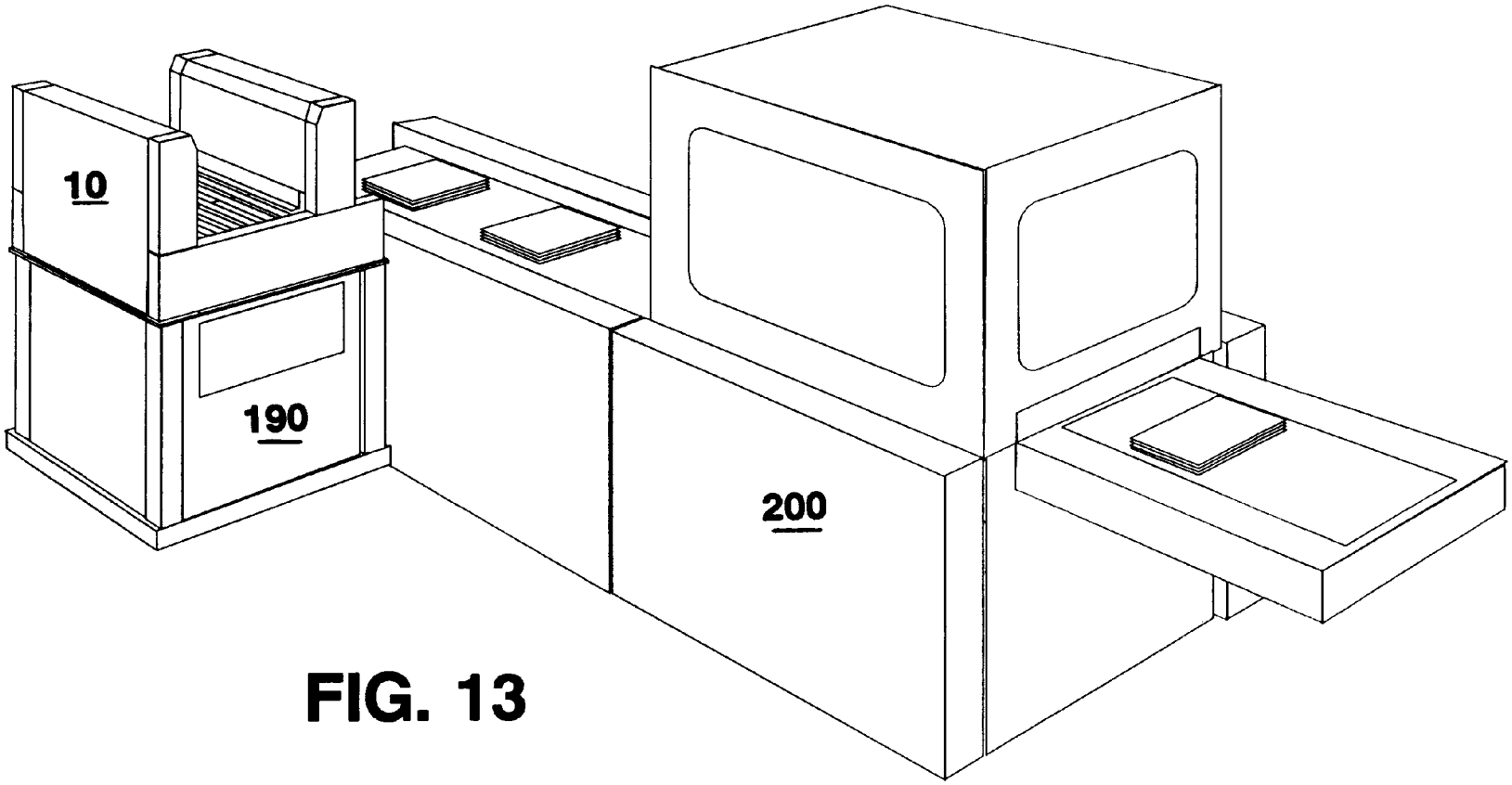
FIG. 13 is a perspective view of the sheet set feeder/cover feeder assembly shown in FIG. 9 mated to a shrink wrapper.

Set feeder 10 thus allows individual sheet sets to be removed from the bottom of an offset-jogged stack of such sets. As shown in FIG. 9, set feeder 10 or 110 may be mated with a cover feeder 190, which typically feeds one or more covers 192 for each sheet set 22*a*, 22*b*, 22*c*, 22*d* fed by feeder 10. After the cover is placed on the top (and/or bottom) of the sheet set, the complete document 194 may then be sent (using conveyor belt 53, shown in phantom in FIG. 9) for further processing, e.g., by a stitcher/folder 196 (e.g., a Standard Horizon SPF-10 or SPF-20, available from Standard Duplicating Machines Corporation, 10 Connector Road, Andover, Mass.) and/or a face trimmer 197 (e.g., a Standard Horizon FC-10), as shown in FIG. 10. Alternatively or additionally, the document may be processed by a perfect binder 198 (FIG. 11, e.g. a Standard Horizon BQ-440), a mailing/inserting system 199 (FIG. 12, e.g., a Gunther DP 100), and/or a shrink wrapper 200 (FIG. 13, e.g., a Schaffer unit).

Each offset-jogged sheet set in the stack placed into the hoppers of sheet set feeders 10, 110 is often a entire document, and each set is fed directly to one or more of the above processors or finishers after it is stripped off the bottom of the stack by the feeder. In some instances, however, particularly in the case of lengthy documents, each set is only a portion of a document, and it is necessary to combine multiple sets or add additional pages to a set to make a complete document prior to processing.

Figure 14:
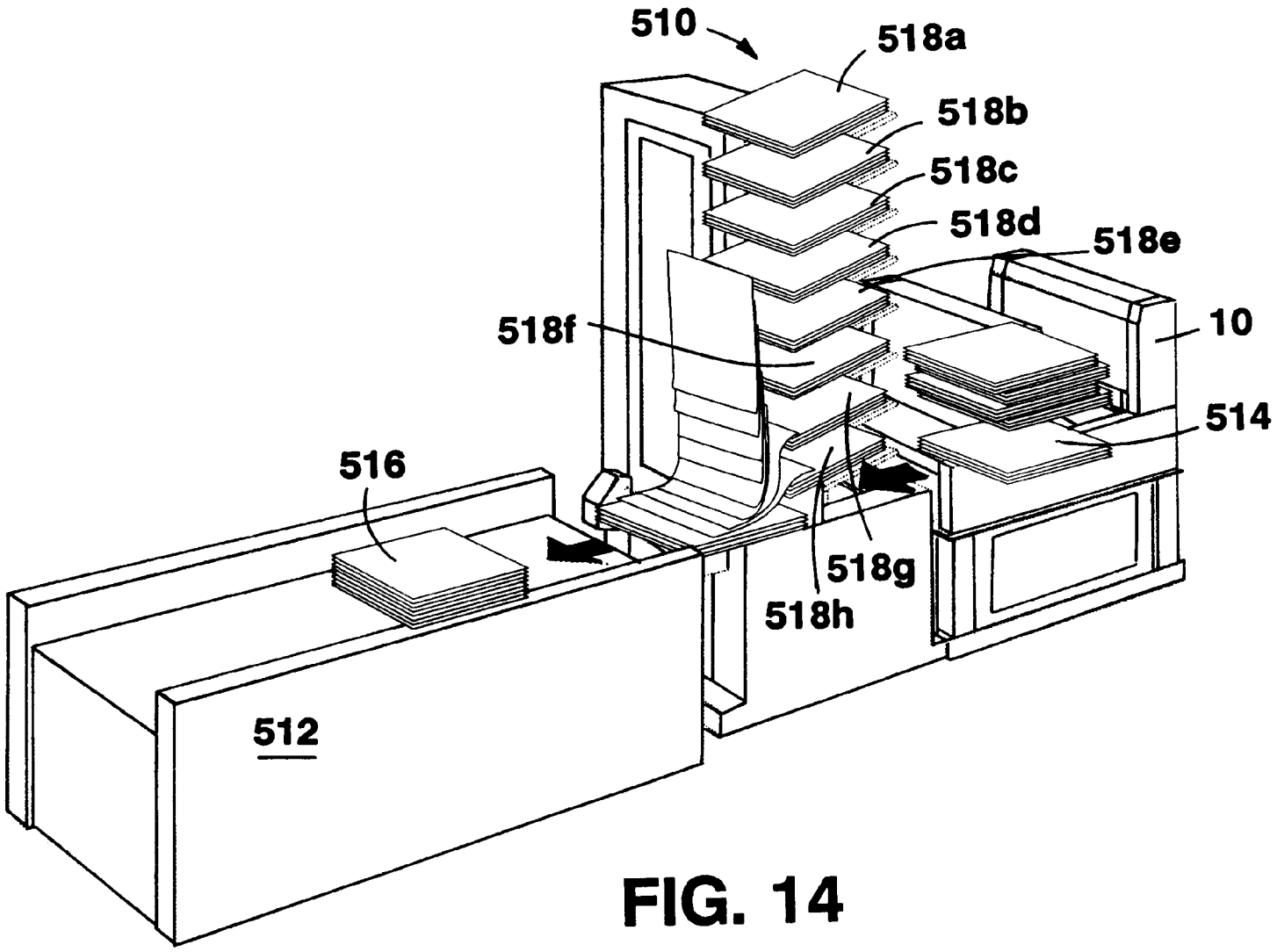
FIG. 14 is a perspective view of the sheet set feeder/cover feeder assembly shown in FIG. 9 mated to a collator and finisher.
Figure 15:
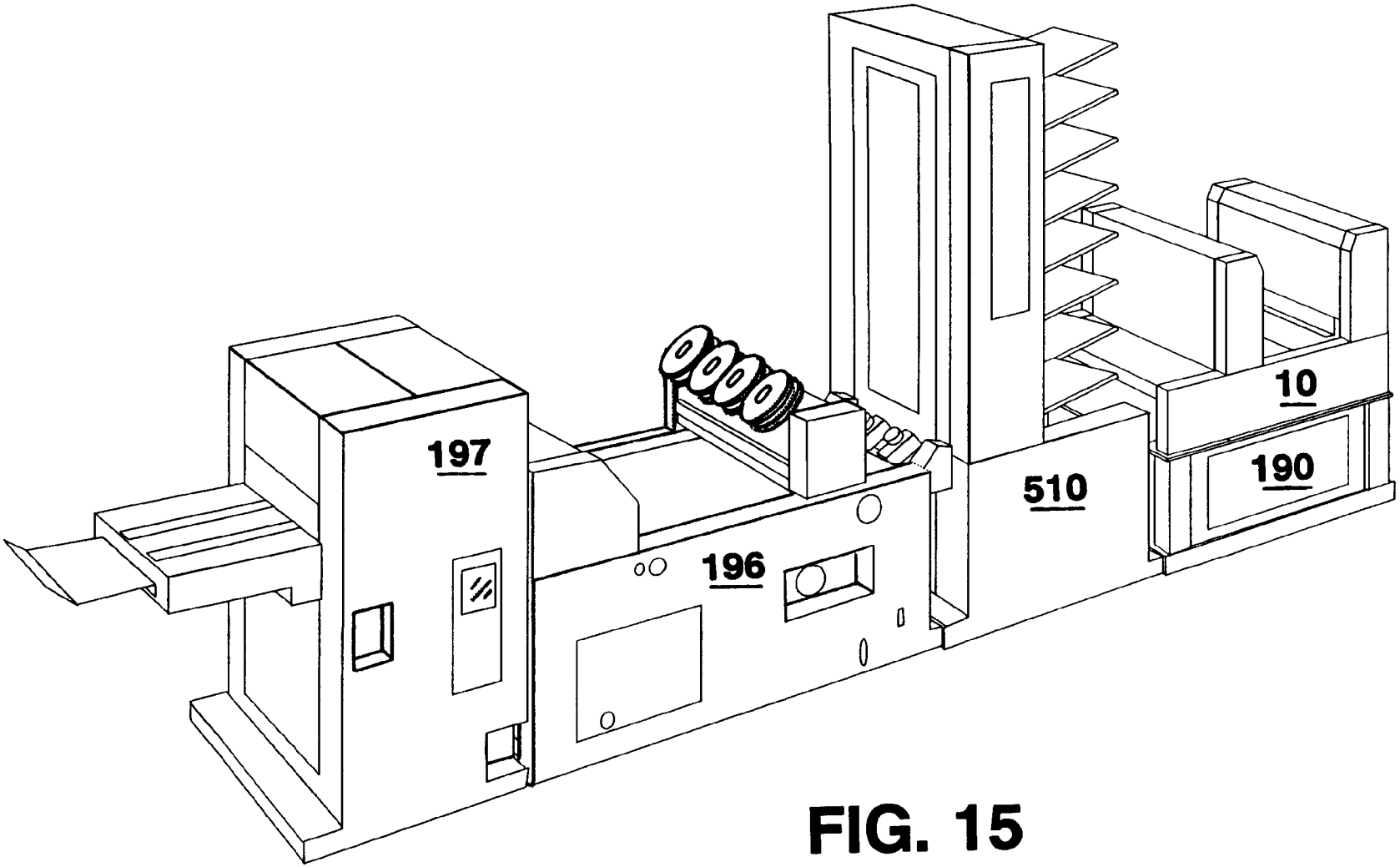
FIG. 15 is a perspective view of the sheet set feeder/cover feeder assembly shown in FIG. 9 mated to a collator, a stitcher/folder, and a face trimmer.

For example, as shown in FIG. 14, sheet set feeder 10 is mated to, e.g., a Horizon MC-80 collator 510 and a finisher 512 (finisher 512, shown schematically in FIG. 14, generically represents one or more of the above-described processors). Each of the individual sets 514 loaded into feeder 10 is only a portion of a document 516. The remaining eight pages of document 516 are loaded into the respective bins 518*a–h* of collator 510. As set 514 passes through collator 510, a single sheet is drawn from each bin 518*a–h* and placed onto set 514 in the proper order to complete document 516. The output of collator 510 is then sent to finisher 512 for further processing, such as by stitcher/folder 196 and face trimmer 197 as shown in FIG.

Figure 16:
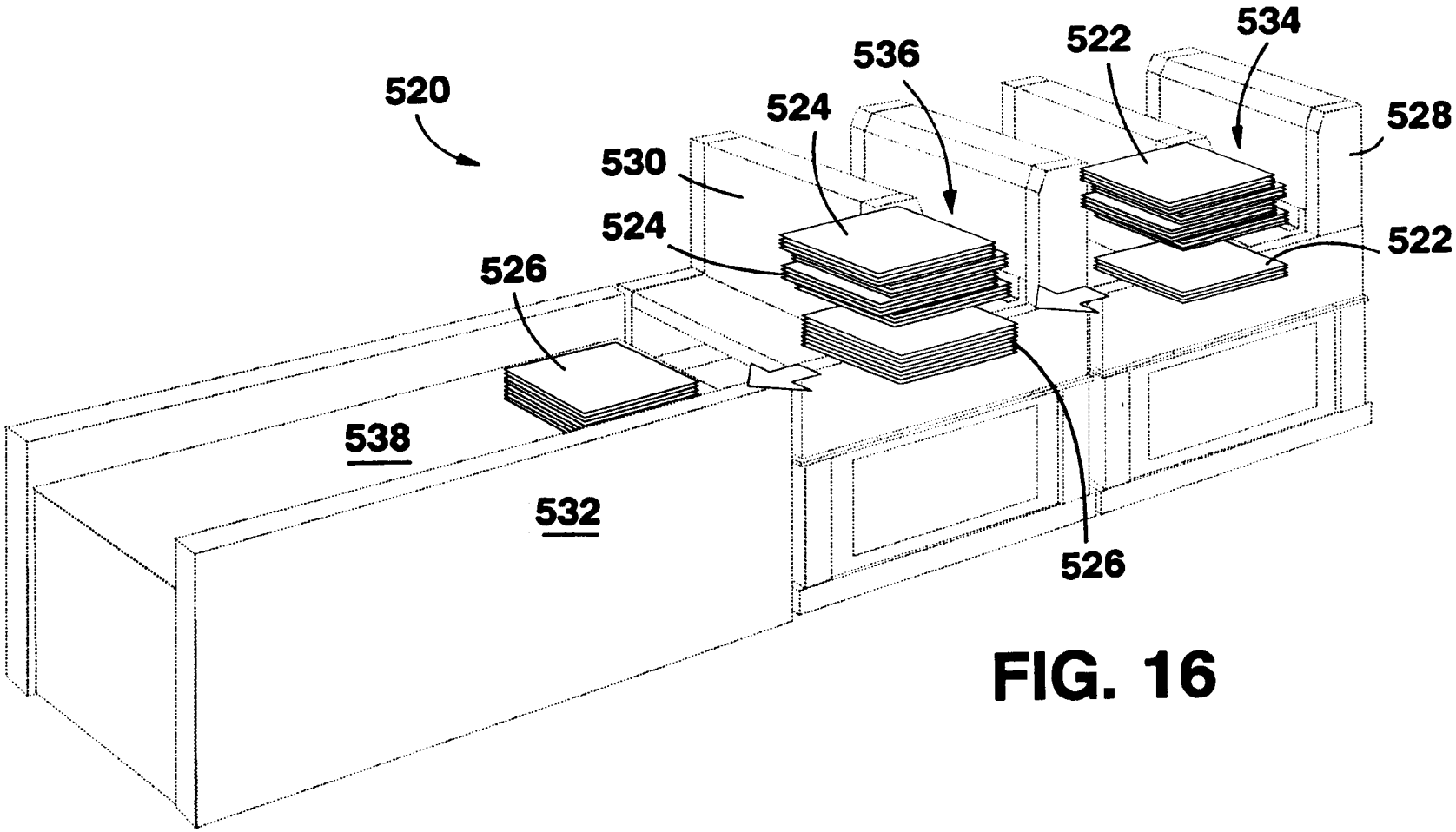
FIG. 16 is a perspective view of two of the sheet set feeder/cover feeder assemblies shown in FIG. 9 mated in tandem to a finisher.

An alternative system 520 for combining sheet sets 522, 524 to make a single document 526 is shown in FIG. 16. In this system, two feeders 528, 530, each similar in construction to either feeder 10 or feeder 110, are connected in tandem, and the output of the second feeder 530 is supplied to a finisher 532. A stack 534 comprising sheet sets 522 is placed into feeder 528, and a stack 536 comprising sheet sets 524 is placed into feeder 530. Feeder 528 strips sheet set 522 off the bottom of stack 534 and sends it, via a conveyor 538, to feeder 530. As set 522 passes through feeder 530, set 524 is stripped off the bottom of stack 536 and placed on top of set 522 to complete document 526, which is then finished or processed as desired.

Figure 17:
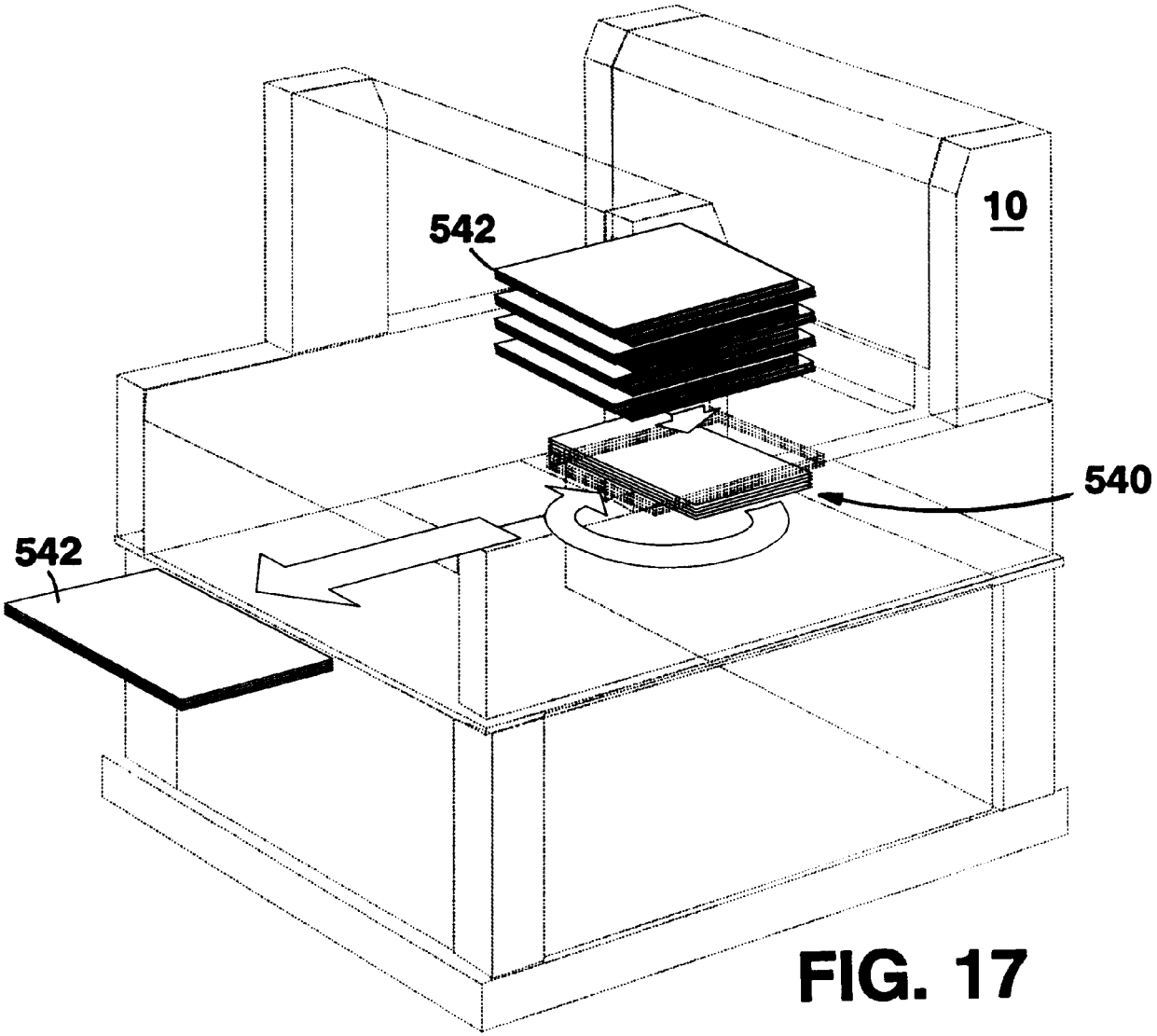
FIG. 17 is a perspective view of the sheet set feeder/cover feeder assembly shown in FIG. 9 with a rotator for rotating sheet sets.

In certain processing or finishing equipment, it is preferable that the set to be processed enter the processor "long-edge" first. However, because of the configuration of feeder 10 (as well as of feeder 110), sets 22*a*, 22*b*, 22*c*, 22*d* absent some additional manipulation enter the processors "short-edge" first. To reorient the sets to accommodate such processing equipment, feeders 10, 110 can optionally be provided with a rotator 540 that rotates individual sets 542, e.g., by 90°, as shown in FIG. 17.

Figure 18:
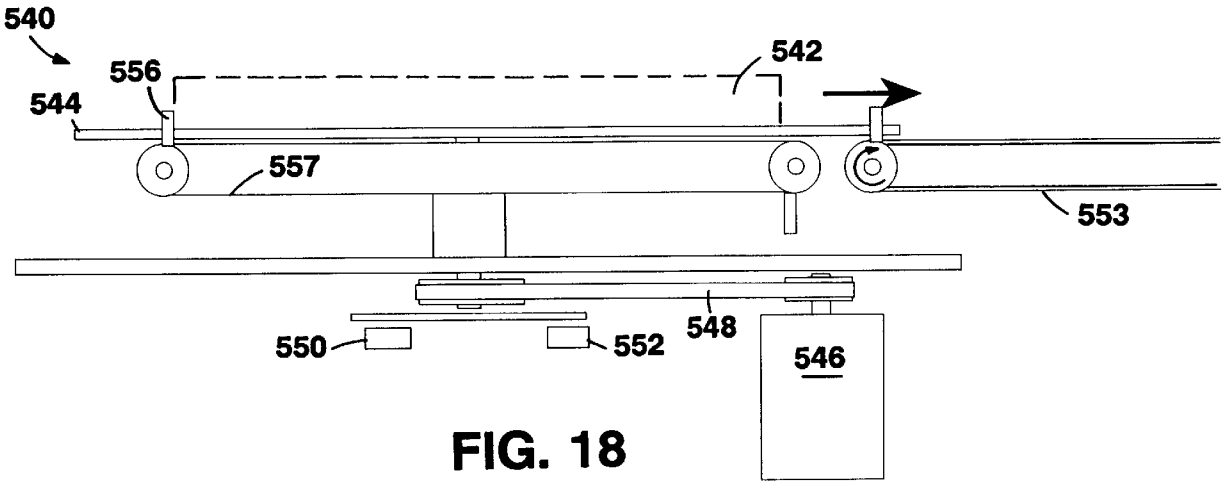
FIG. 18 is a side view of the rotator of the assembly shown in FIG. 17.
Figure 19:
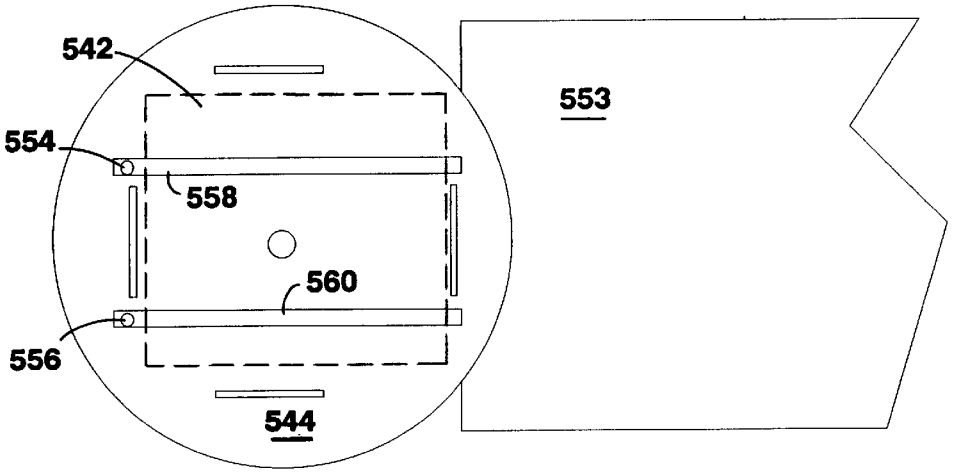
FIG. 19 is a top view of the rotator of the assembly shown in FIG. 17.

The details of rotator 540 are shown in FIGS. 18 and 19. Rotator 540 includes a platter 544 disposed directly beneath door 44 (FIG. 1) of feeder 10. After a set 542 (shown in phantom) falls onto platter 544, the platter is rotated by a motor 546 and drive belt 548 assembly until set 542 is oriented as desired, as indicated by sensors 550, 552 that sense the rotational position of platter 544. Set 542 is then pushed off platter 544 and onto a main conveyor belt 553 by pusher pins 554, 556 that are driven by a secondary conveyor belt 557 so as to travel along slots 558, 560 in platter 544. Main conveyor belt 553 then, e.g., delivers set 545 to a finisher or processor.

The specific implementation set forth above is only one illustration of an embodiment of the invention. Other embodiments are within the claims.

Figure 20:
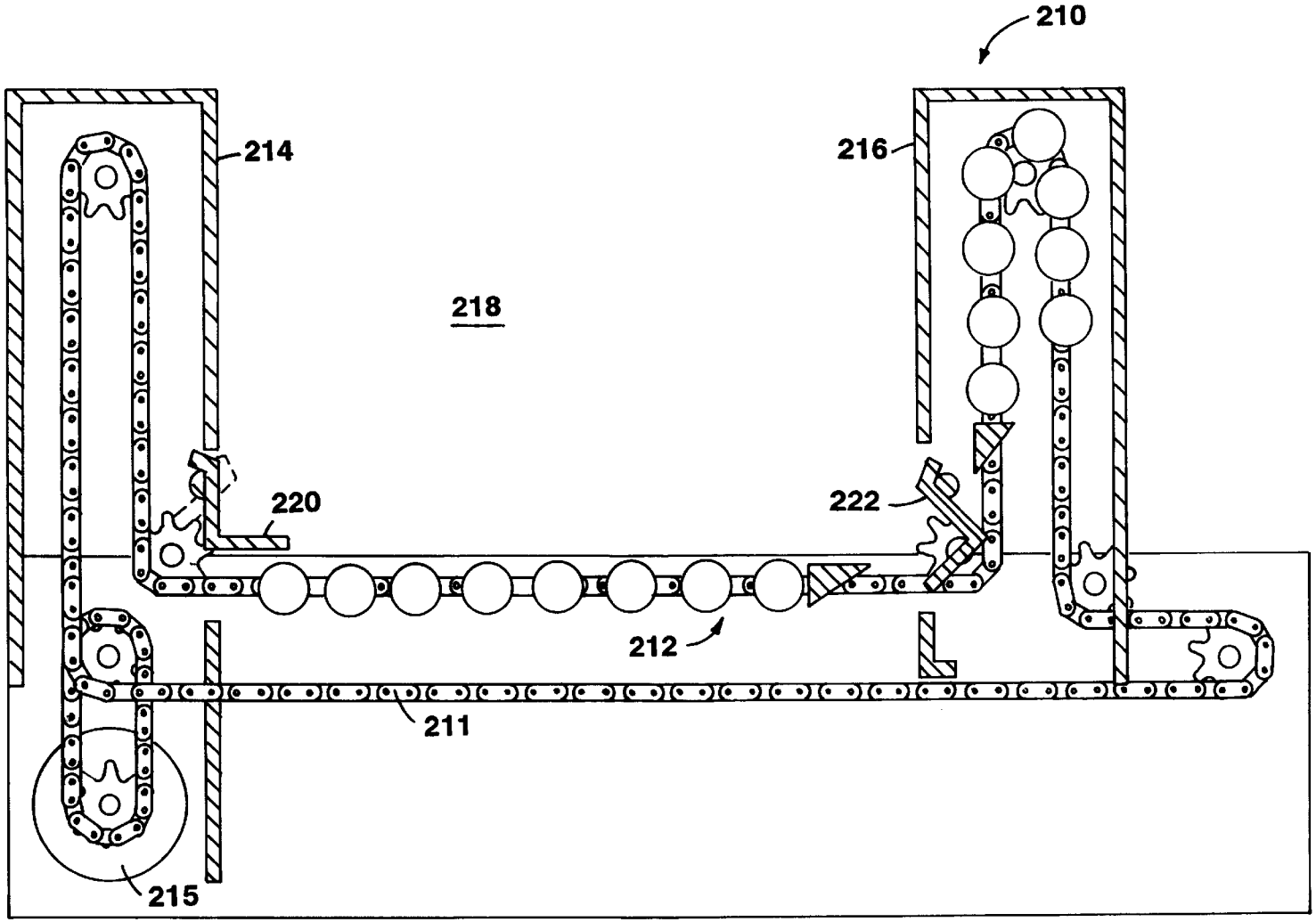
FIG. 20 is a cross-sectional side view of another sheet set feeder.
Figure 21:
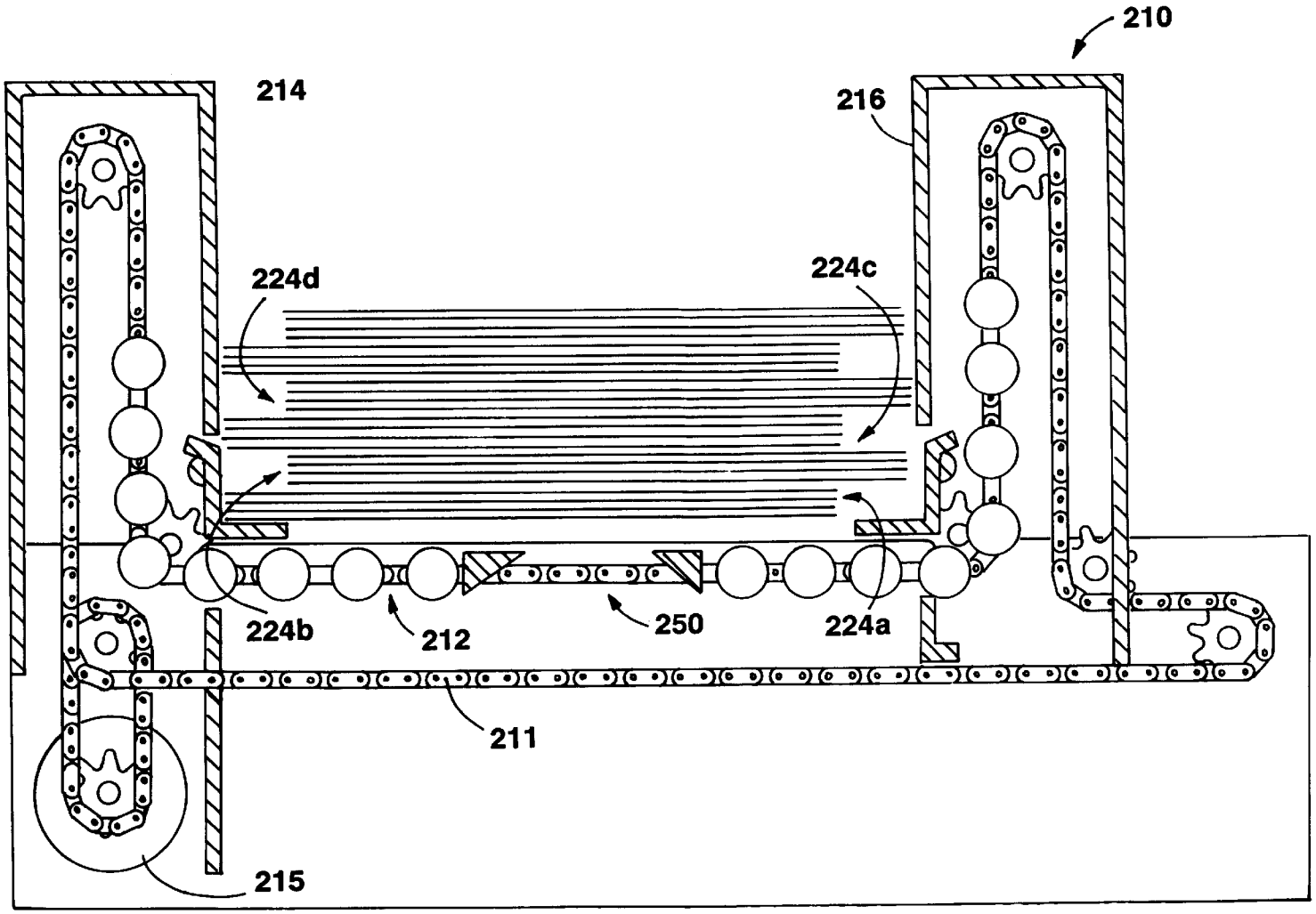
FIG. 21 is a cross-sectional side view of the sheet set feeder shown in FIG. 20, with a stack of sheet sets placed into the feeder.
Figure 22:
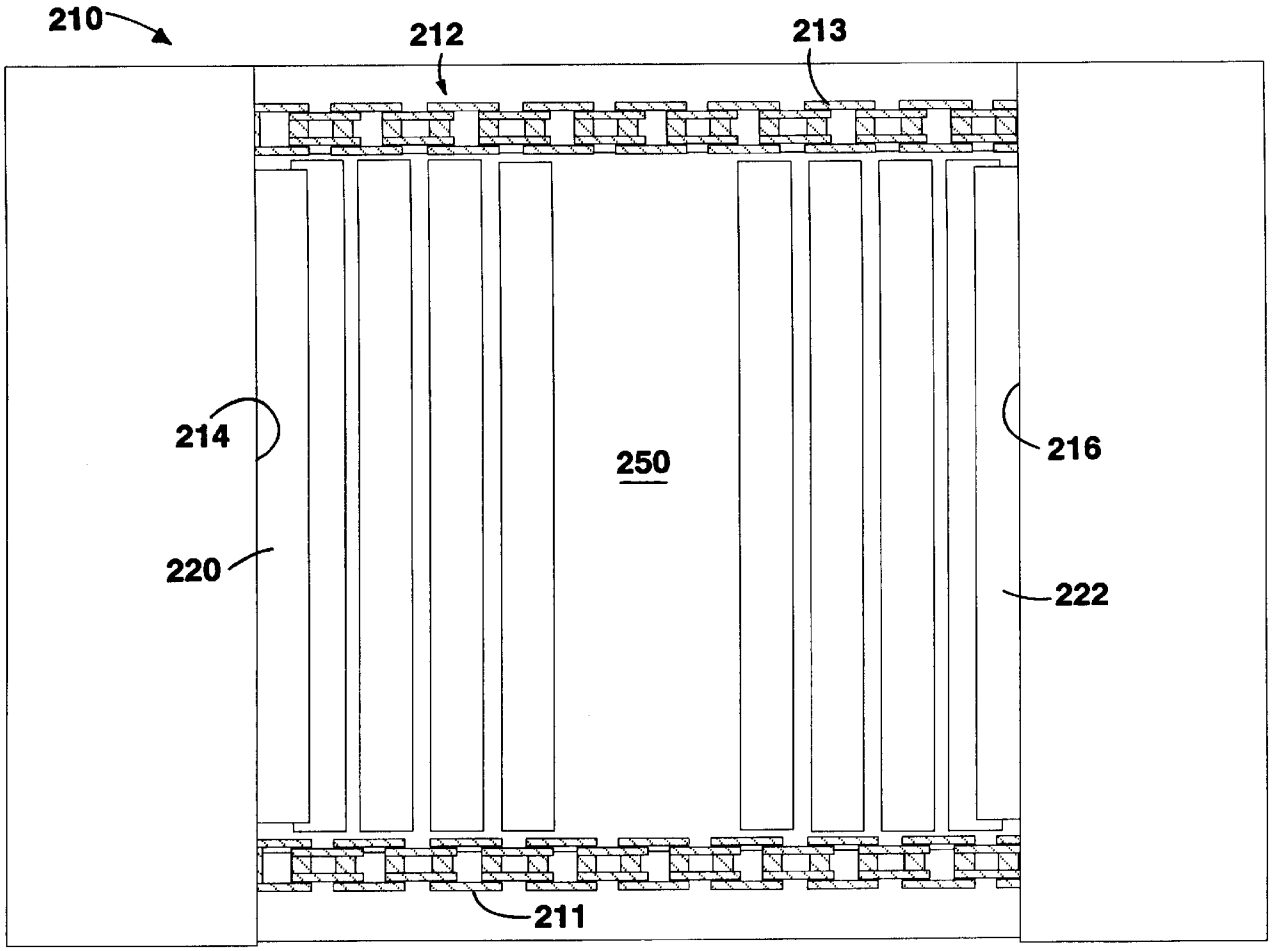
FIG. 22 is a top view of the sheet set feeder shown in FIG. 20.

For example, because it is flexible, the shutter of the paper set feeder need not run around an oval path as in feeders 10, 110, but can instead circulate through a variety of configurations to conform to packaging or other constraints. Thus, as shown in FIGS. 20, 21, and 22, a paper set feeder 210 can have a flexible shutter 212 (comprising chains 211, 213 driven by a reversible motor 215) that is routed behind the left and right walls 214, 216 of a hopper 218. As with feeders 10 and 110, left and right shelves 220, 222 support the ends of alternate sets 224*a*, 224*b*, 224*c*, 224*c* stacked in hopper 218.

Figure 23:
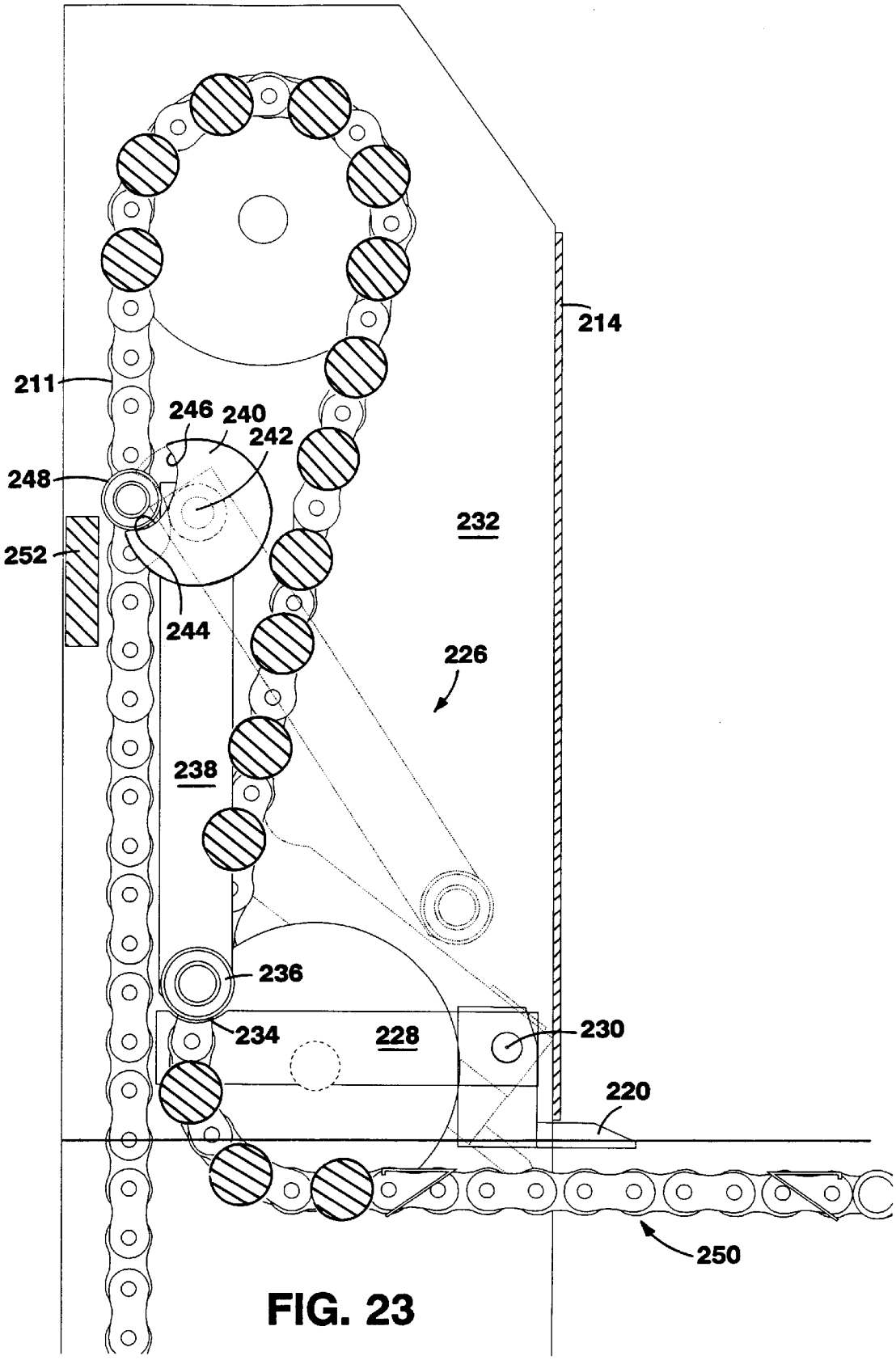
FIG. 23 is a cross-sectional side view of a mechanism for actuating a shelf of the sheet set feeder shown in FIG. 20.
Figure 24A:
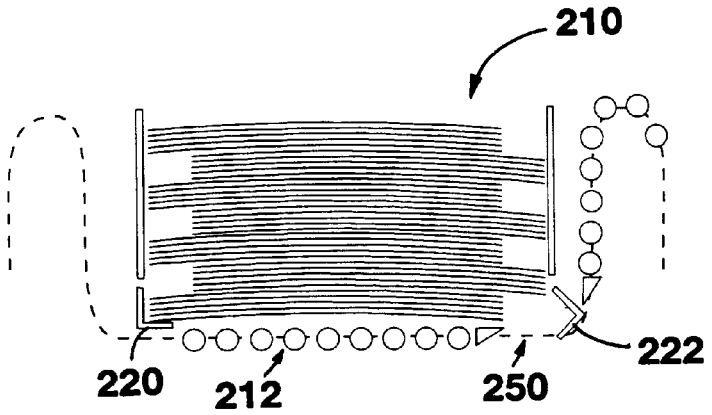
FIGS. 24A, 24B, 24C, and 24D are schematic side views showing the sheet set feeder shown in FIG. 20 in operation.
Figure 24B:
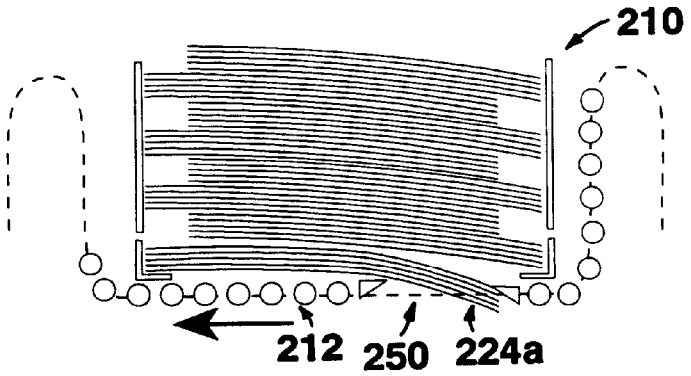
Figure 24C:
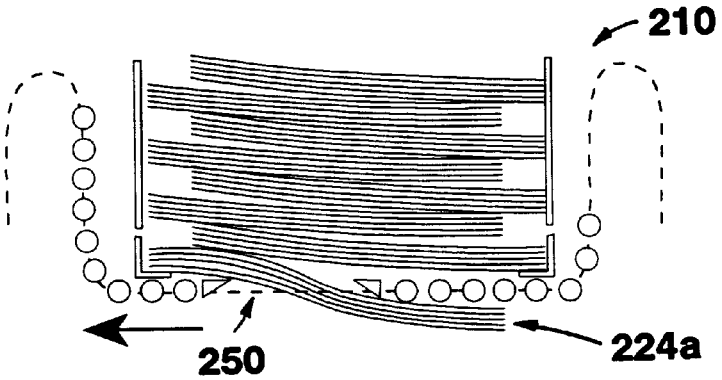
Figure 24D:
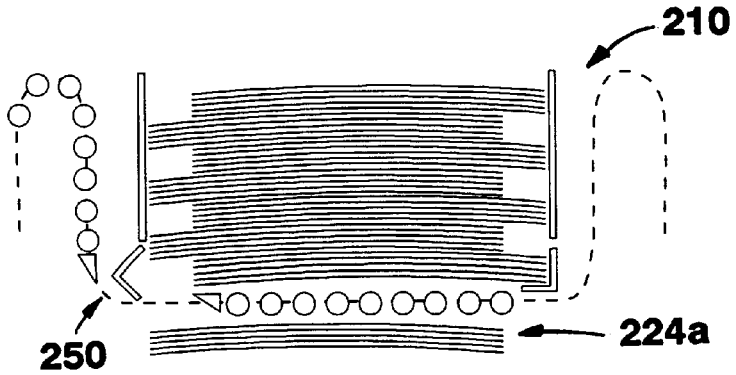

The mechanism 226 for actuating the left shelf 220 of feeder 210 is shown in detail in FIG. 23. The mechanism for actuating right shelf 222 is identical in all material respects to mechanism 226. Left shelf 220 is attached to the right end of a pivot arm 228 pivotally attached by a pin hinge/torsion spring 230 to the housing 232 of feeder 210. A recess 234 in the left end of pivot arm 228 receives the outer race of a bearing 236 attached to one end of an actuating arm 238, such that pin hinge/torsional spring 230 biases pivot arm 228 in a clockwise direction against bearing 236. The other end of actuating arm 238 is attached to a cam 240 pivotally attached by a pin hinge 242 to housing 232. Cam 240 defines a pair of superimposed crescent-shaped recesses 244, 246 in its outer circumference. Recesses 244, 246 are sized to receive the outer race of a bearing 248 attached to link chain 211.

When link chain 211 moves bearing 248 down past cam 240 (i.e., when the aperture 250 defined by shutter 212 moves past left wall 214), it engages recess 244, rotating cam 240 and actuating arm 238 in a counter-clockwise direction, to the position shown in phantom in FIG. 23. Because pivot arm 228 is no longer restrained from rotating by bearing 236, pin hinge/torsional spring 230 rotates it in a clockwise direction, to the position shown in phantom in FIG. 23, causing left shelf 220 to drop down. As bearing 248 continues to move down, it passes a proximity switch 252 mounted to housing 232, which reverses the direction of rotation of motor 215, and thus also the direction of movement of chains 211, 213 and aperture 250.

When link chain 211 moves bearing 248 back up past cam 240, it engages recess 246, rotating cam 240 and actuating arm 238 in a clockwise direction back to its original vertical position. As actuating arm 238 rotates, bearing 236 engages the top surface of pivot arm 228, rotating it and left shelf 220 in a counter-clockwise direction back to their original horizontal positions.

The operation of paper set feeder 210 is illustrated in FIGS. 24A, 24B, 24C, and 24D, and is similar in material respects to the operation of set feeders 10 and 110.

Figure 25A:
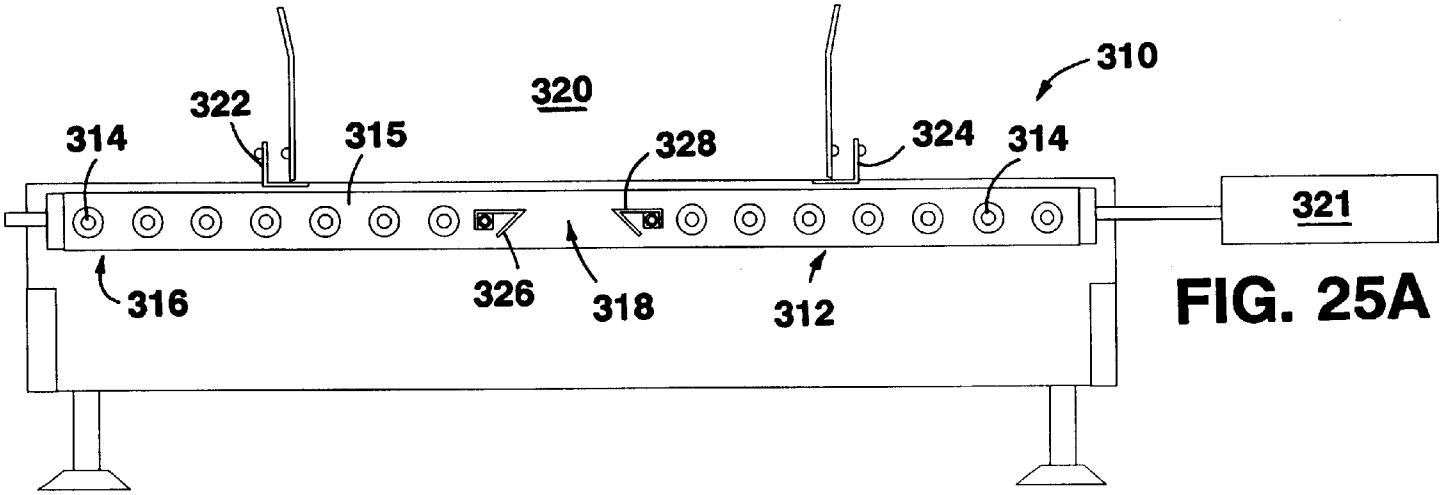
FIGS. 25A and 25B are side views of another sheet set feeder.
Figure 25B:
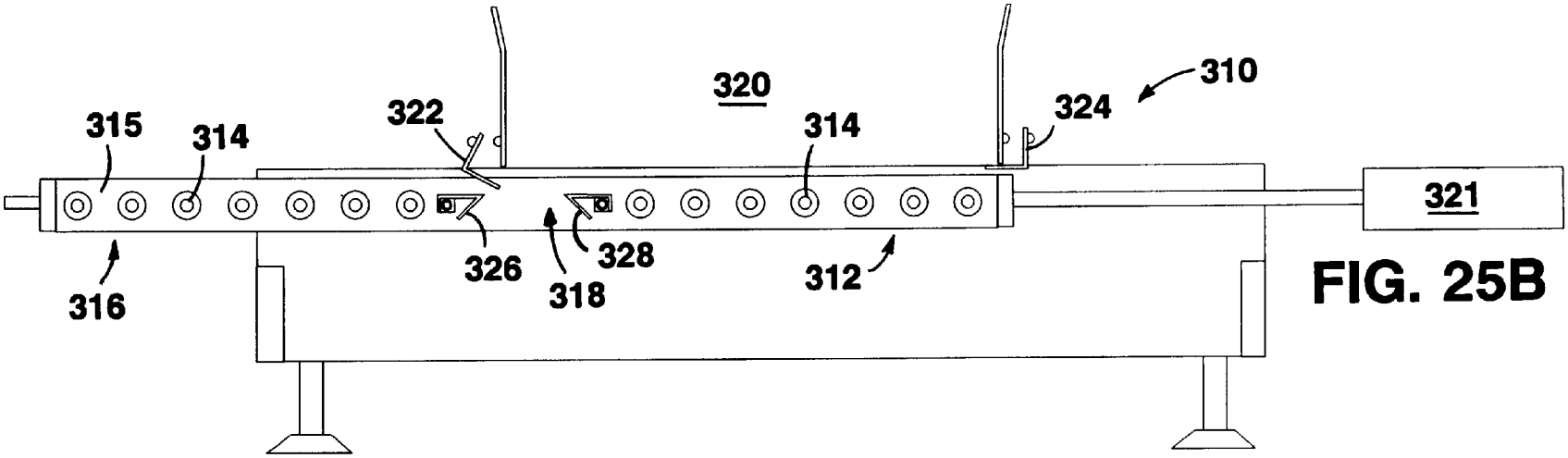
Figures 26A, 26B, 26C, 26D:
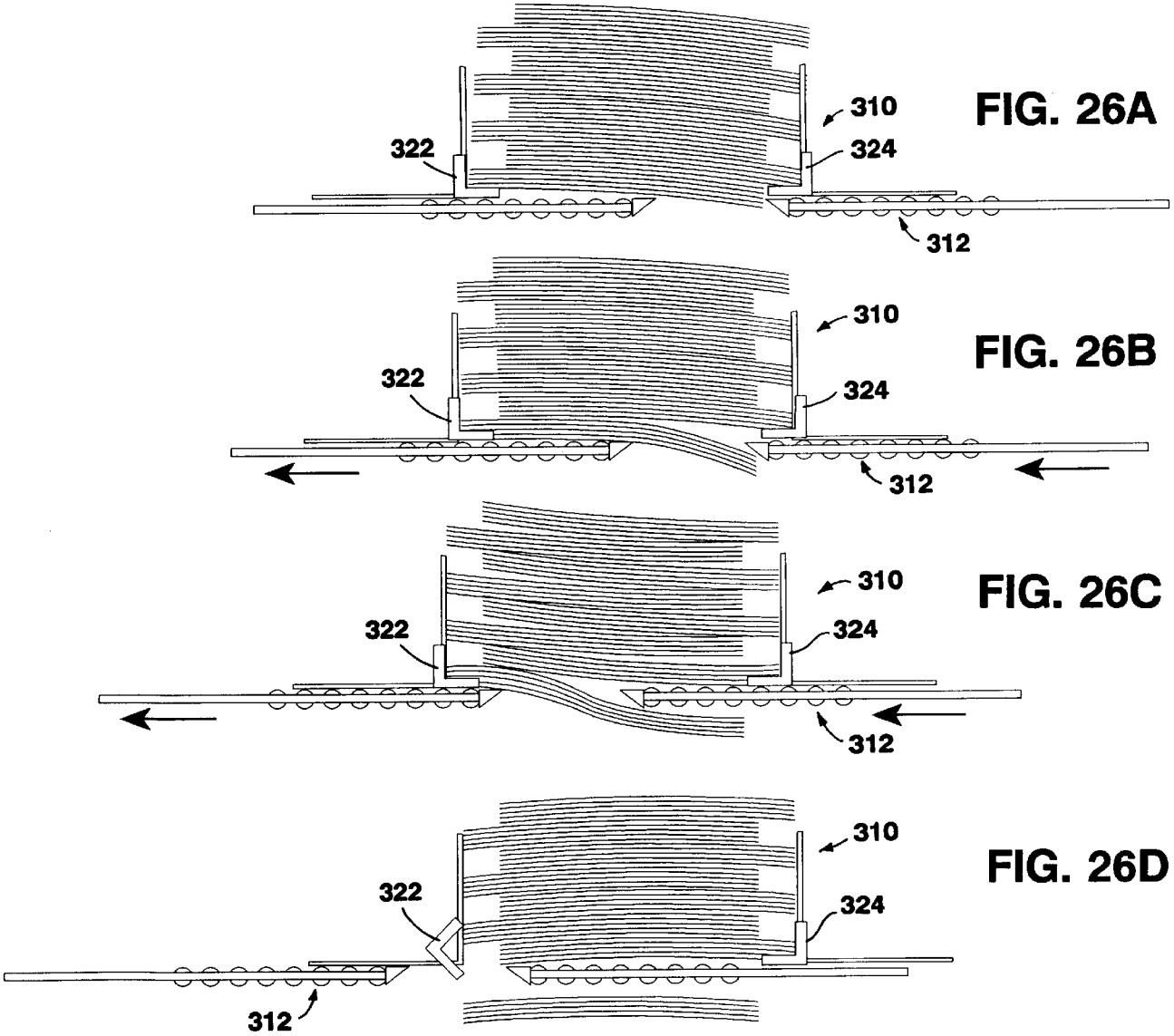
FIGS. 26A, 26B, 26C, and 26D are schematic side views showing the sheet set feeder shown in FIGS. 25A and 25B in operation.

Although making shutters 26, 120, 212 flexible so they can, e.g., wrap around the sides of hopper 218 (as in the case of feeder 210) or into other non-planar configurations may make feeders 10, 110, 210 more compact, the shutter can instead be relatively rigid and planar. For instance, as shown in FIGS. 25A and 25B, a set feeder 310 includes a shutter 312 comprised of individual rollers 314 disposed between the sides 315 (only one side shown) of a rectangular frame 316, e.g., of metal. As frame 316, and thus also the aperture 318 defined by shutter 312, shuttles back and forth with respect to the hopper 320, rollers 314 remain essentially coplanar. Frame 316 is shuttled back and forth by a pneumatic cylinder 321, but could instead be driven, e.g., manually, by a hydraulic cylinder, or by a drive chain arrangement similar to those employed in set feeders 10, 110, 210.

Like set feeder 10, set feeder 310 includes left and right shelves 322, 324 and left and right wedges 326, 328 at the edges of aperture 318. Shelves 322, 324 can be actuated using any of the above-described or below-described mechanisms, or can instead be actuated by any other suitable mechanism, such as individual solenoids that are controlled based on the output of a sensor or sensors that determine the position of the aperture with respect to the hopper. In operation, set feeder 310 behaves in much the same manner as set feeders 10, 110, and 210 as shown in FIGS. 26A, 26B, 26C, and 26D.

Although used in feeders 10, 110, 210, 310, the sheet set feeder need not have separate and discrete right and left shelves that support the edges of the bottommost and next-to-bottommost sheet sets. Such a feeder 410 is shown in operation in FIGS. 27A, 27B, 27C, 27D, 27E. (Although feeder 410 does not include right and left wedges at the edges of the aperture 412 in its shutter 414, they could be included if desired.)

Shutter 414 of feeder 410 is relatively rigid and planar, like shutter 312 of feeder 310, but could instead be flexible if desired. Whereas the lengths of the apertures in set feeders 10, 110, 210, 310 remain fixed during operation, the length of aperture 412 varies as shutter 414 shuttles back and forth. As described below, this is accomplished by using two separate drive systems 432, 434 (shown schematically in FIG. 27A) that independently control, based on the outputs of a series of proximity sensors 436, 437, 438, 439, 440, 441, 442, 443 located to sense the position of shutter 414, the movement of the left and right halves 444, 446 of shutter 414. Drive systems 432, 434 comprise reversible motor and drive chain arrangements similar to those employed in set feeders 10, 110, 210, but could instead comprise, e.g., pneumatic or hydraulic cylinders as in set feeder 310.

Figure 27A:
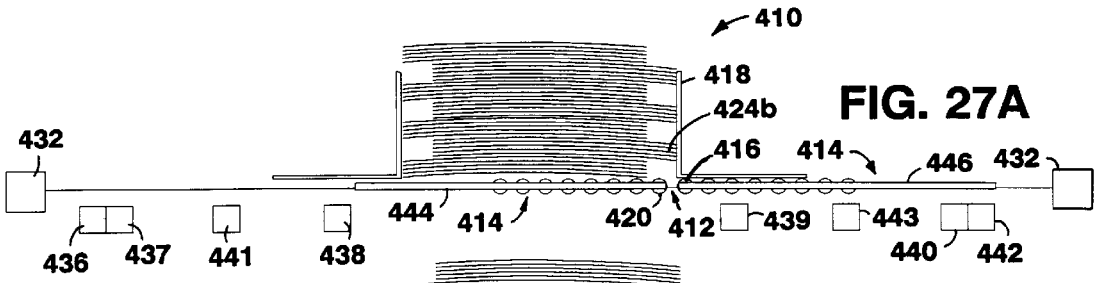
FIGS. 27A, 27B, 27C, 27D, and 27E are schematic side views showing another sheet set feeder in operation.
Figure 27B:
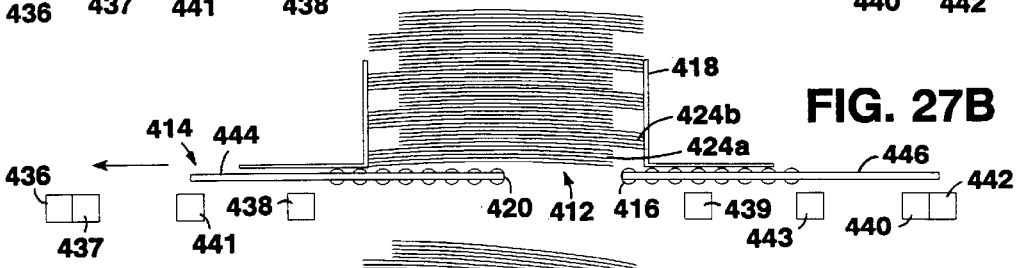
Figure 27C:
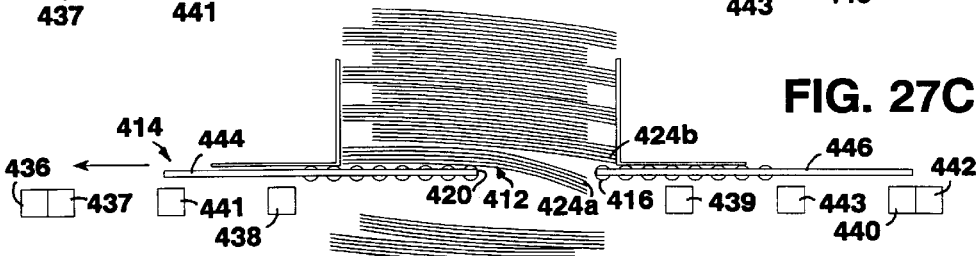
Figure 27D:
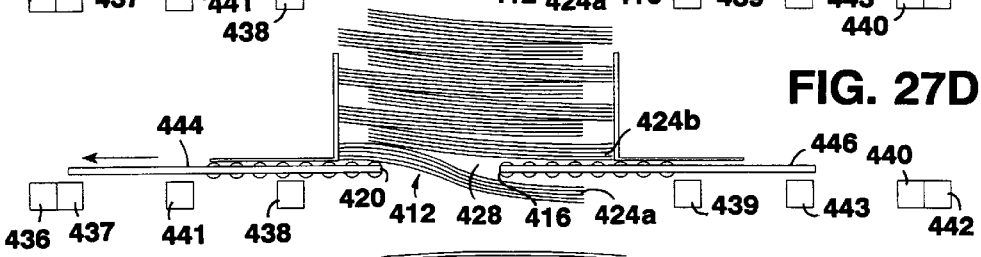
Figure 27E:
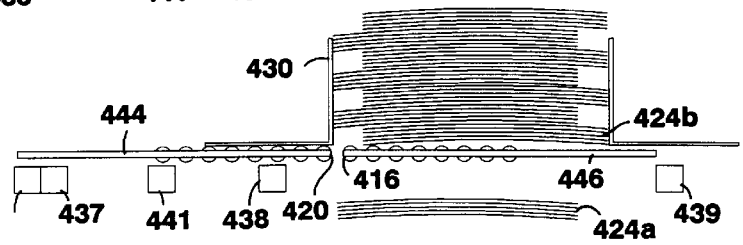

As shown in FIG. 27A, when the right edge 416 of aperture 412 is even with the right wall 418 of feeder 410 (as indicated by sensor 442), the left edge 420 of aperture 412 is immediately adjacent right edge 416 (as indicated by sensor 438). At this point, both halves 444, 446 of shutter 414 are moved so that both right edge 416 and left edge 420 move together to the left. When right edge 416 is even with the right edge of the bottommost set 424*a* in the stack 426 (as indicated by sensor 440), as shown in FIG. 27B, right half 446 stops moving, and left half 444 continues to move to the left. As the length of aperture 412 increases, the right end of bottommost set 424*a* droops through the aperture, as shown in FIG. 27C. The portion of shutter 414 disposed immediately adjacent right edge 416 of aperture 412 supports next-to-bottommost set 424*b*, preventing it from also drooping through the aperture. When the length of aperture 412 has increased sufficiently (as indicated by sensor 441), such that a gap 428 has formed between bottommost set 424*a* and next-to-bottommost set 424*b*, right half 446 of shutter 414 resumes moving to the left, at the same speed as left half 444. Right edge 416 then enters gap 428, stripping bottommost set 424*a* off the bottom of stack 426 as shown in FIG. 27D. When left edge 420 of aperture 412 reaches the left wall 430 of feeder 410 (as indicated by sensor 436), left half 444 of shutter 414 stops moving. Right half 446 continues to move to the left until it is immediately adjacent left edge 420 (as indicated by sensor 439), as shown in FIG. 27E. The process then reverses to strip off next-to-bottommost set 424*b*.

Figure 28:
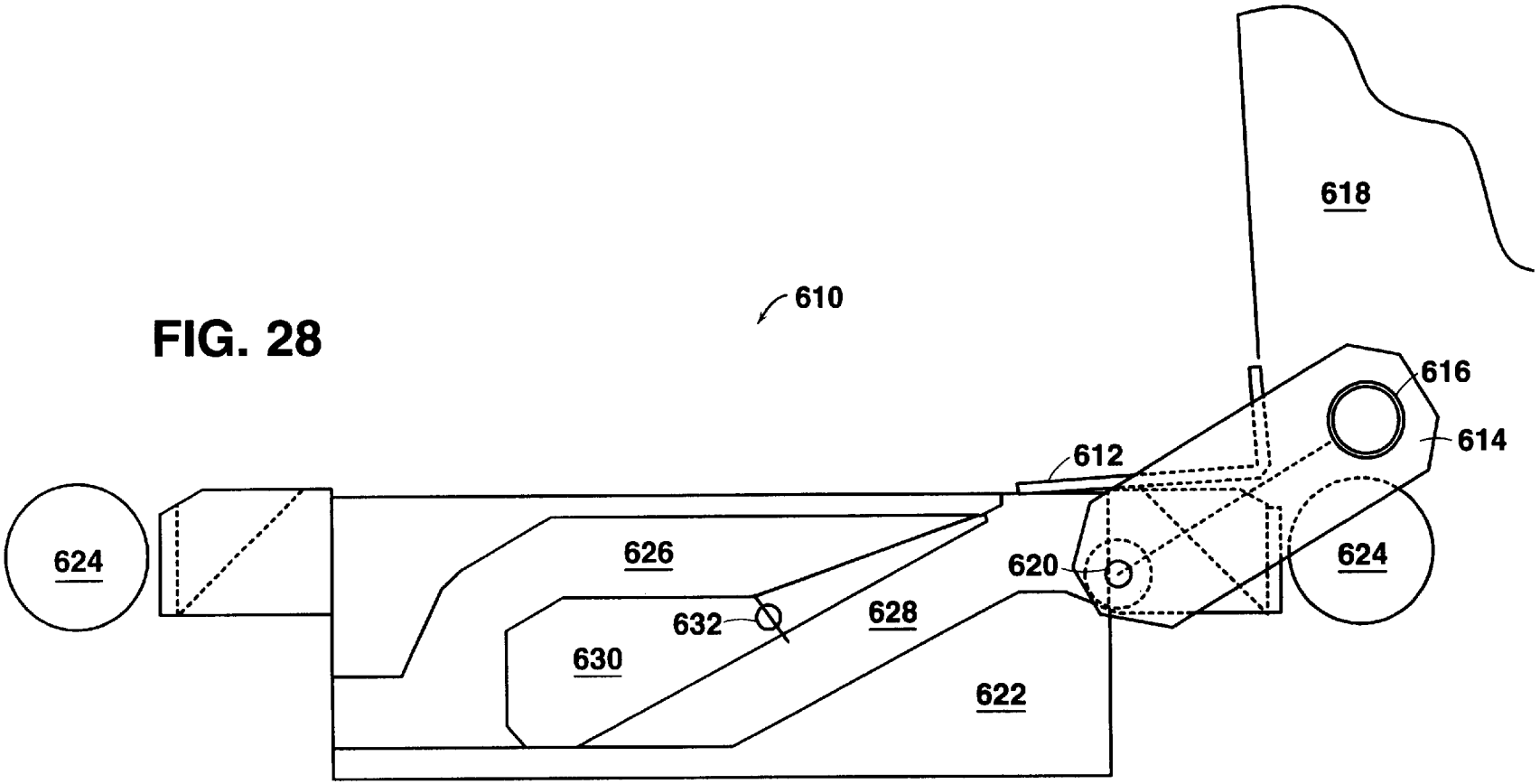
FIG. 28 is a side view of a shelf actuation mechanism for a sheet set feeder.

An alternate shelf actuation mechanism 610 for, e.g., set feeder 10, is shown in FIG. 28. Shelf actuation mechanism 610 is similar to left shelf actuation mechanism 59 of set feeder 10, in that it is configured to cause the right paper support shelf 612 to rotate back up to the horizontal orientation more rapidly than it rotates down to the near-vertical orientation.

Shelf 612 is rigidly attached to a pivot arm 614 in mechanism 610. The right end of pivot arm 614 is rotatably attached, via pivot 616, to the housing 618 of a set feeder similar in construction to set feeders 10, 110, 210, 310. The left end of pivot arm 614 carries a cam follower 620, which is configured to be received in a box cam 622.

Box cam 622 is carried between the rollers 624 of a shutter mechanism similar in construction to the shutter mechanisms of set feeders 10, 110, 210, 310. Rollers 624, box cam 622, and another box cam (not shown) disposed on the other side of the shutter define an aperture in the shutter. The other box cam is similar in construction to box cam 622, but is configured to rotate a left paper support shelf (not shown) in the same manner that box cam 622 rotates right paper support shelf 612.

Box cam 622 includes upper and lower pathways 626, 628 defined by a cam pivot arm 630 that pivots with respect to box cam 622 via a pivot 632. The left side of cam pivot arm 630 is overbalanced with respect to the right side of the arm, and thus the arm is biased by the force of gravity in the counterclockwise direction. Under the force of gravity alone, the left end of pivot arm 630 rests against the bottom wall of box cam 622.

Figure 29A:
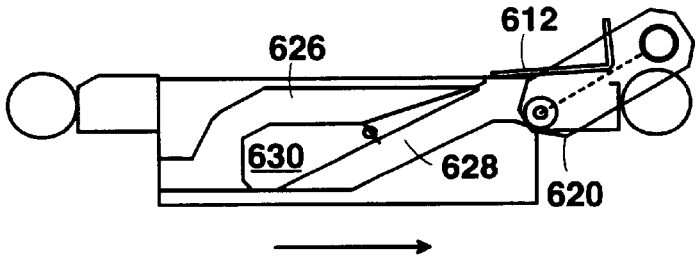
FIGS. 29A, 29B, 29C, 29D, 29E, 29F, and 29G are sequential side views showing the shelf actuation mechanism of FIG. 28 in operation.
Figure 29B:
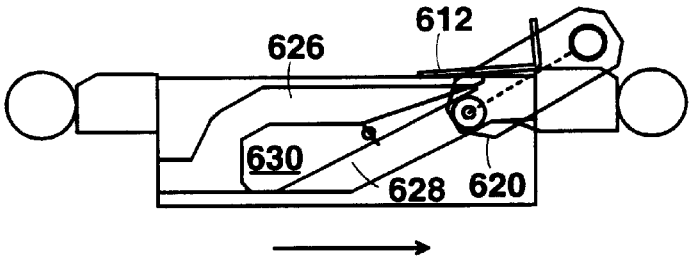
Figure 29C:
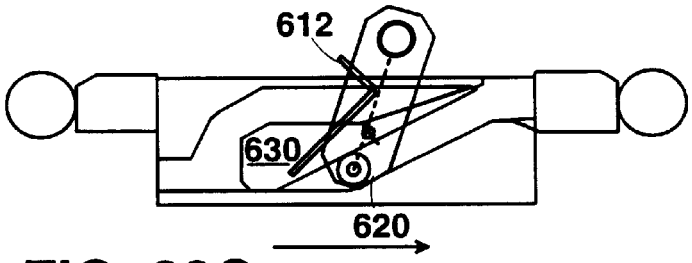
Figure 29D:
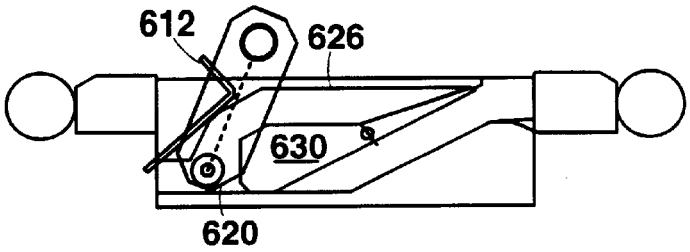

The operation of shelf actuation mechanism 610 is illustrated in sequential FIGS. 29A, 29B, 29C, 29D, 29E, 29F, and 29G. As shown in FIGS. 29A and 29B, when cam follower 620 first enters box cam 622, the right end of cam pivot arm 630 prevents the follower from entering upper path 626, forcing it instead into lower path 628. As box cam 622 continues to move to the right, cam follower 620 travels along lower path 628, causing shelf 612 to rotate downward in a counterclockwise direction, as shown in FIG. 29C. When it reaches the left side of pivot arm 630, follower 620 causes arm 630 to rotate clockwise. When cam follower 620 moves completely past the left end of pivot arm 630, gravity causes the overbalanced left side of the arm to rotate counterclockwise, until the left end of the arm again rests on the bottom wall of box cam 622, as shown in FIG. 29D.

Figure 29E:
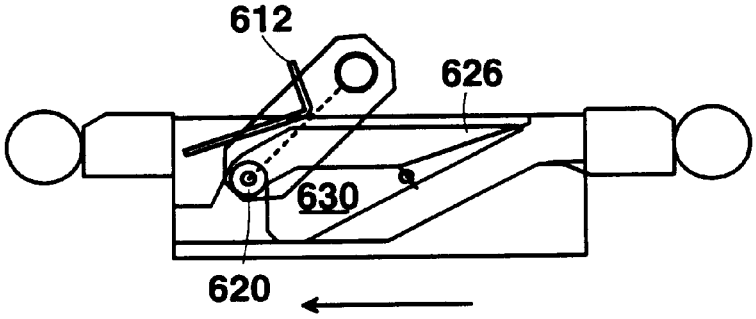
Figure 29F:
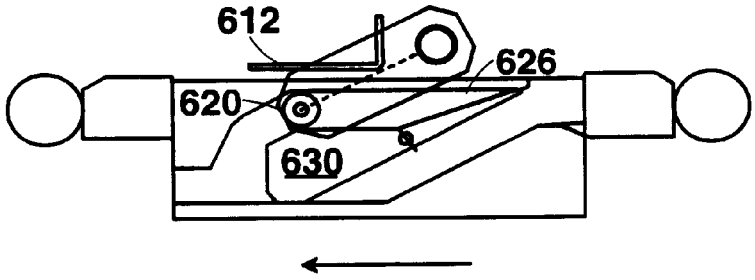
Figure 29G:
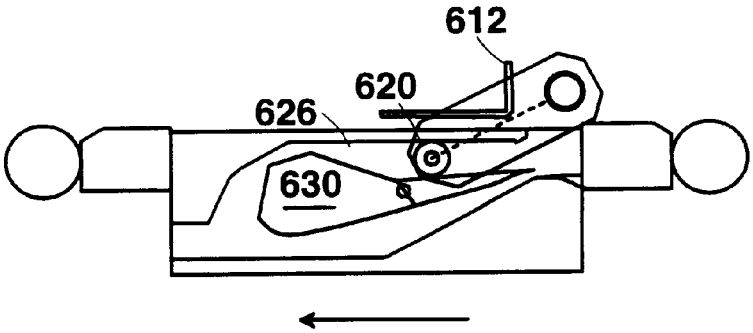

At this point, shelf 612 has rotated to a nearly vertical position, allowing the end of the bottommost paper set (not shown) to drop through the aperture. The shutter (and thus also box cam 622) then reverses direction. As the box cam moves to the left, cam follower 620 comes into contact with the left end of cam pivot arm 630, as shown in FIG. 29E. Because of the steep profile of the left end the arm, cam follower 620 moves up very quickly, causing shelf 612 to rotate rapidly up to the near-horizontal orientation. As explained above in connection with shelf actuating mechanism 59 of set feeder 10, by "snapping up" in this manner, shelf 612 is more rapidly positioned to support the free end of the next-to-bottommost sheet set, reducing the likelihood that the free end will droop down into the aperture in the shutter. As box cam 622 continues to move to the left, cam follower 620 continues to traverse upper pathway 626, causing shelf 612 to return to its horizontal orientation, as shown in FIG. 29F. As shown in FIG. 29G, as cam follower 620 moves past the right end of cam pivot arm 630, the arm is caused to rotate in a clockwise direction. When the follower exits box cam 622, gravity causes the overbalanced left side of the arm to rotate counterclockwise, until the left end of the arm again rests on the bottom wall of box cam 622.

In some embodiments of set feeders 10, 110, 210, 310, 410, the offset-jogged stack of sheet sets completely fills the sheet set hopper, covering the reciprocating shutter mechanism. For increased versatility, the hopper can instead be designed to handle sheets of various lengths and widths, e.g., 8½ in.×11 in., 11 in.×17 in., etc. For the reasons noted above, regardless of the paper size being processed, the stack should just fit between the walls of the hopper, such that the offset-jogged ends of the stack are positioned over the paper support shelves. It is also desirable to cover any portion of the shutter mechanism that remains exposed on the sides of the stack, e.g., to prevent debris from entering and possible fouling the set feeder and to protect the operator of the feeder from the reciprocating shutter.

Figure 30:
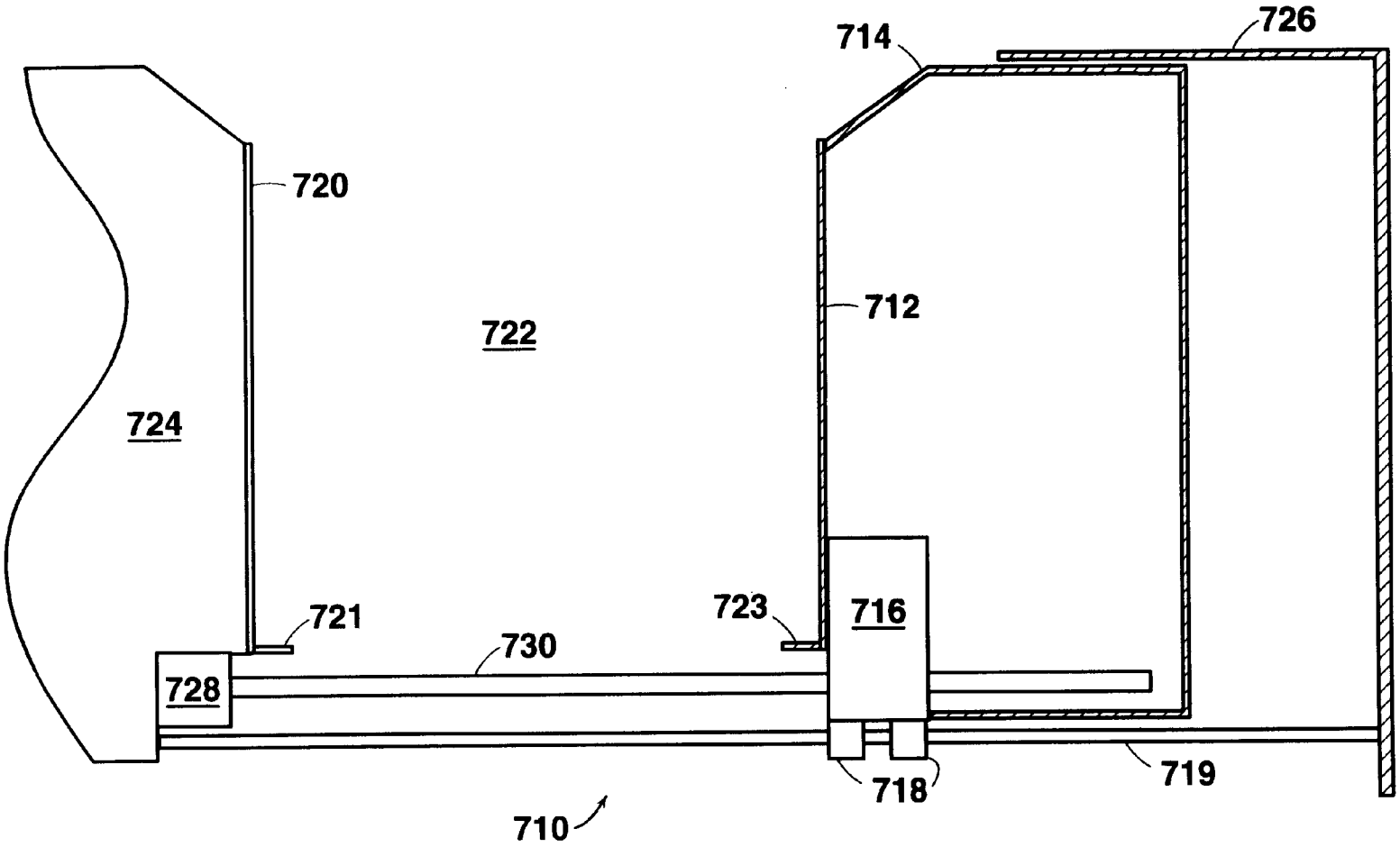
FIG. 30 is a schematic side view of a hopper wall and shelf adjusting mechanism for a sheet set feeder.
Figure 31:
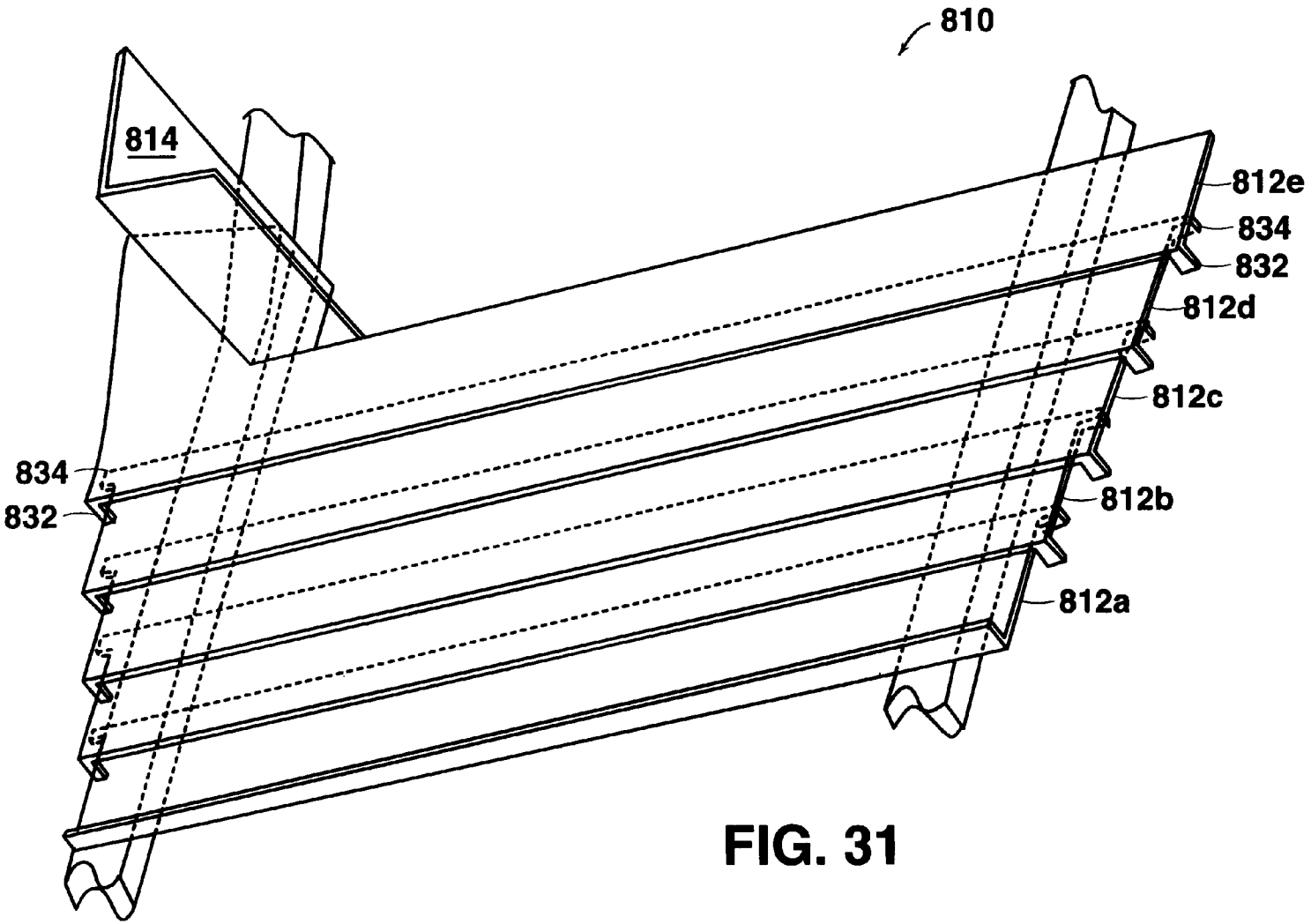
FIGS. 31 and 32 are perspective and schematic side views, respectively, of a shield mechanism for a sheet set feeder.
Figure 32:
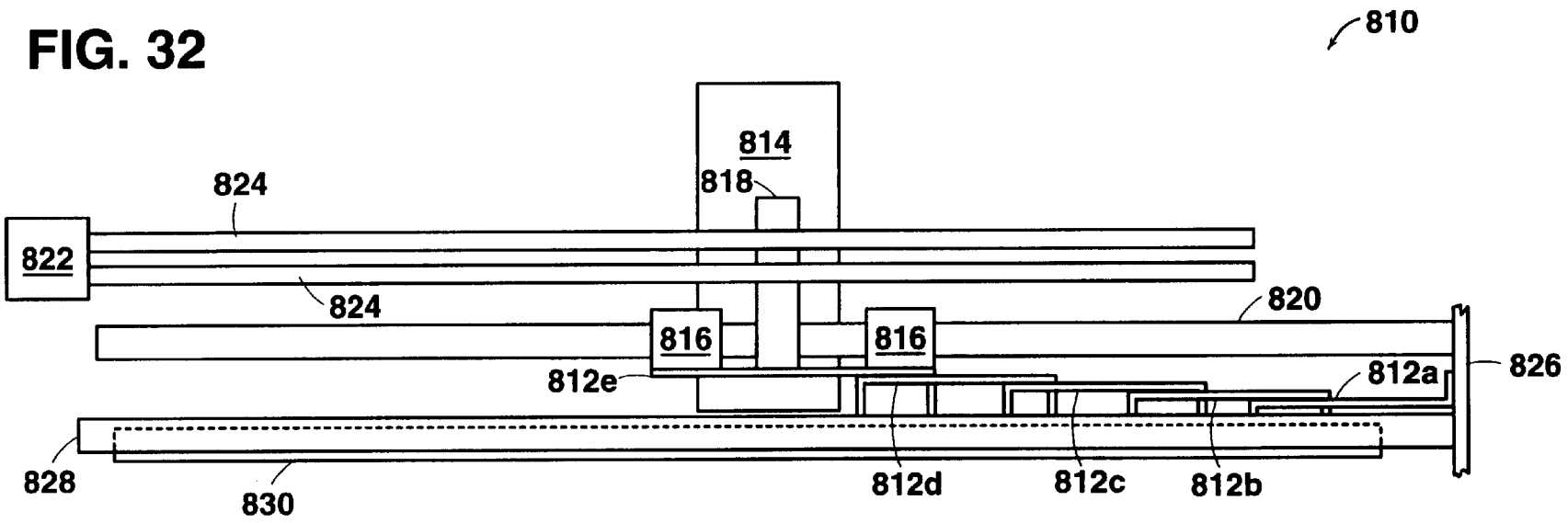

A mechanism for automatically moving the hopper walls and paper support shelves to accommodate sheets of different lengths is shown in FIG. 30, and a shield mechanism for automatically covering the side portions of the shutter to accommodate sheets of different widths is shown in FIGS. 31 and 32.

In the hopper wall and shelf adjusting mechanism 710 shown in FIG. 30, one hopper wall 712 (similar to hopper wall 16 of set feeder 10) and a paper set support shelf 723 are included in a movable housing assembly 714. Movable housing assembly 714 also includes a screw block 716 and a pair of linear bearings 718 that allow the entire housing assembly to be moved longitudinally, along rail 719, toward and away from the opposite wall 720 (and associated paper support shelf 721) of the hopper 722. Most components of adjusting mechanism 710 are positioned along the edge of the hopper, so as not to interfere with the feeding of paper sets.

Rail 719 extends between a fixed left housing 724 (which carries hopper wall 720 and paper support shelf 721) and a fixed right housing 726. A motor 728 attached to left housing 724 drives a lead screw 730 threaded into screw block 716. When energized to rotate in one direction, motor 728 causes movable housing assembly 714, and thus also hopper wall 712 and shelf 723, to move closer to hopper wall 720 and shelf 721. When energized to rotate in the opposite direction, motor 728 causes the distance between the two hopper walls to increase. The control of motor 728 can be automated, e.g., to set the appropriate wall-to-wall hopper distance in response to a user's indication of the length of the paper to be processed.

A similar mechanism is used to cover the portions of the shutter that lie alongside the stack of sheet sets. One side of a shield mechanism 810 is shown in FIGS. 31 and 32 (the other side of the shield mechanism is a mirror image of the this shield structure). Mechanism 810 includes a series of overlapping slidable plates 812*a*, 812*b*, 812*c*, 812*d*, 812*e*. A movable side guide 814, a pair of linear bearings 816, and a screw block 818 are attached to the outermost plate 812*e*. Linear bearings 816 ride longitudinally along a linear rail 820 that extends between the sides of the set feeder hopper. A motor driver assembly 822 at one side of the hopper drives a pair of lead screws 824, one of which is threadably engaged with screw block 818, and the other of which is threadably engaged with the screw block (not shown) of the other half of the shield mechanism.

The innermost plate 812*a* attaches to the housing 826 of the set feeder. All of the plates 812*a*, 812*b*, 812*c*, 812*d*, 812*e* ride on a support rail 828, such that the plates lie just above the shutter 830.

In operation, if side guide 814 is located adjacent housing 826 (that is, if the shield mechanism 810 is "open"), motor 822 can be energized to rotate in one direction, drawing side guide 814 and outermost plate 812*e* toward the motor. When outermost plate 812*e* is almost fully exposed, a pair of tangs 832 at either end of plate 812*e* engage mating tangs 834 on next-to-outermost plate 812*d*, drawing plate 812*d* toward motor 822 as well. This process can be continued until all of plates 812*a*, 812*b*, 812*c*, 812*d*, 812*e* are fully extended, as illustrated in FIGS. 31 and 32. To "close" shield mechanism 810, motor 822 is energized to reverse the direction of rotation, until all of plates 812*a*, 812*b*, 812*c*, 812*d*, 812*e* are again adjacent to housing 826.

As noted, shield mechanism includes two shield halves, each of which is driven by one of lead screws 824. Either or both shield halves can be independently decoupled from its associated lead screw 824, such that, e.g., only one shield half moves when motor 822 is energized. Thus, if the stack of sheet sets is placed in the center of the hopper, both shield halves are coupled to lead screws 824. When motor 822 is energized, both shields close at the same rate to cover the exposed shutter on both sides of the center-positioned (or "center-registered") stack. If the sheet stack is instead positioned against the left side of the hopper ("left registered"), the left shield half is decoupled from its associated lead screw 824. When motor 822 is energized, only the right shield half moves to cover the exposed shutter. Likewise, if the sheet stack is positioned against the right side of the hopper ("right registered"), the right shield half is decoupled from its associated lead screw 824.

Like motor 728, the control of motor 822 can be automated, e.g., to close the shield by the appropriate amount in response to a user's indication of the width of the paper to be processed. So, in a set feeder that employs both shelf adjusting mechanism 710 and shield mechanism 810, the user could, e.g., press a button indicating the size of the paper to be processed (e.g., 8½ in.×11 in.), and the two mechanisms 710, 810 could automatically adjust the hopper size and cover any exposed portions of the shutter.

The various features of the embodiments described herein, such as the air jet passages, the primary and secondary accumulator arrangement, the tensioning bar, the shelf-actuation mechanisms, and the drive mechanisms, may be interchanged among the various sheet set feeders as desired.

Although in the above-described sheet set feeders 10, 110, 210, 310, 410, sheet sets are fed from the bottom of the stack, other feeder configurations are possible. For instance, in a sheet set feeder 1010 shown in FIG. 33, individual sets are fed from the top of the stack. Sheet set feeder 1010 includes a housing 1012. Two facing vertical walls of housing 1012, left wall 1014 and right wall 1016, define a hopper 1018 for receiving a stack 1020 comprised of offset-jogged sheet sets 1022*a*, 1022*b*, 1022*c*, 1022*d*, each of which in turn comprises two or more sheets 1024*a*, 1024*b*, 1024*c*, 1024*d* of, e.g., paper. (Sheet set feeder 1010 can also be used to feed offset-jogged sets of other types of substantially planar sheets, such as of film or fabric.) The distance between left wall 1014 and right wall 1016 of hopper 1018 is approximately equal to the length of a single sheet set, plus the distance by which each set is offset-jogged with respect to adjacent sets. Right wall 1016 can be moved toward and away from left wall 1014 to adjust the dimensions of hopper 1018 to accommodate sets of different lengths (e.g. by using mechanism 710).

An elevator 1026 disposed within hopper 1018 supports stack 1020. Elevator 1026 comprises a substantially flat surface that is moved up and down by an elevator mechanism 1028. Elevator mechanism 1028 may be driven by, e.g., a motor or a pneumatic pump, and may comprise, e.g., a lead screw and screw block assembly, a chain drive arrangement, or a hydraulic or pneumatic piston.

Pivoting fingers 1030, 1032 are located near the top opening of hopper 1018 on the left and right sides of hopper 1018, respectively. Pivoting fingers 1030, 1032 are pivotable about pivot points 1034, 1036 and are moved by pivoting mechanisms 1038, 1040, respectively. Pivoting mechanisms 1038, 1040 can be driven by, e.g., reversible electric motors, solenoids or pneumatic pumps. Pivoting mechanisms 1038, 1040 can be operated to pivot fingers 1030, 1032 around pivots 1034, 1036, and also to move pivots 1034, 1036 left and right along respective slots.

Pivoting fingers 1030, 1032 hold topmost left-jogged and right-jogged sets 1022*a* and 1022*b* in place at their left and right ends, respectively. Pivoting finger 1030 can also be long enough to hold lower right-jogged set 1022*b* in place at its left end. Pivoting fingers 1030, 1032 depress respective ends of sets 1022*a*, 1022*b* slightly at the points of contact (which may cause respective opposite ends of sets 1022*a*, 1022*b* to be raised slightly, depending on the sheet material and the dimensions of the sheets), facilitating the separation of sets 1022*a*, 1022*b*.

A linear rail 1042 is disposed above hopper 1018. A gripper 1044 (shown in detail below in FIGS. 34A, 34B and 35) is attached to a carriage 1046, which moves back-and-forth along rail 1042 by, e.g., a reversible electric motor 1050. Reversing the direction of rotation of motor 1050 reverses the direction of motion of gripper 1044 along linear rail 1042. Gripper 1044 is moved left and right along linear rail 1042, and can be closed to grab the end of the topmost set, and opened to release the set.

The rotational speed of motor 1050 may be controlled to vary the linear speed of gripper 1044 along linear rail 1042. To provide for smooth motion of gripper 1044, motor 1050 is initially controlled so that it ramps up from zero velocity to a constant speed. This speed is maintained until gripper 1044 nears its leftmost or rightmost point of travel, at which point the motor speed is ramped back down to zero. The direction of rotation of motor 1050 is then reversed, and the velocity profile repeated for the next cycle.

A level sensor 1058 located near the top opening of hopper 1018 detects the height of stack 1020 within hopper 1018. Level sensor 1058 may be, e.g., an "electric eye" sensor (photosensor) or other type of sensing device. Level sensor 1058 determines when stack 1020 has been raised to a predetermined height by sensing the presence of the top of stack 1020 in the region of the top opening of hopper 1018. Level sensor 1058 communicates with elevator mechanism 1028 via a controller (not shown) to activate elevator mechanism 1028 to move elevator 1026 upward so that top set 1022*a* is positioned at the proper height to be grabbed by gripper 1044.

A rubber-tipped push rod or snubber 1148 resides within left wall 1014 of housing 1012 and is actuatable to move horizontally back and forth. Snubber 1048 is capable of pushing a right-jogged set, e.g., next-to-topmost set 1022*b*, to the right a short distance so that gripper 1044 may easily grab the right end of set 1022*b*.

Air jets 1150, 1160 are disposed on housing 1012. Air passages 1151, 1162 connected to air jets 1150, 1160, respectively, pass through housing 1012 and are angled slightly downwardly. Air passages 1151, 1162 are directed toward the left and right ends of topmost set 1022*a* and next-to-topmost set 1022*b*. Air jets 1150, 1160 may be controlled to issue air blasts, or slower, more steady streams of air, through air passages 1151, 1162. Air jets 1150, 1160 comprise manifolds 1152, 1164 and solenoid valves 1154, 1166, respectively, which are in turn connected to a source or sources of pressurized gas. When solenoid valves 1154, 1166 are energized, air from the gas source is supplied to manifolds 1152, 1164, causing air to issue from air passages 1151, 1162. Valves 1154, 1166 can be operated to deliver low-velocity to high-velocity air flow. Air jet 1150 may be activated to produce a stream of air directed downwardly toward the right end of next-to-topmost set 1022*b*, to facilitate set separation during operation, as described in detail below. Similarly, air jet 1160 may be activated to produce a stream of air directed downwardly toward the left end of next-to-topmost set 1022*b*.

Figure 34A:
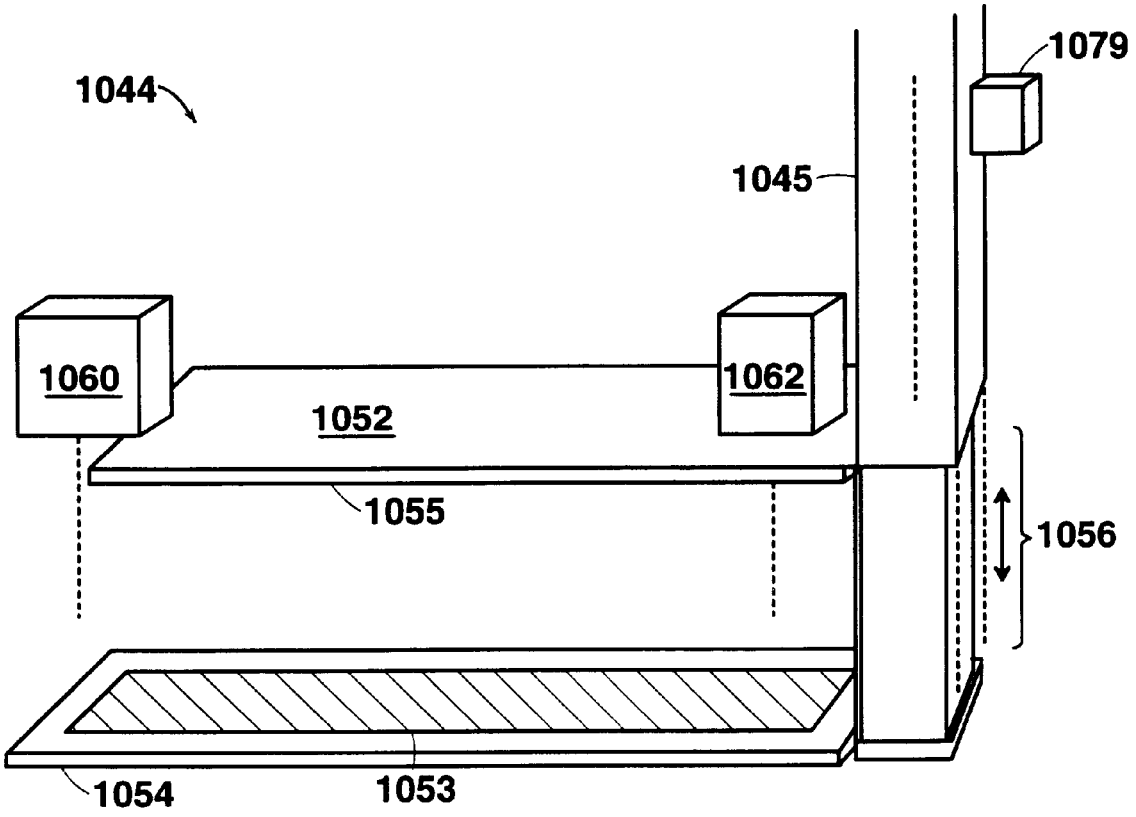
FIGS. 34A is a cross-sectional side view of a gripper for grabbing the topmost set from the stack of sheet sets placed in the feeder shown in FIG. 33.
Figure 34B:
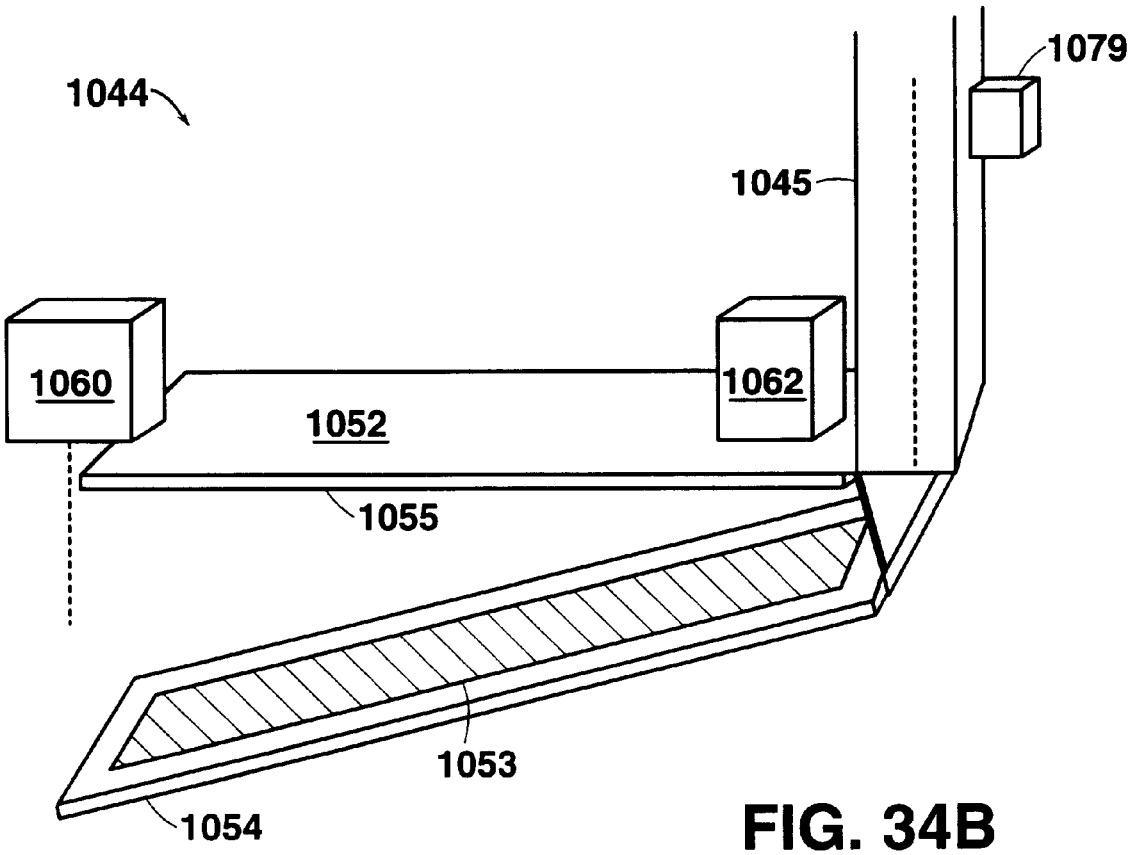
FIGS. 34B is a cross-sectional side view of another gripper for grabbing the topmost set from the stack of sheet sets placed in the feeder shown in FIG. 33.
Figure 35:
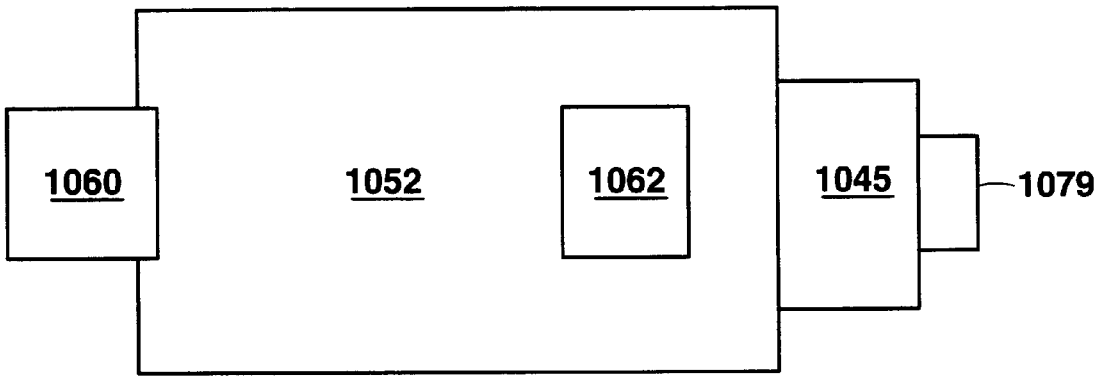
FIG. 35 is a top view of the gripper shown in FIG. 34A.

As shown in greater detail in FIGS. 34A, 34B and 35, gripper 1044 is comprised of substantially planar jaws 1052, 1054 which, in their open position, are spaced apart by a distance at least slightly greater than the thickness of the set which is to be grabbed. The interior surfaces of jaws 1152, 1054 are lined with thin rubber pads 1053, 1055, which, when in contact with the sheets of the grabbed set, provide a friction force to assist in holding the set within jaws 1152, 1054. Jaw 1152 is fixedly connected to gripper arm 1045. Jaw 1054 is connected to a movable rod 1056 that may be activated to move up and down by, e.g., a solenoid or a motor/lead screw/screw block arrangement (such as used in hopper wall and shelf adjusting mechanism 710). Rod 1056 is telescoped within gripper arm 1045 to be movable therein. Rod 1056 may be moved upward, bringing jaw 1054 closer to jaw 1152 to grab topmost set 1022*a*. Rod 1056 may also be moved downward, increasing the separation between jaws 1152, 1054 to release the grabbed set.

Alternatively, jaws 1052, 1054 may be pivotally connected for grabbing topmost set 1022*a*, as shown in FIG. 34B. Instead of the single-pivot arrangement shown in FIG. 34B, the jaw assembly could be a multi-pivot linkage, such as a parallelogram linkage.

A leading edge sensor 1060, disposed on jaw 1052 near the opening formed by jaws 1052, 1054, detects when the right edge of topmost set 1022*a* has entered jaws 1052, 1054. A trailing edge sensor 1062 disposed on jaw 1052 near rod 1056 detects when gripper 1044 has fully captured the right edge of topmost set 1022*a*. When this occurs, set 1022*a* is grabbed by closing jaws 1052, 1054. Leading edge sensor 1060 and trailing edge sensor 1062 may be, e.g., electric eye sensors, similar to level sensor 1058 described above.

Figure 36:
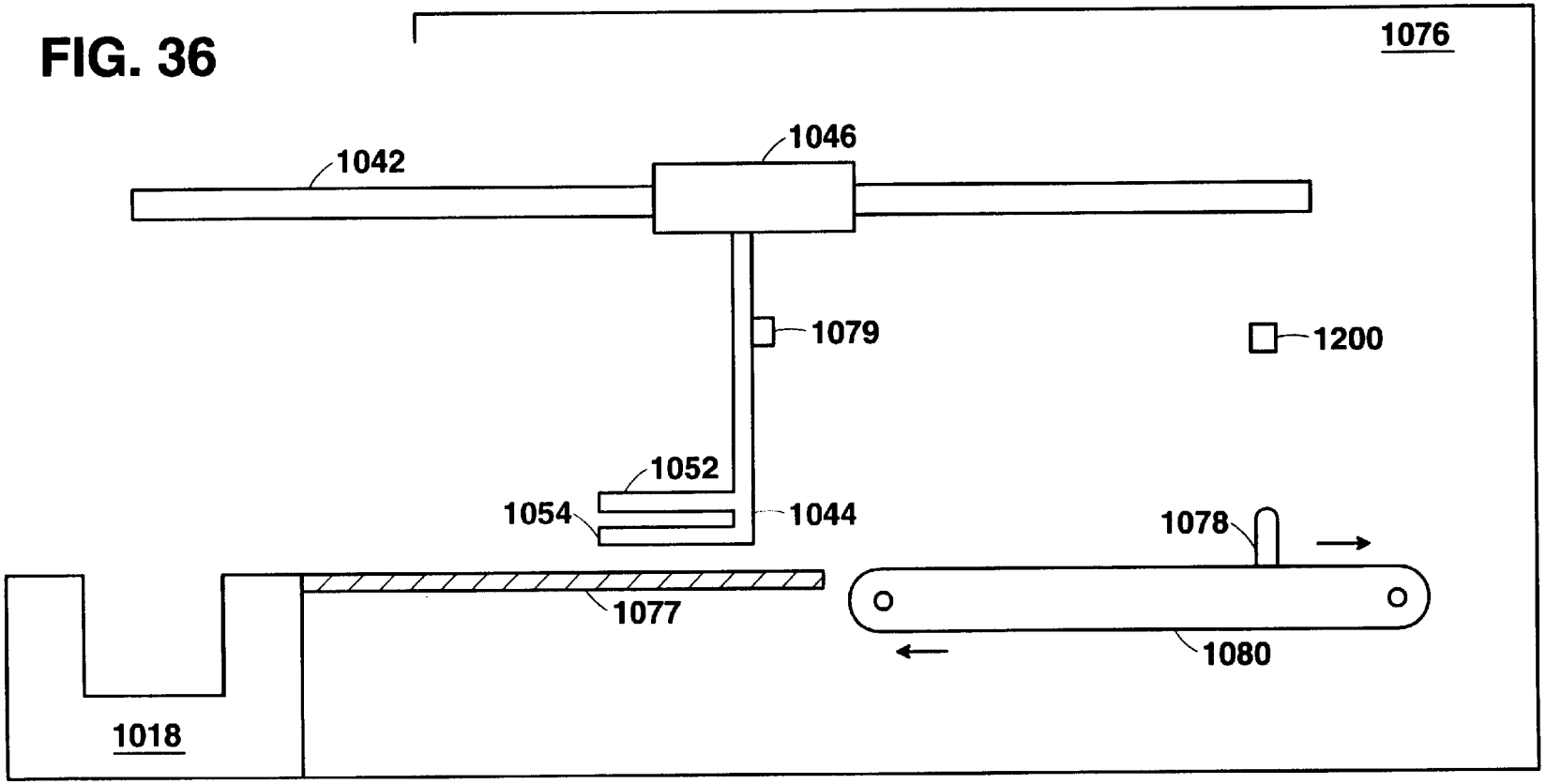
FIG. 36 is a cross sectional side view of the output of the feeder shown in FIG. 33 being fed into an accumulator.

As shown in FIG. 36 (not to scale), an accumulator 1076 is located adjacent to hopper 1018. A substantially planar surface 1077 runs along the length of accumulator 1076 from hopper 1018. Planar surface 1077 is positioned at a height so that topmost set 1022*a* remains substantially horizontal when set 1022*a* is pulled off the top of stack 1020 and through accumulator 1076. When gripper 1044 releases grabbed set 1022*a* within accumulator 1076, it will fall without substantially disturbing the organization of the sheets of set 1022*a*, since set 1022*a* remains in a nearly horizontal orientation as it is pulled into accumulator 1076 until it is dropped.

Accumulator 1076 includes a conveyor belt 1080. Accumulator 1076 can include other means for carrying away sets 1022*a*, 1022*b*, 1022*c*, 1022*d*, and/or a rotator 246 (FIGS. 17, 18, 19) for rotating the individual sets, e.g., by 90°.

The bottom of gripper 1044 is spaced above conveyor belt 1080 by a distance greater than the thickness of a typical large set 1022*a*, e.g., about two inches. Two solenoid-actuated pins 1078 (only one shown in FIG. 36) project from the top surface of conveyor belt 1080 when the solenoids are energized, and are recessed below the surface of the conveyor belt when deenergized. An indicator switch 1200 (such as a proximity switch) lies directly above pins 1078, such that when a finger 1079 on gripper 1044 moves past the switch, it sends a signal to the controller to open the jaws of the gripper. The pins 1078 are spaced apart (in the direction perpendicular to the plane of FIG. 36) to allow gripper 1044 to move between them. The operation of this subassembly of accumulator 1076 is described in detail below.

Like bottom set feeder 10, top set feeder 1010 is configured to interface with finishing and processing equipment, such that the conveyor belt 1080 supplies individual sets, in sequence to, e.g., a cover feeder 190 (FIG. 9), a stitcher/folder 196 and/or a face trimmer 197 (FIG. 10), a perfect binder 198 (FIG. 11), a mailing/inserting system 199 (FIG. 12), and/or a shrink wrapper 200 (FIG. 13).

Figure 33:
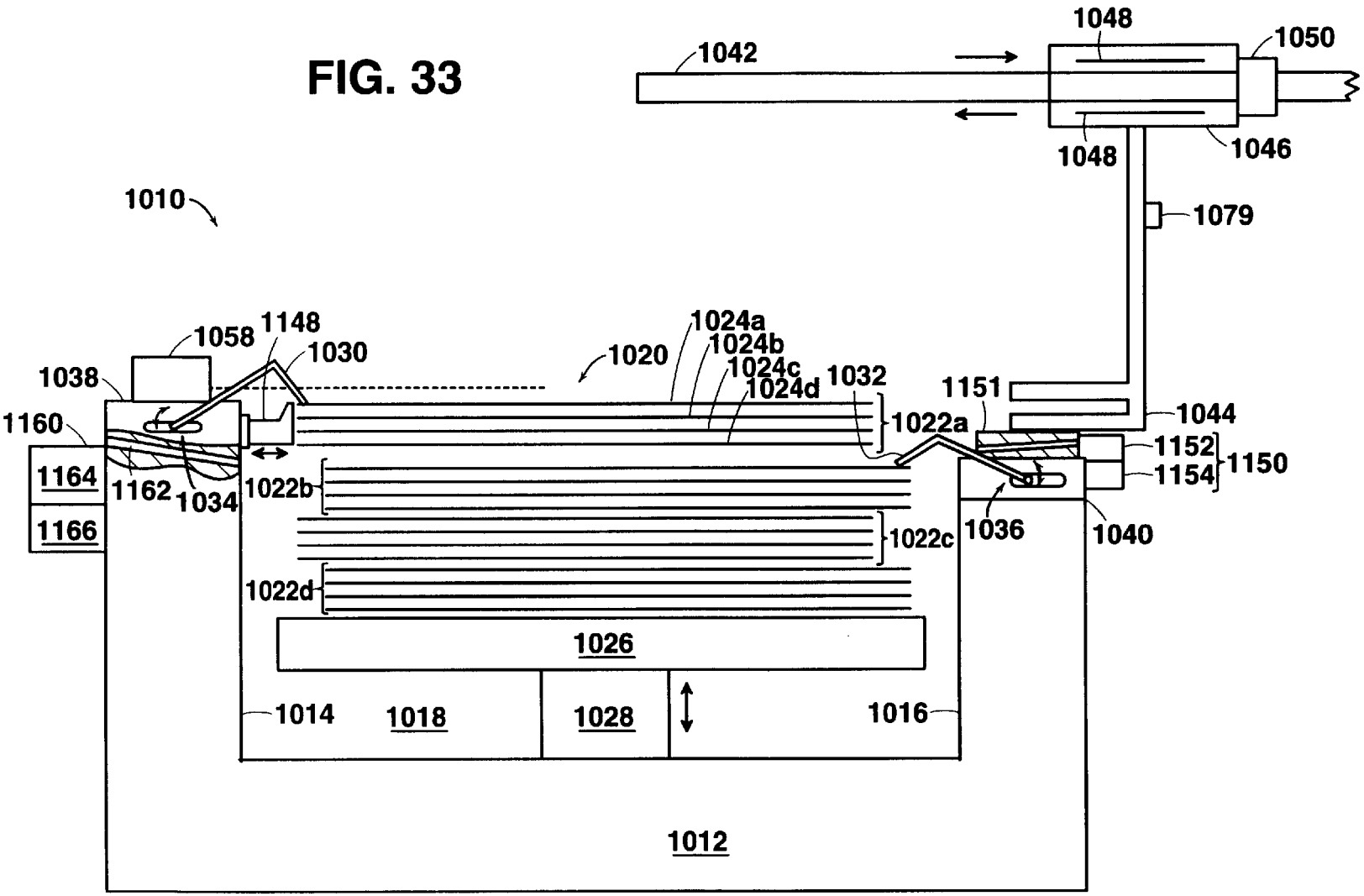
FIG. 33 is a cross-sectional side view of a sheet set feeder with a stack of sheet sets placed into the feeder.

In operation, stack 1020 is placed into hopper 1018 of sheet set feeder 1010 so that bottommost set 1022*d* rests on elevator 1026, as shown in FIG. 33. When stack 1020 is placed in hopper 1018, level sensor 1058 may not detect that set 1022*a* is at the proper height to be grabbed by gripper 1044. If so, level sensor 1058 will send a signal to the controller (not shown) to activate elevator mechanism 1028 to raise elevator 1026. When level sensor 1058 detects that set 1022*a* is at the proper height to be grabbed by gripper 1044, level sensor 1058 sends a signal to the controller (not shown) to activate elevator mechanism 1028 to cease upward movement of elevator 1026.

As shown in FIG. 33, gripper 1044 moves along linear rail 1042 from right to left to grab the right end of topmost set 1022*a*. Two different cycles are used to remove the offset-jogged sets 1022*a*, 1022*b*, 1022*c*, 1022*d* from the top of stack 1020.

Figure 37A:
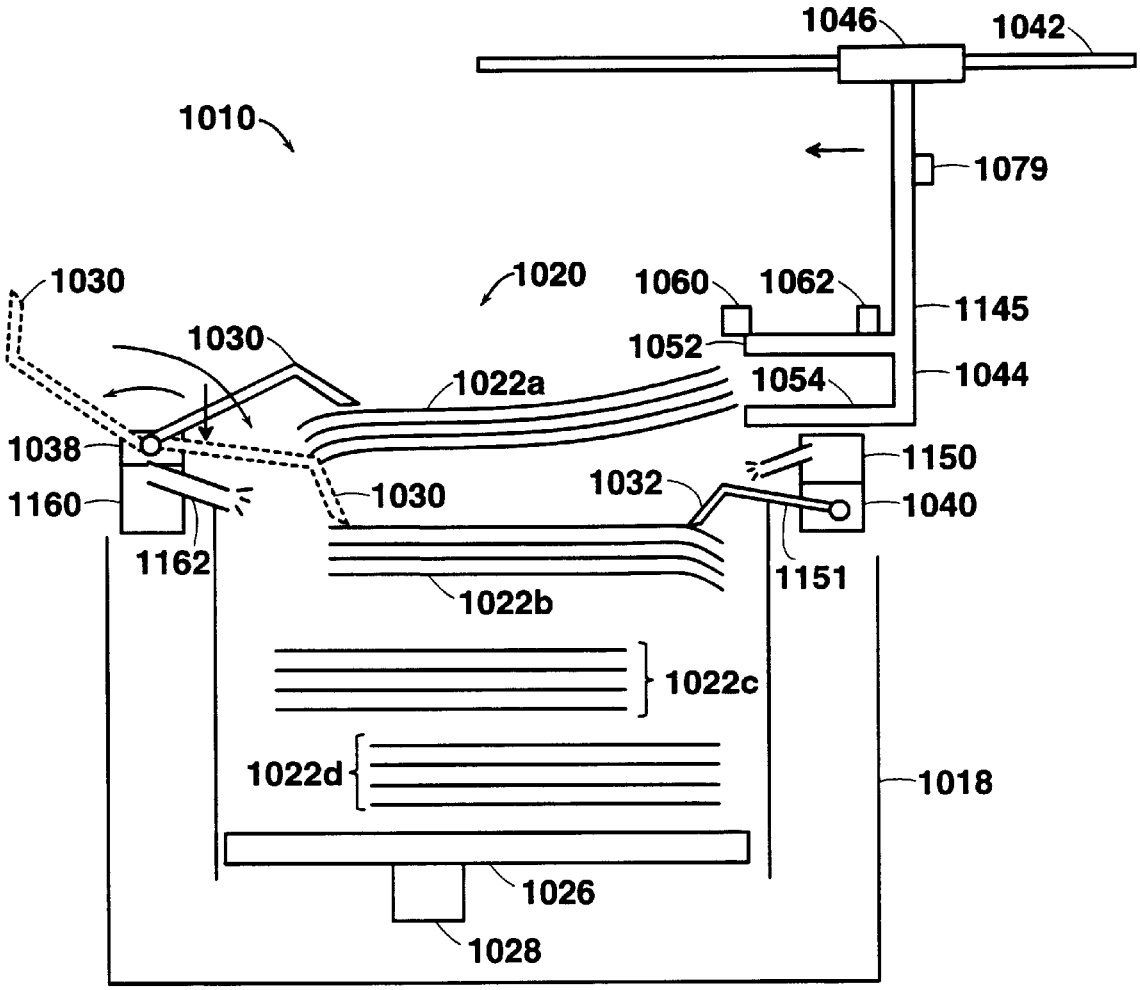
FIGS. 37A, 37B, 37C and 37D are schematic side views showing the sheet set feeder shown in FIG. 33 in operation.

In the first cycle, left-jogged set 1022*a* is removed from the top of stack 1020. As shown in FIG. 37A, carriage 1046 moves along linear rail 1042 from the right until leading edge sensor 1060 detects the right edge of set 1022*a*. When it does, sensor 1060 sends a signal to the controller to activate air jet 1150, producing a blast of air through air passage 1151 to slightly raise the right end of set 1022*a* and slightly lower the right end of set 1022*b*, facilitating separation of sets 1022*a*, 1022*b*. The blast of air from jet 1150, in conjunction with the effect of pivoting finger 1030, which pushes down on the left side of set 1022*a* and consequently may raise the right side of set 1022*a*, facilitates separation of the right ends of sets 1022*a*, 1022*b* so that the jaws 1052, 1054 of gripper 1044 may easily slide around the right end of set 1022*a*.

When trailing edge sensor 1062 detects that the jaws 1052, 1054 of gripper 1044 have fully encompassed the right edge of topmost set 1022*a*, jaws 1052, 1054 clamp shut to firmly grasp topmost set 1022*a*. Pivoting mechanism 1038 is activated by, e.g., a timer or a stepper mechanism (not shown), to rotate finger 1030 to release the left edge of set 1022*a* to allow set 1022*a* to be pulled off the top of stack 1020.

Once gripper 1044 has grabbed set 1022*a*, carriage 1046 reverses direction and moves to the right to pull set 1022*a* off the top of stack 1020. The timer or stepper mechanism that activates pivoting mechanism 1038 may also activate air jets 1150, 1160 to issue air blasts, or slower, more steady steams of air, through air passages 1151, 1162 to facilitate separation of sets 1022*a*, 1022*b* so that set 1022*a* may easily slide across the top of set 1022*b*. After gripper 1044 pulls set 1022*a* to the right a short distance, e.g., one inch, pivoting finger 1030 is activated by the timer or stepper mechanism to contact the left end of next-to-topmost set 1022*b* to help prevent set 1022*b* from being pulled to the right by gripper 1044 along with topmost set 1022*a*.

Figure 37B:
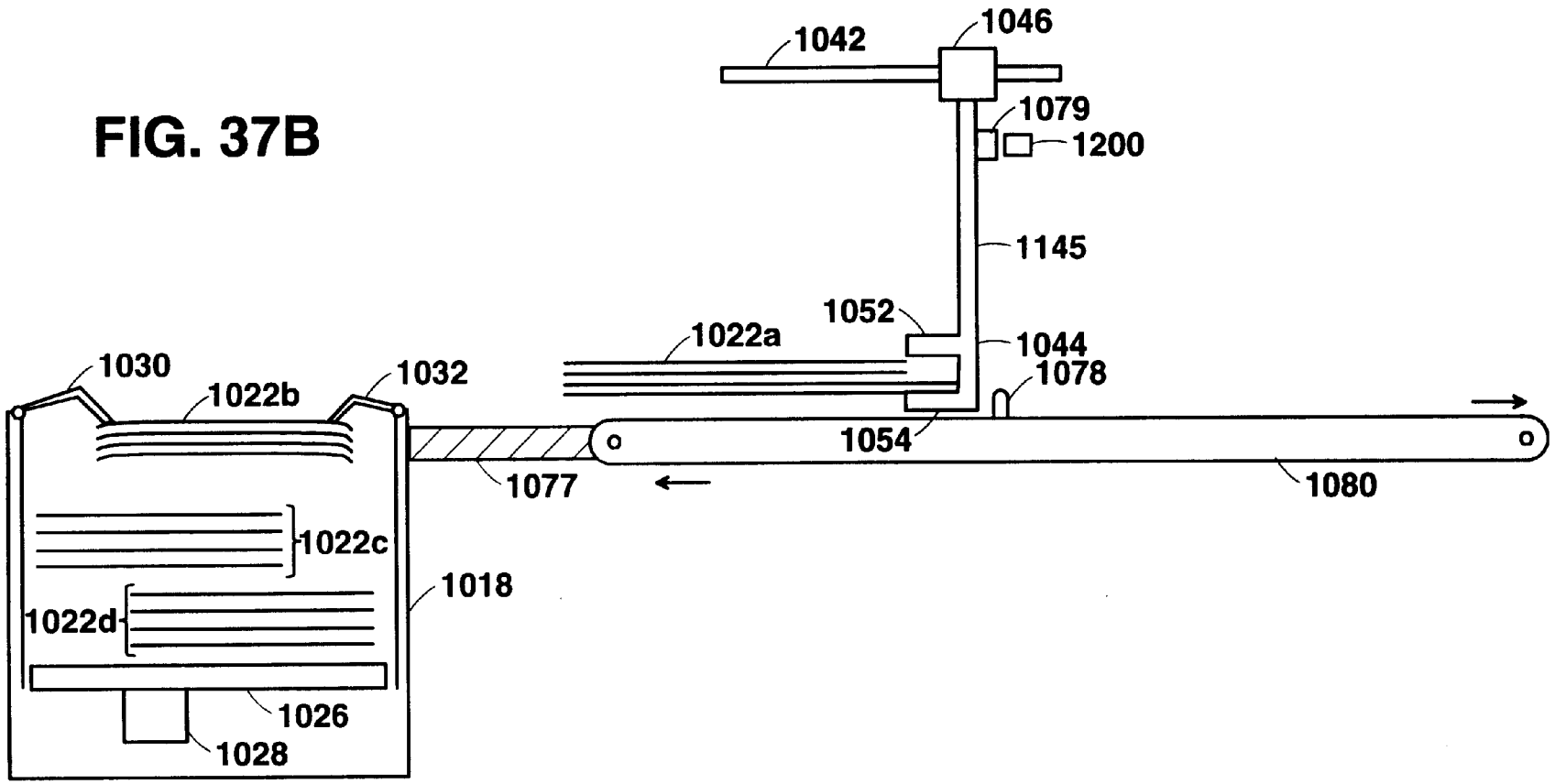

As shown in FIG. 37B, gripper 1044 pulls set 1022*a* to the right. At this point, conveyor belt 1080 is stopped, and the solenoids that drive pins 1078 are energized to extend the pins. When finger 1079 passes switch 1200, the controller opens jaws 1052, 1054 of gripper 1044. As gripper 1044 continues to move to the right between the pins, set 1022*a* is stopped by pins 1078. When the jaws of the gripper slide completely out from underneath the set, set 1022*a* falls onto conveyor belt 1080. The lower jaw 1054 of gripper 1044 is then closed, the solenoids that drive pins 1078 are deenergized to retract them, and conveyor belt 1080 is switched on to deliver set 1022*a* to, e.g., the associated processing equipment.

Once topmost set 1022*a* has been removed from stack 1020, level sensor 1058 detects that the topmost set 1022*b* of stack 1020 is not at the required level to be grabbed by gripper 1044. Level sensor 1058 sends a signal to the controller (not shown) to activate elevator mechanism 1028 to raise elevator 1026 until topmost set 1022*b* is at the proper height to be grabbed by gripper 1044. When level sensor 1058 detects that topmost set 1022*b* has reached the proper level to be grabbed by gripper 1044, level sensor 1058 sends a signal to the controller (not shown) to cause elevator mechanism 1028 to cease the upward movement of elevator 1026.

Figure 37C:
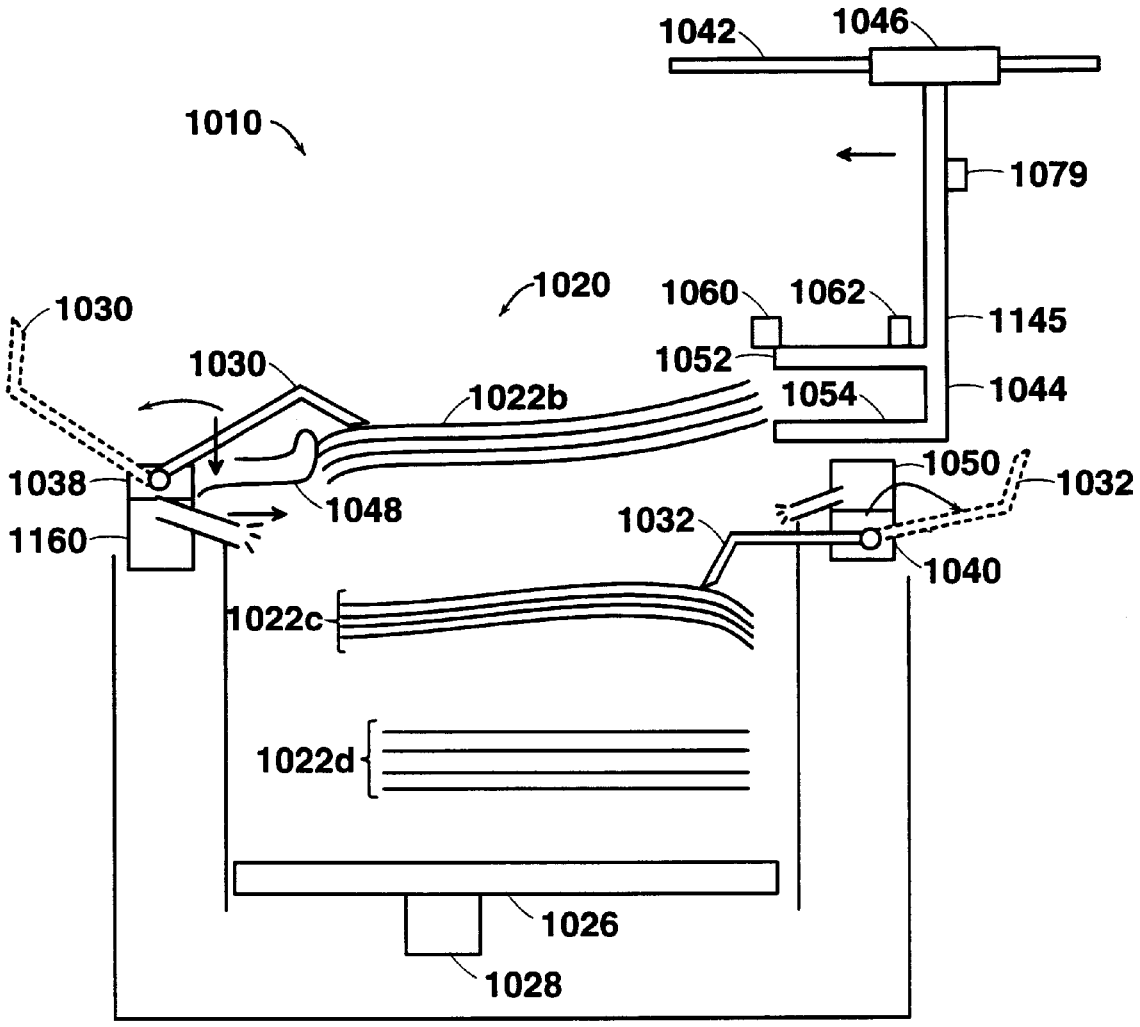

In the second cycle, right-jogged set 1022*b* is removed from the top of stack 1020. As shown in FIG. 37C, carriage 1046 moves along linear rail 1042 from the right so that the open jaws 1052, 1054 of gripper 1044 will easily slide around the right edge of topmost set 1022*b*. Before gripper 1044 reaches hopper 1018, the controller (not shown) activates pivoting mechanism 1034, 1036 to rotate fingers 1030, 1032, respectively, upward and out of the path of gripper 1044. When leading edge sensor 1060 detects the right edge of set 1022*b*, it sends a signal to the controller (not shown) to stop carriage 1046. The controller then activates snubber 1048 to push set 1022*b* to the right a short distance so that gripper 1044 may easily grab the right end of set 1022*b*.

When trailing edge sensor 1062 detects that the jaws 1052, 1054 of gripper 1044 have fully encompassed the right edge of topmost set 1022*b*, jaws 1052, 1054 clamp shut to firmly grasp topmost set 1022*b*.

Once gripper 1044 has grabbed set 1022*b*, carriage 1046 reverses direction and moves to the right to pull set 1022*b* off the top of stack 1020. The timer or stepper mechanism may also activate air jets 1150, 1160 to issue air blasts, or slower, more steady streams of air, through air passages 1151, 1162 to facilitate separation of sets 1022*b*, 1022*c* so that set 1022*b* may easily slide across the top of set 1022*c*.

Figure 37D:
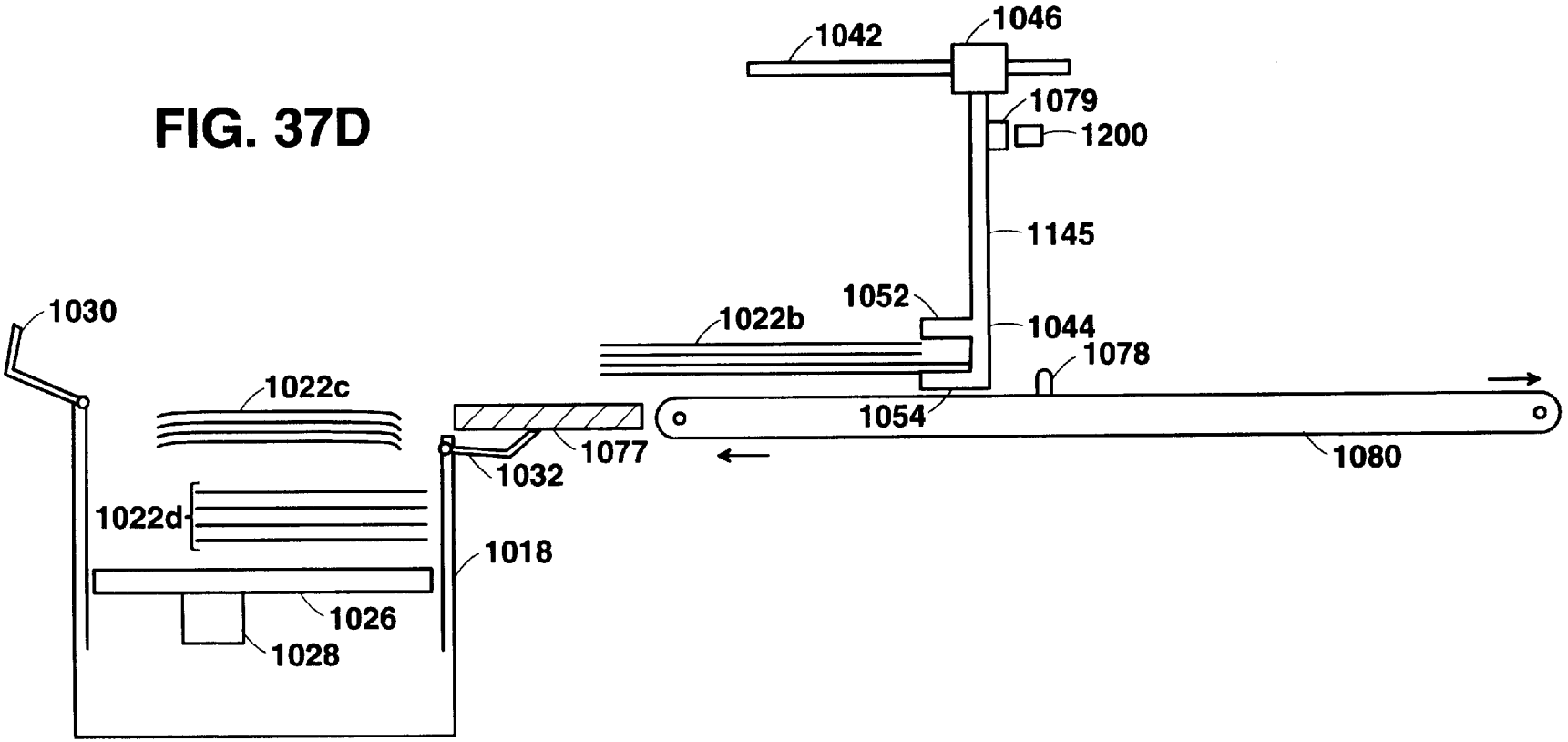

As shown in FIG. 37D, gripper 1044 pulls set 1022*b* to the right, and the set is disengaged from the gripper in the manner described above in connection with set 1022*a*.

Pivoting fingers 1030, 1032 are reset to their original positions, and the first and second cycles are repeated until all remaining sets 1022*c*, 1022*d* are fed onto conveyor belt 1080.

Figure 38:
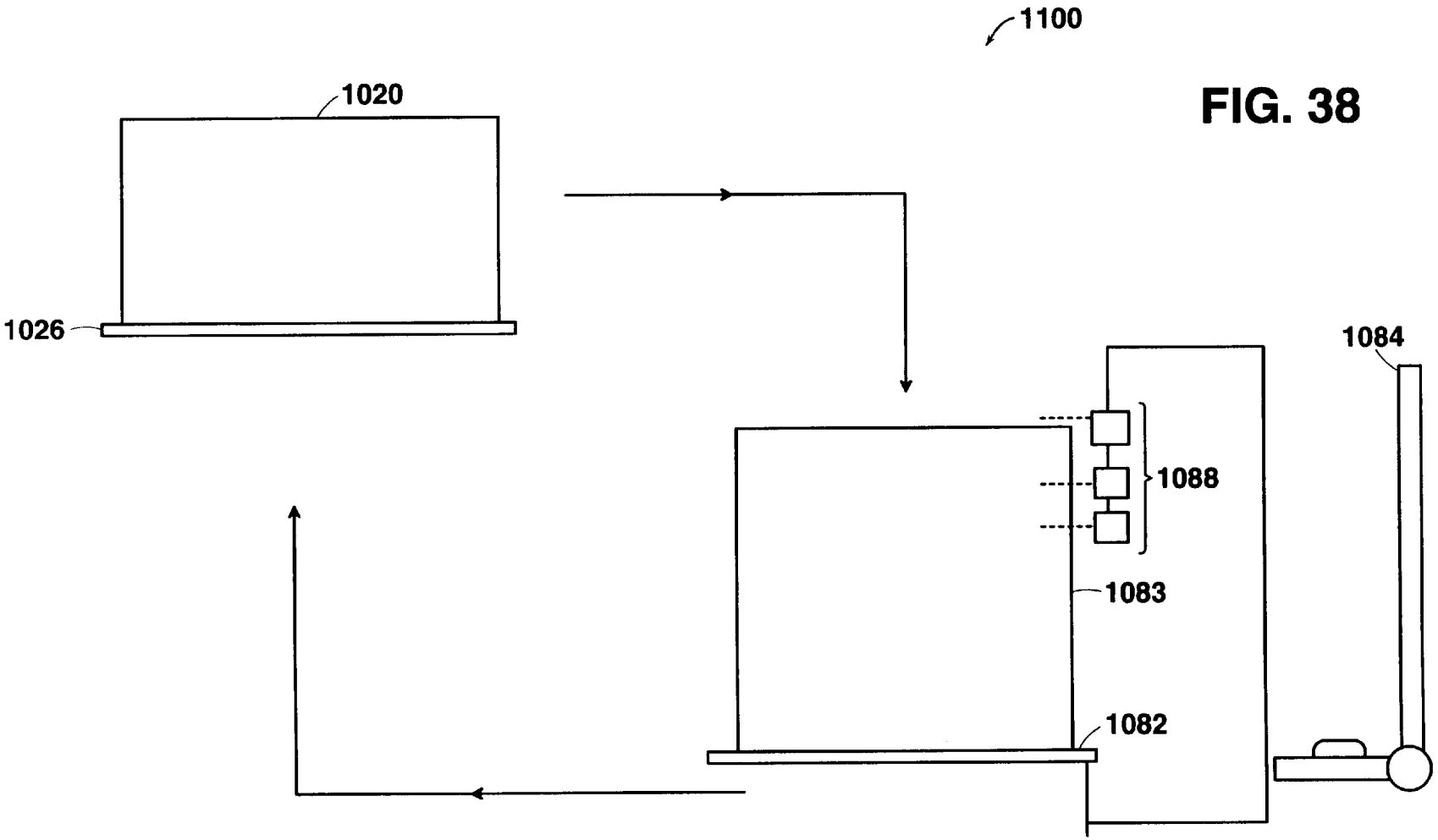
FIG. 38 is a schematic diagram showing the operation of a dual elevator stacking system.

An additional feature of the invention is a stacker 1100 for loading offset-jogged sets onto elevator 1026. As shown in FIG. 38 (schematic diagram), a second elevator 1082 may be loaded while individual sets are removed from elevator 1026 according to the procedure described above. Elevators 1026 and 1082 are driven independently by, e.g., separate belt systems (not shown).

While stack 1020 on elevator 1026 is being processed on the left portion of the system shown in FIG. 38, elevator 1082 is at the right of the system and at its lowest position, or an intermediate position, and a new stack of sets may be loaded onto elevator 1082. Alternatively or additionally, elevator 1082 may rest at the lowest position so that a dockable cart 1084 may be locked onto elevator 1082, e.g., using mechanical guides and couplings, to transfer a stack of sets 1083 onto elevator 1082. Alternatively or additionally, elevator 1082 may be lowered in incremental steps, as determined by a sensor or sensors 1088, so that stacks of sets may be loaded manually at a height convenient for the operator. Sensor 1088 may be, e.g., an electric eye sensor. When processing on elevator 1026 is complete, elevator 1026 is moved to the right portion of the system shown in FIG. 38 and lowered to be loaded, elevator 1082 (loaded with a stack 1083 of sets) simultaneously moves to the left for processing of stack 1083.

Figure 39:
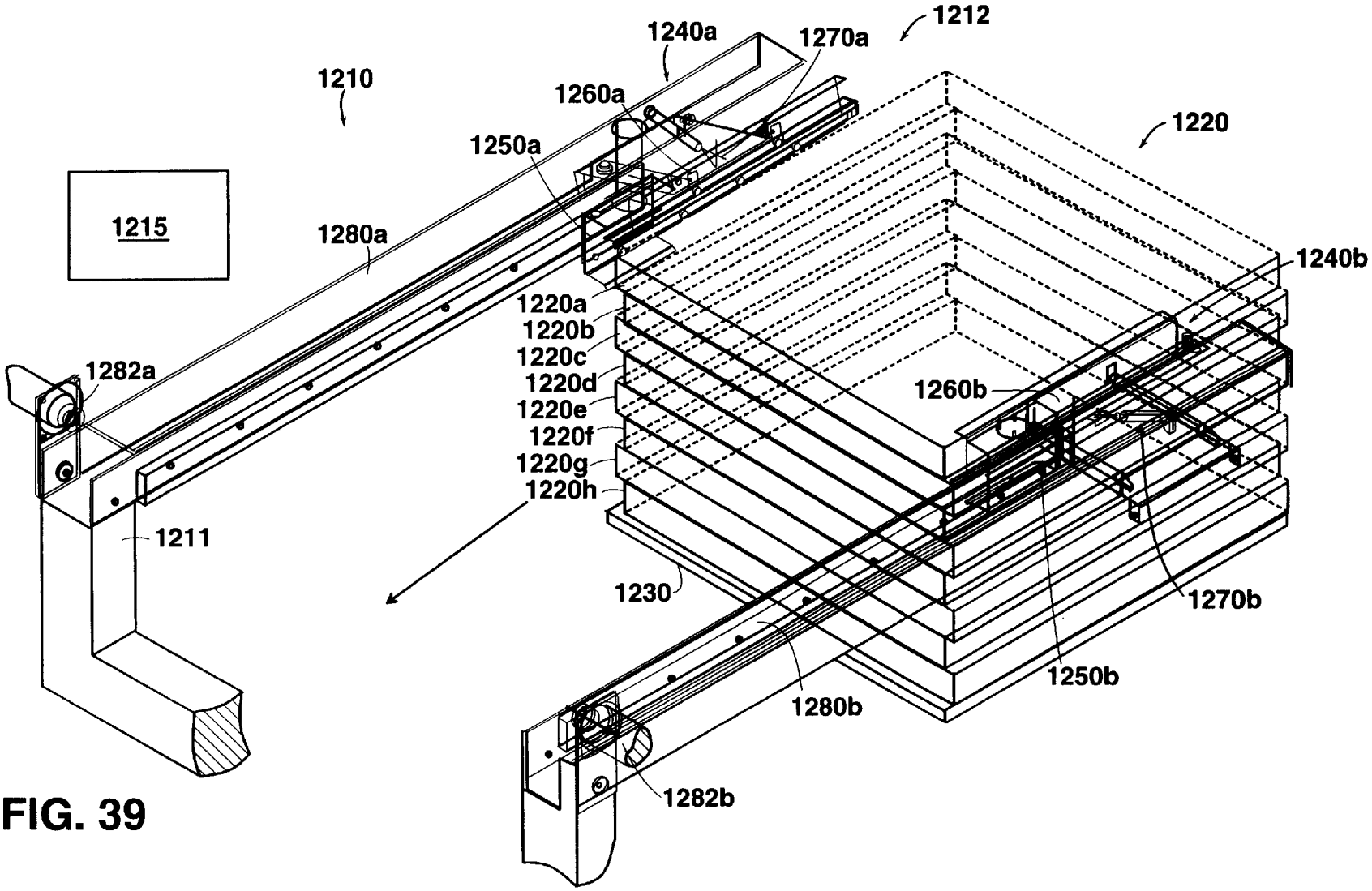
FIG. 39 is a perspective view of another sheet set feeder.

Another top-feeding sheet set feeder 1210 is shown in FIG. 39. Feeder 1210 includes a controller 1215 (e.g., a microprocessor controller and associated circuitry), a housing 1211, and a hopper 1212 for receiving a stack 1220 comprised of offset-jogged sheet sets 1220*a*, 1220*b*, 1220*c*, 1220*d*, 1220*e*, 1220*f*, 1220*g*, 1220*h*. Adjustable sheet set guides (not shown) can be manually or automatically adjusted in accordance with the dimensions of the stack 1220. An elevator 1230 at the bottom of the hopper supports the stack 1220. The elevator 1230 is moved up and down by an elevator mechanism, e.g., similar to elevator mechanism 1028.

The sheet set feeder 1210 includes two linear rails 1280*a*, 1280*b*. A left set transporter 1240*a* and a right set transporter 1240*b*, described in further detail below, are carried by respective left and right rails 1280*a*, 1280*b*, and are shuttled back-and-forth along the rails 1280*a*, 1280*b* by, e.g., respective reversible left and right electric motors 1282*a*, 1282*b*. The rails lie parallel to the offset-jogged ends of the stack 1220. To stabilize the stack against the sheet set guides, the entire sheet set feeder 1210 is tilted 15° with respect to the horizontal ground in the feed direction, i.e., such that the electric motors 1282*a*,1282*b* lie at a lower point than the stack end of the rails.

Figure 40:
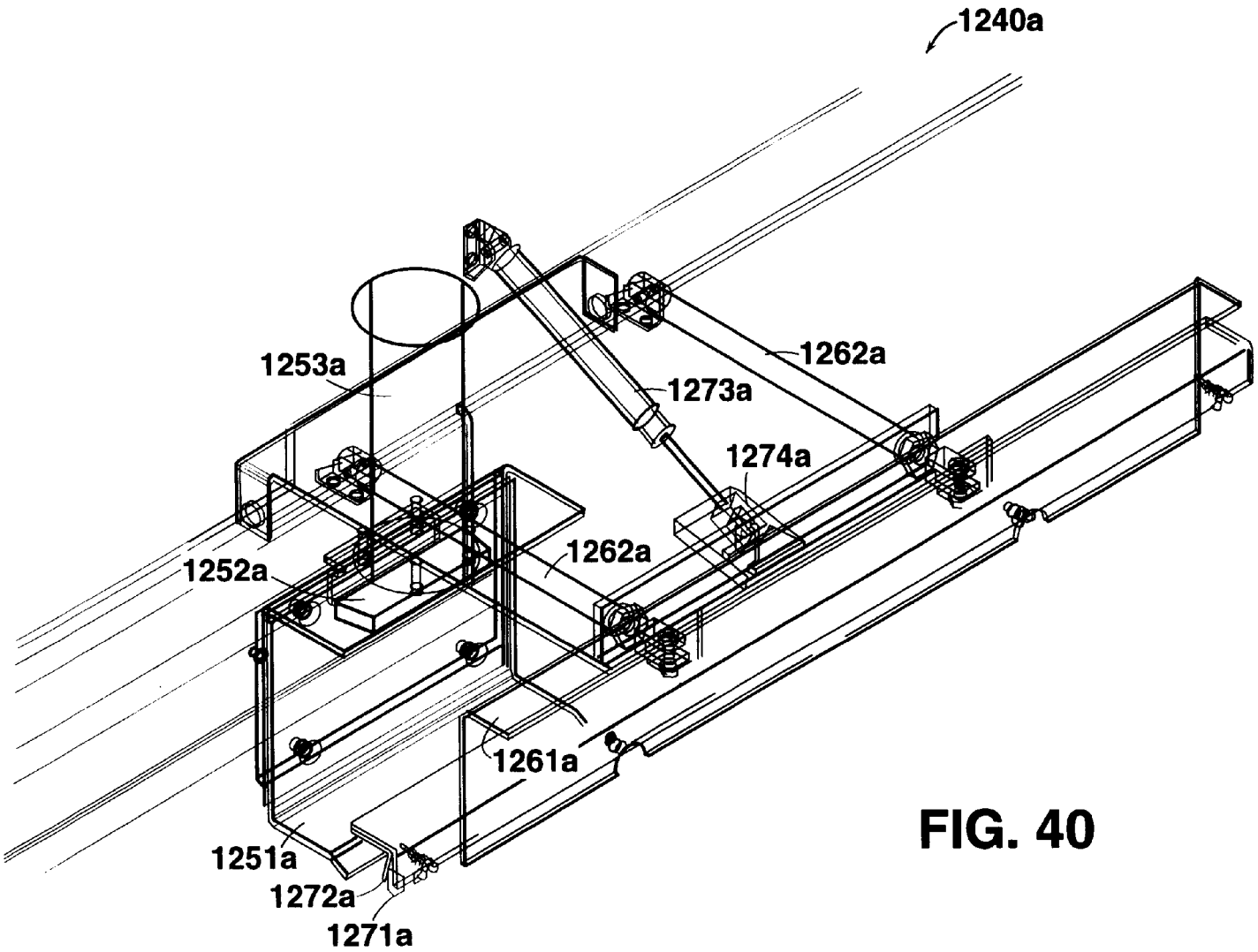
FIG. 40 is detail perspective view of the sheet set feeder shown in FIG. 39.
Figure 41:
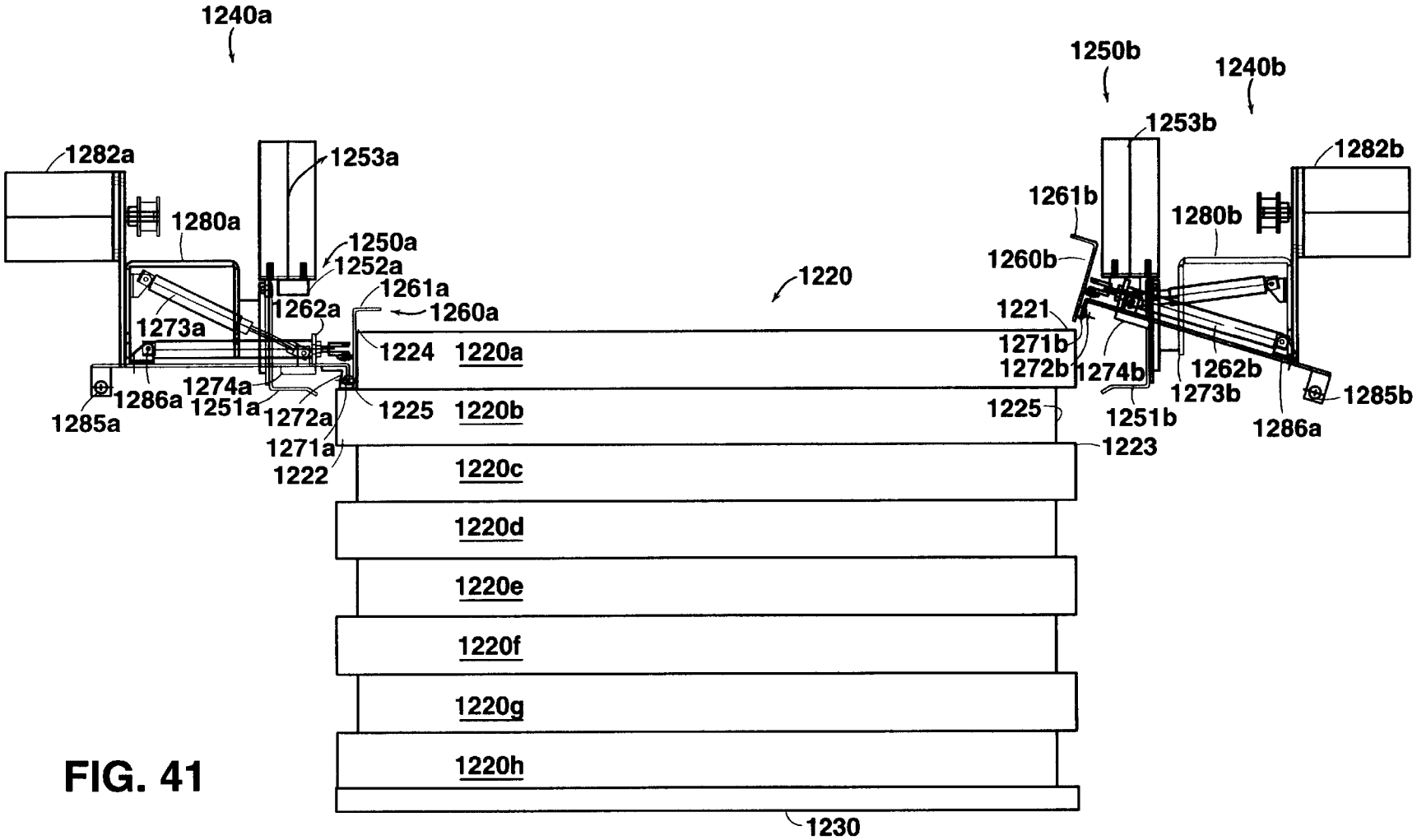
FIGS. 41–48 are side views of the sheet set feeder shown in FIG. 39 in various phases of operation.

A perspective view of the left set transporter 1240*a* is shown in FIG. 40. As shown in FIG. 41, the right set transporter 1240*b* is identical to, although the mirror-opposite of, the left set transporter 1240*a*. Each set transporter includes a gripper 1250*a*, a depressor arm 1270*a*, and a pusher arm 1260*a*.

The gripper 1250*a* includes a fixed lower jaw 1251*a* and a moveable upper jaw 1252*a*. When activated, an air cylinder 1253*a* (alternatively, an electric solenoid) moves the upper jaw towards the lower jaw.

The depressor arm 1270*a* pivots about a hinge 1285*a* with respect to its associated rail 1280*a*. An air cylinder 1273*a* (alternatively, an electric solenoid) connected to the arm prevents it from rotating too far below horizontal, e.g., by more than 20°. The depressor arm 1270*a* further includes a nose 1271*a*, a level sensor 1274*a*, and an air nozzle 1272*a*. The nose 1271*a* projects downward and contacts the top surface of the projecting left end of the next-to-topmost set (e.g., set 1220*b* in FIGS. 40 and 41). When the depressor arm rotates, the level sensor 1274*a* sends a signal to the controller 1215 when the bottom of the nose 1271*a* is level with the bottom jaw 1251*a* of the gripper 1250*a*. Level sensor 1274*a* can be, e.g., a mercury switch, a contact switch, a potentiometer on hinge 1285*a*, a proximity sensor, or a photosensor. The air nozzle 1272*a* is located next to the nose 1271*a*, and is positioned to direct a controlled air blast towards the stack 1220, as described in further detail below. The cylinder 1273*a* has two modes of activation, extension and retraction. When extended, the cylinder rotates the depressor arm clockwise. When retracted, the cylinder rotates the depressor arm counterclockwise. When retracted, the depressor arm 1270*a* is moved up and out of the way of the topmost set 1220*a*.

The pusher arm 1260*a* includes a plow 1261*a* and an air cylinder 1262*a* (alternatively, an electric solenoid). When activated and deactivated, the cylinder moves the plow 1261*a* horizontally in and out with respect to the recessed left end 1224 of the topmost sheet set (e.g., set 1220*a* in FIGS. 40 and 41). The pusher arm 1260*a* pivots with respect to the depressor arm 1270*a* about a hinge 1286*a*. The depressor arm 1270*a* stops the pusher arm 1260*a* from rotating clockwise below the depressor arm 1270*a*, and when the depressor arm 1270*a* rotates counterclockwise, the pusher arm 1260*a* rotates counterclockwise with it.

In operation, the stack 1220 is placed into the hopper 1212 so that the bottommost set 1220*h* rests on the elevator 1230, as shown in FIG. 41. The controller 1215 then operates the elevator 1230 to raise the stack 1220. When the projecting right end 1221 of the topmost set 1220*a* contacts the right nose 1271*b* of the right depressor arm 1270*b*, the right depressor arm 1270*b* rotates clockwise, causing the associated level sensor 1274*b* to signal the controller 1215 that the gripper 1250*b* in the right set transporter will be used to remove the topmost set 1220*a* from the stack 1220. Accordingly, the controller 1215 then sends a signal to retract the cylinder 1273*b*, pivoting the right depressor arm 1270*b* (and thus also the pusher arm 1260*b*) clockwise up out of the way, as shown in FIG. 41.

The elevator 1230 continues to lift the stack 1220 until the top surface of the left projecting end 1222 of the next-to-topmost set 1220*b* contacts the nose 1271*a* of the left depressor 1270*a*, rotating it counterclockwise. When the nose 1271*a* is level with the bottom jaw 1251*a* of the left gripper 1250*a*, the level sensor 1274*a* signals the controller 1215, indicating that the top surface of the projecting end 1222 of the next-to-topmost set 1220*b* is level with the lower jaw 1251*a* of the left gripper 1250*a*. The controller 1215 then stops the elevator mechanism.

The controller 1215 then sends a signal that causes the air cylinder 1273*a* on the left depressor 1270*a* to extend, forcing the nose 1271*a* onto the projecting end 1222 of the next-to-topmost set 1220*b*. This creates a small gap 1226 between the bottom surface of the recessed end of the topmost set 1220*a*, and the top surface of the projecting end 1222 of the next-to-topmost set 1220*b*. The controller 1215 then causes an air blast to be directed from the left air nozzle 1272*a* into the gap 1226, e.g., by opening a controllable pneumatic valve between the air nozzle and a pressure source. This air blast tends to "float" the topmost set 1220*a* on the next-to-topmost set 1220*b*.

Figure 42:
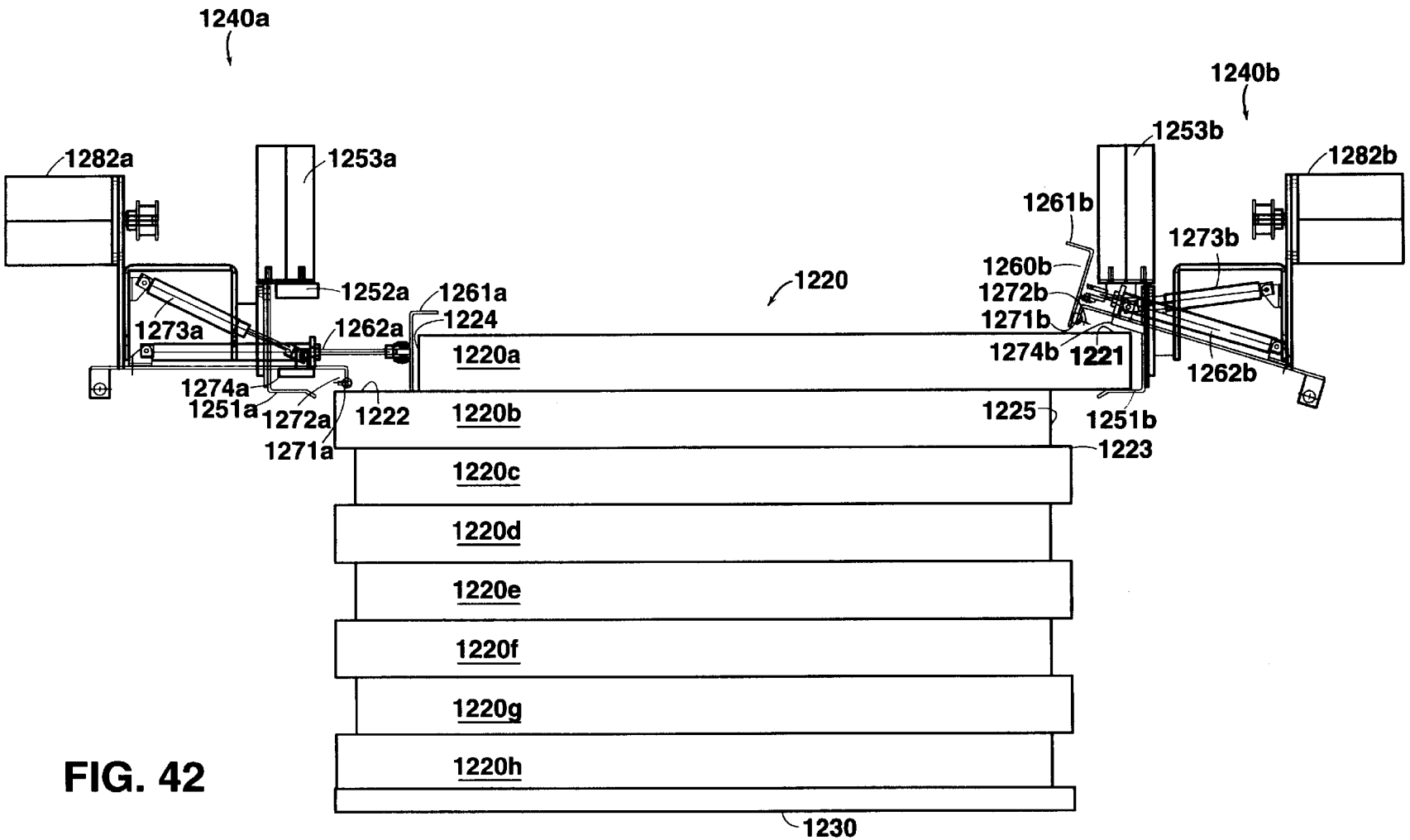
Figure 43:
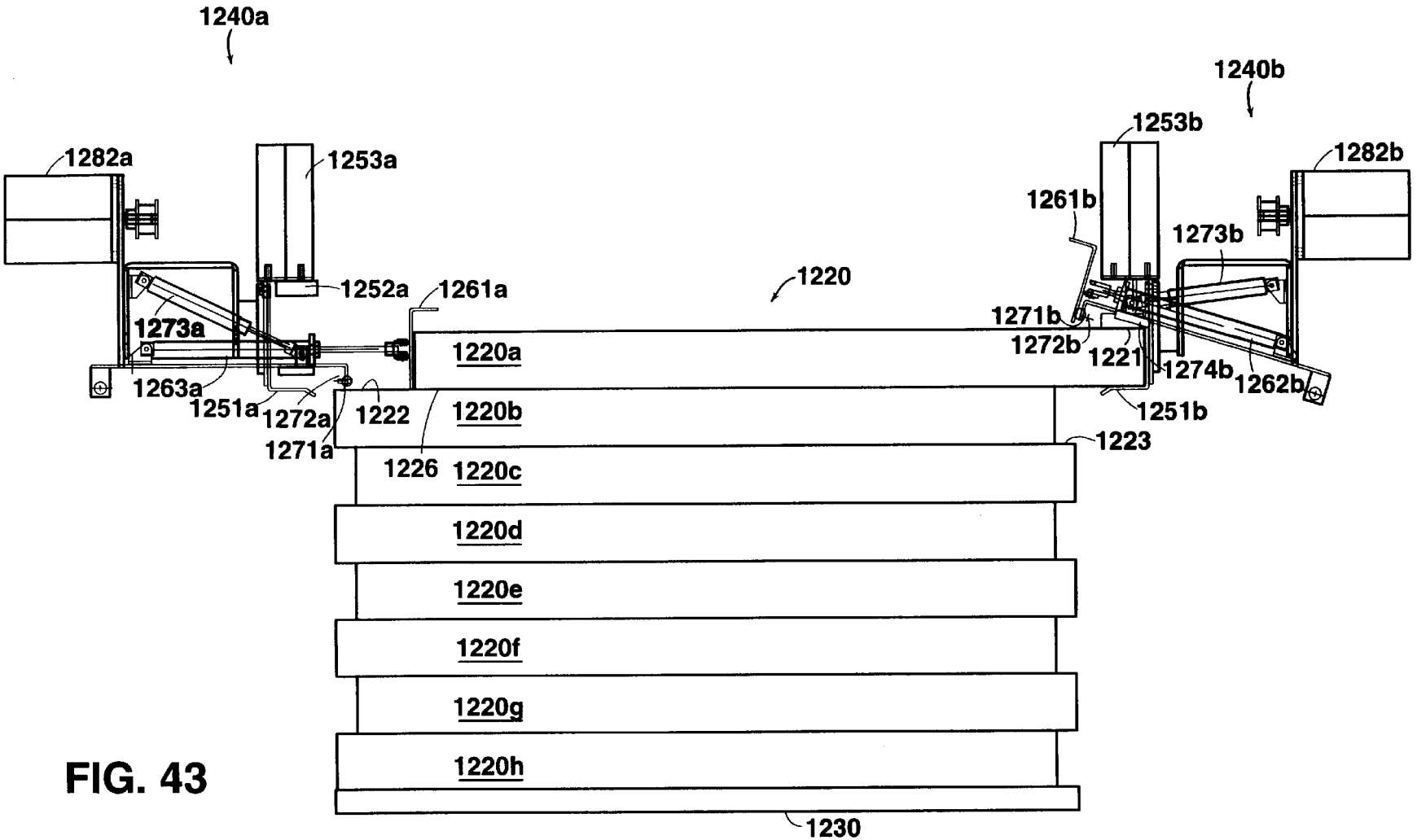
Figure 44:
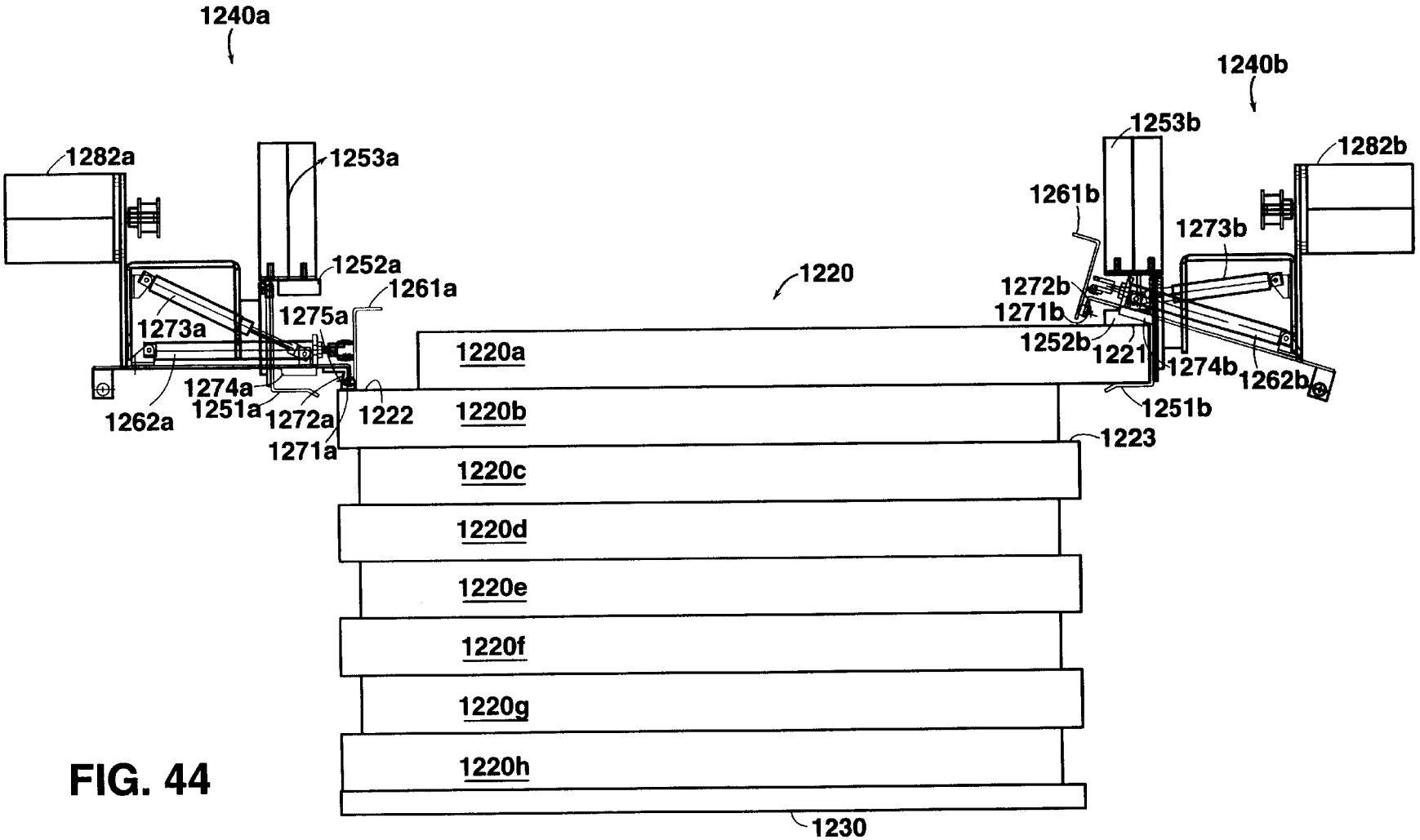
Figure 45:
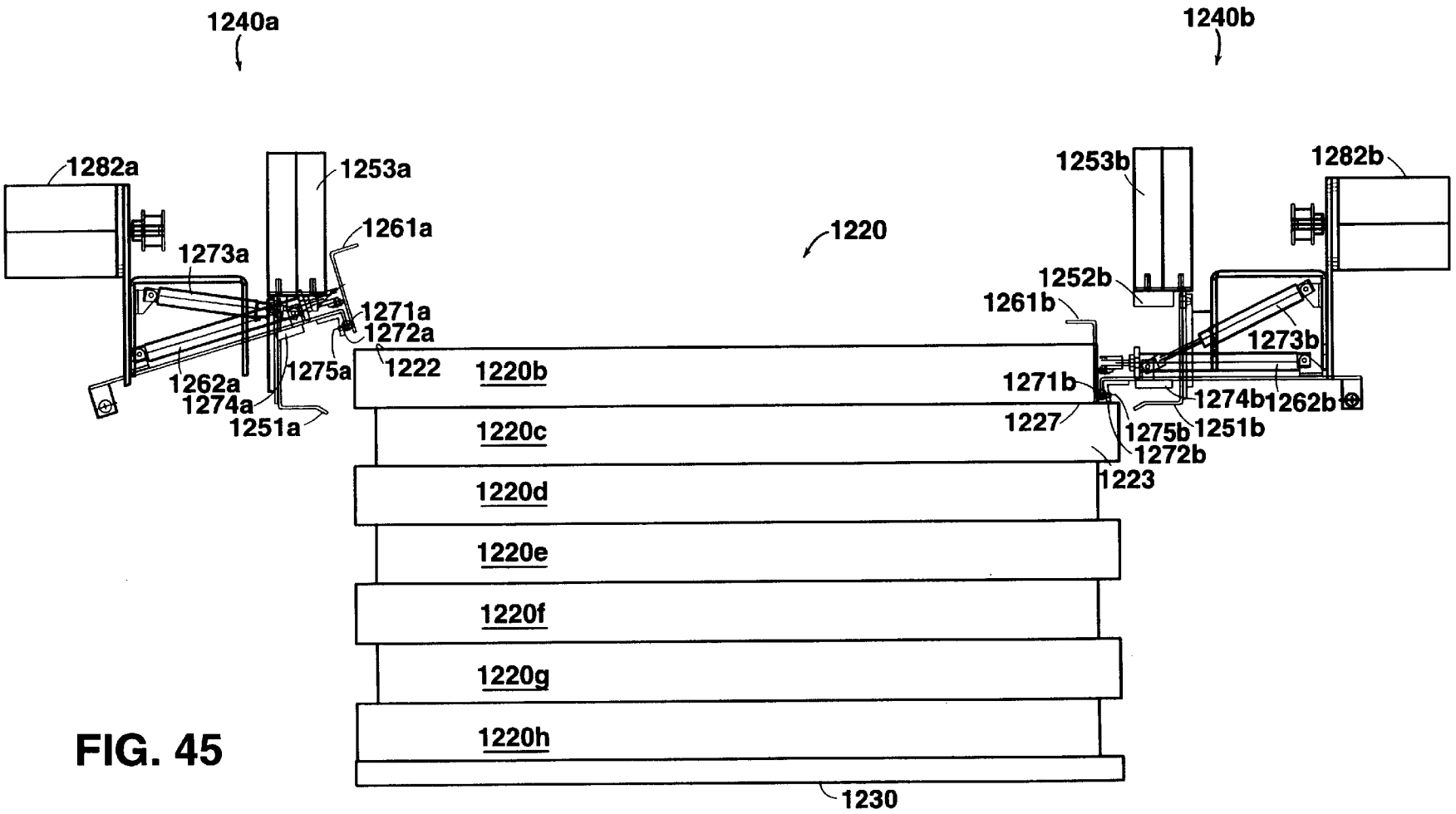
Figure 46:
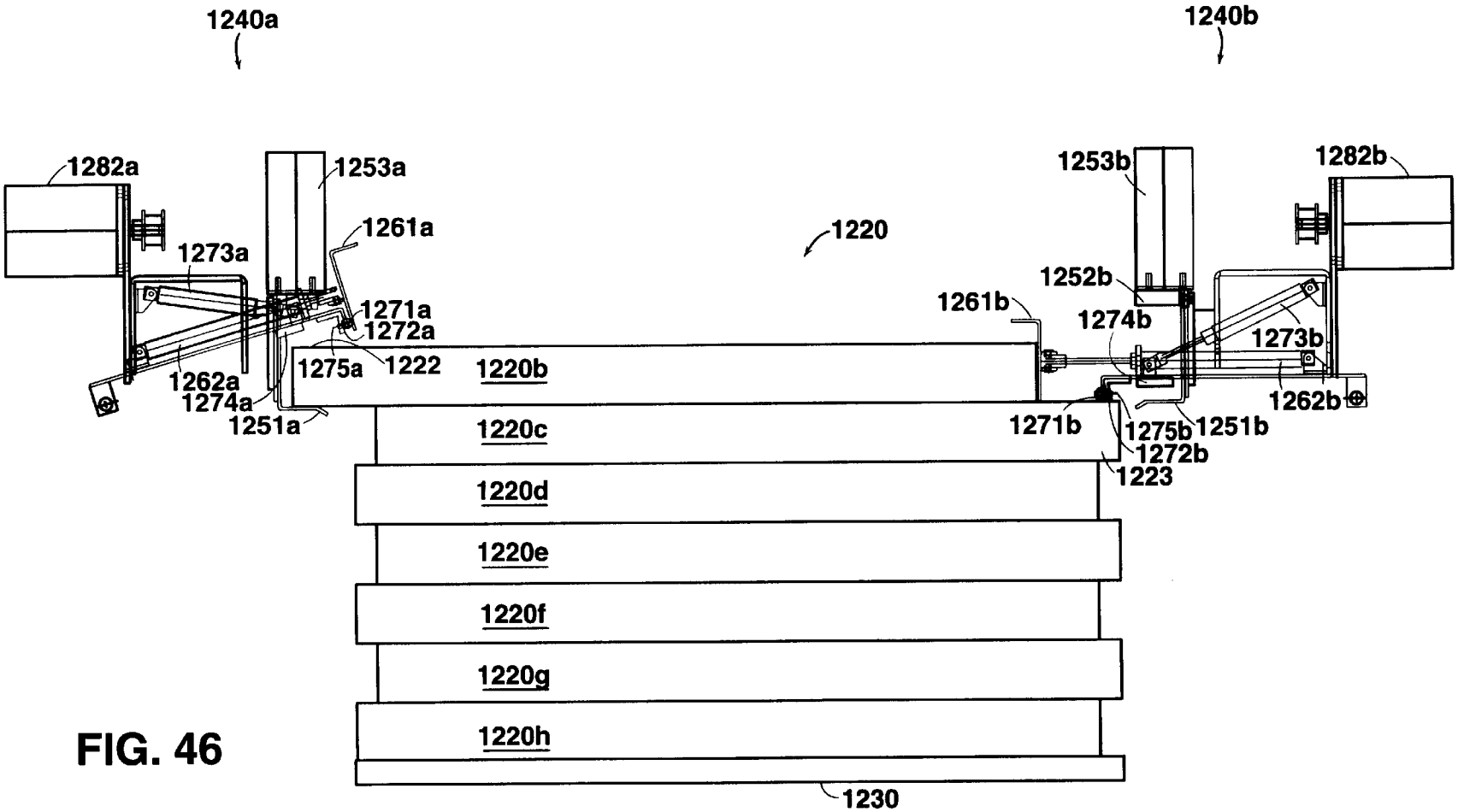
Figure 47:
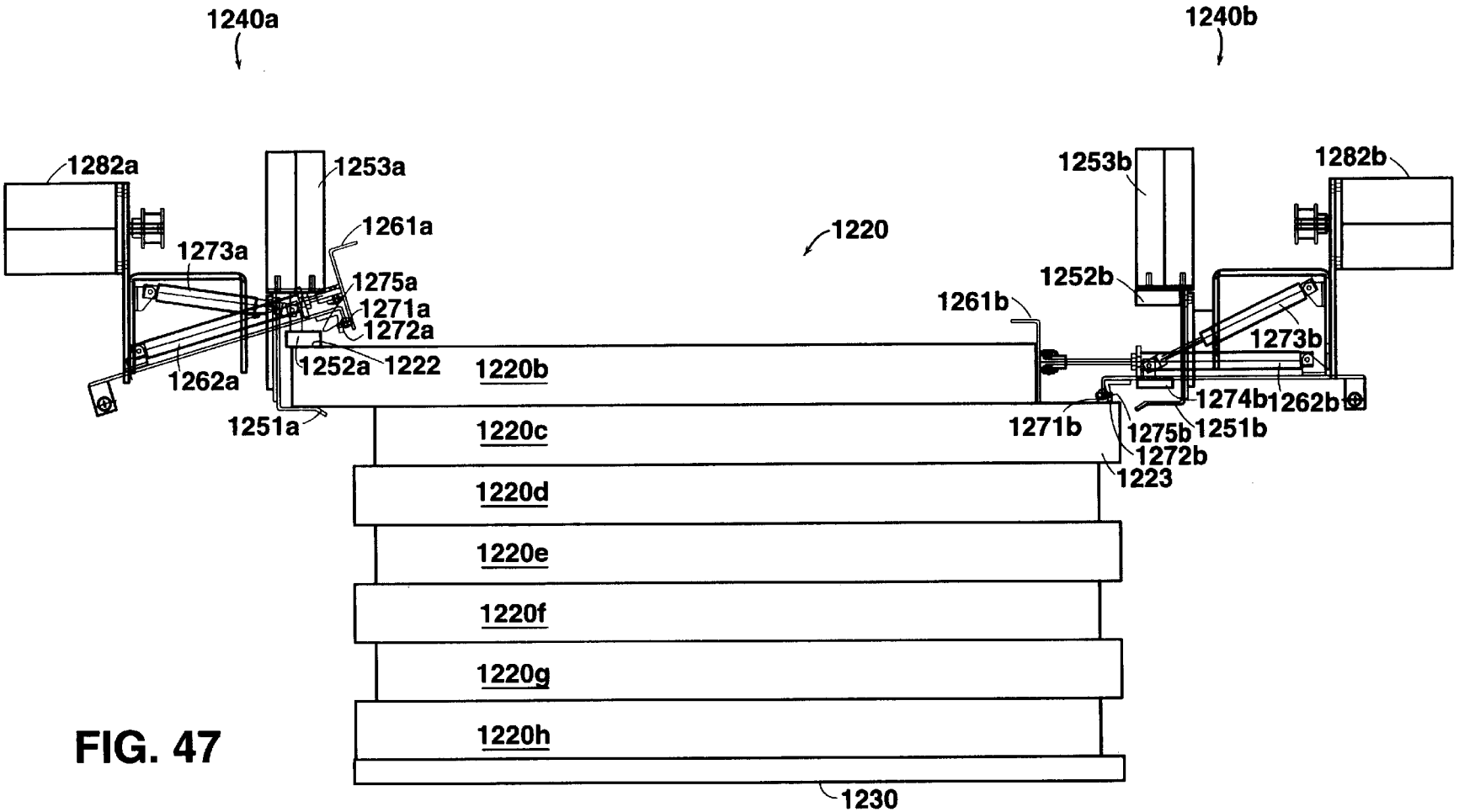
Figure 48:
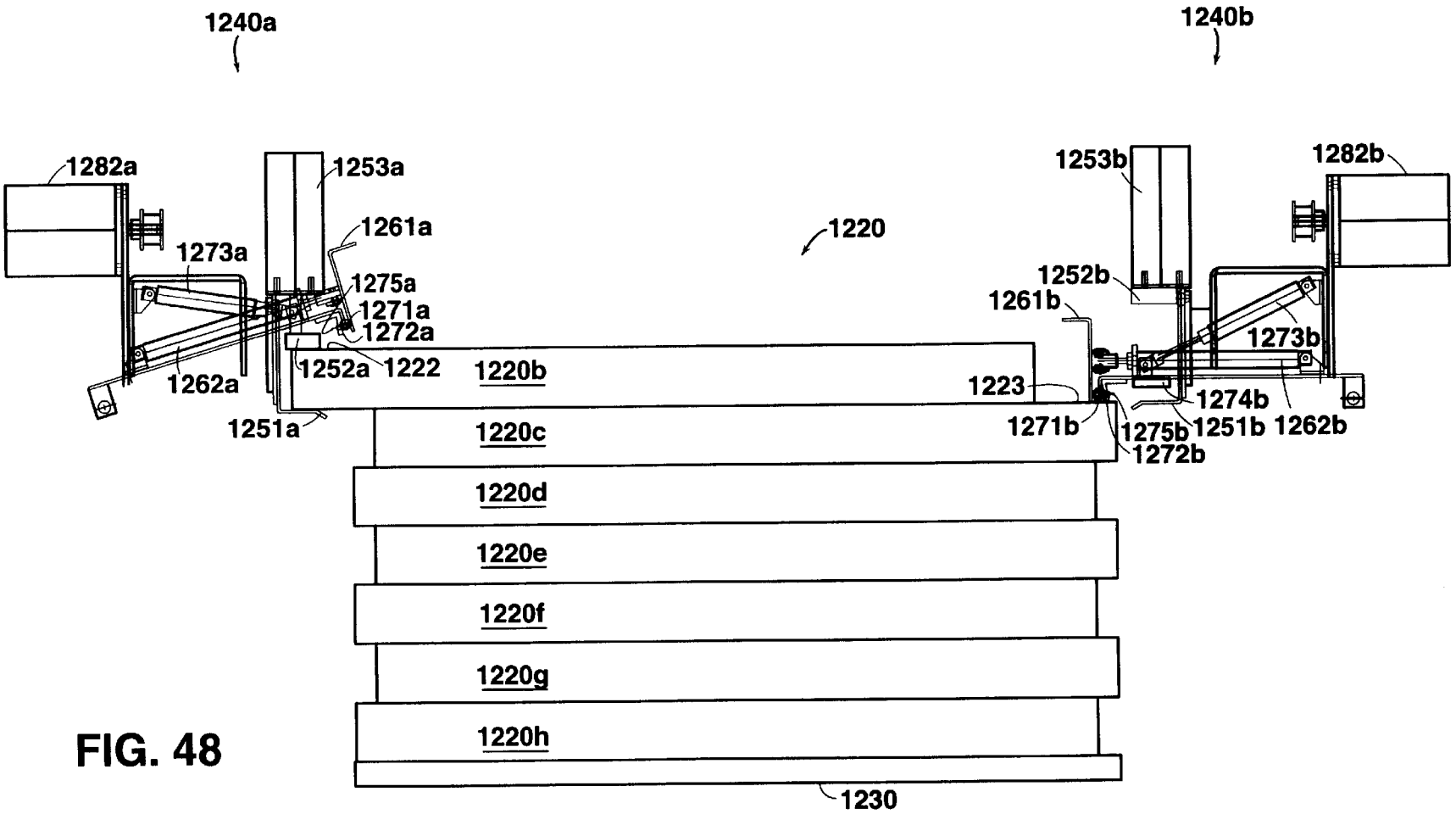

During this air blast, the controller activates the cylinder 1262*a* to move the left plow 1261*a* into contact with the recessed end of the topmost set 1220*a*, as shown in FIG. 42. The left plow 1261*a* pushes the topmost set 1220*a* until sensors, such as sensors 1060, 1062 in FIG. 34A, indicate that the right projecting end 1221 of the topmost set 1220*a* has been pushed into the jaws of the right gripper 1250*b*. When it does, the controller 1215 deactivates the cylinder 1262*a* to stop extension of the plow 1261*a* and also activates the air cylinder 1253*b* to move the upper jaw 1252*b* of the right gripper 1250*b* towards the lower jaw 1251*b*, grasping the topmost set 1220*a*, as shown in FIG. 43. The controller then signals the air cylinder 1262*a* to retract the left plow 1261*a*, as shown in FIG. 44.

Once the right gripper 1250*b* has grasped the topmost set 1220*a*, depressor 1270*a* continues to hold the projecting end 1222 of the next-to-topmost set 1220*b* and the electric motor 1282*b* is activated to pull the topmost set 1220*a* completely off the stack 1220 in a direction transverse to the direction in which the plow 1261*a* travels. In a manner described above, the topmost set 1220*a* is transferred to a conveyor for further processing, and the gripper 1250*b* returns to its starting position next to the stack 1220. The controller sends a signal that causes the air cylinder 1273*a* on the left depressor 1270*a* to retract to its starting position.

The next set 1220*b* (formerly the next-to-topmost set, now the topmost set) is removed from the stack 1220 in a process similar to that described above, except that the right pusher arm 1260*b* and the right depressor arm 1270*b* are used to slide the set 1220*b* into the jaws of the left gripper 1250*a*. Then the left gripper 1250*a* is closed and moved along the left rail 1282*a* to completely remove the set from the stack, as shown in FIGS. 45–48. The remaining sets are removed in a similar manner.

What is claimed is:

1. A method for feeding sheet sets comprising:

loading a hopper with a stack of sheet sets comprising a first sheet set having an end, a second sheet set having an end, and a third sheet set having an end, the first sheet set being disposed on top of the second sheet set and the second sheet set being disposed on top of the third sheet set, the end of the first sheet set being offset-jogged with respect to the end of the second sheet set and the end of the second sheet set being offset-jogged with respect to the end of the third sheet set;

engaging and mechanically grasping the first sheet set and removing it from the stack of sheet sets;

maintaining the offset-jogged relationship between the end of the second sheet set and the end of the third sheet set while the first sheet set is being removed from the stack of sheet sets.

2. The method as recited in claim 1 further comprising detecting the presence of the first sheet set at a predetermined level.

3. The method as recited in claim 2 further comprising moving the second sheet set to the predetermined level after the first sheet set has been removed from the stack of sheet sets.

4. The method as recited in claim 3 further comprising engaging and mechanically grasping the second sheet set and removing the second sheet set from the stack of sheet sets.

5. The method as recited in claim 4 further comprising holding the third sheet set while the second sheet set is being removed from the stack of sheet sets.

6. The method as recited in claim 1 wherein at least some of the sheets in the first sheet set and the second sheet set bear printed indicia.

7. The method as recited in claim 1 wherein the plurality of sheets in each of the first sheet set and the second sheet are rectangular.

8. The method as recited in claim 1 wherein the plurality of sheets in each of the first sheet set and the second sheet comprise paper sheets.

9. The method as recited in claim 1 wherein the step of holding the second sheet set comprises pressing down on a top surface of the second sheet set.

10. A method for feeding sheet sets comprising:

loading a hopper with a stack of sheet sets comprising a first sheet set having an end, a second sheet set having an end, and a third sheet set having an end, the first sheet set being disposed on top of the second sheet set and the second sheet set being disposed on top of the third sheet set, the end of the first sheet set being offset-jogged with respect to the end of the second sheet set and the end of the second sheet set being offset-jogged with respect to the end of the third sheet set;

detecting the presence of the first sheet set at a predetermined level;

holding the second sheet set to substantially maintain the offset-jogged relationship between the end of the second sheet set and the end of the third sheet set;

while the second sheet set is being held, engaging and mechanically grasping the first sheet set and removing the first sheet set from the stack of sheet sets;

moving the second sheet set to the predetermined level after the first sheet set has been removed from the stack of sheet sets;

engaging and mechanically grasping the second sheet set and removing the second sheet set from the stack of sheet sets, wherein the second sheet set is removed from the stack of sheet sets by moving it in a direction opposite to the direction in which the first sheet set was moved to remove it from the stack of sheet sets.

* * * * *

UNITED STATES PATENT AND TRADEMARK OFFICE
CERTIFICATE OF CORRECTION

PATENT NO. : 6,126,384

DATED : OCTOBER 3, 2000

INVENTOR(S) : THOMAS E. WEEKS, GILBERT G. FRYKLUND AND MR. JAMES A. DARCY

It is certified that error appears in the above-identified patent and that said Letters Patent is hereby corrected as shown below:

Col. 10, line 19, after FIG, insert –15--.

Signed and Sealed this

Eighth Day of May, 2001

*Attest:*

Nicholas P. Godici

NICHOLAS P. GODICI

*Attesting Officer*

*Acting Director of the United States Patent and Trademark Office*